US007129033B2

(12) United States Patent
Mori

(10) Patent No.: US 7,129,033 B2
(45) **Date of Patent: *Oct. 31, 2006**

(54) PHOTOTHERMOGRAPHIC MATERIAL AND IMAGE FORMING METHOD

(75) Inventor: Takayoshi Mori, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/196,451

(22) Filed: Aug. 4, 2005

(65) Prior Publication Data

US 2006/0035178 A1 Feb. 16, 2006

(30) Foreign Application Priority Data

Aug. 9, 2004 (JP) ..... 2004-232751

(51) Int. Cl.

| | |
|---|---|
| ***G03C 1/00*** | (2006.01) |
| ***G03C 1/005*** | (2006.01) |
| ***G03C 1/494*** | (2006.01) |
| ***G03C 5/16*** | (2006.01) |
| ***G03C 5/00*** | (2006.01) |

(52) U.S. Cl. ..... 430/617; 430/618; 430/619; 430/620; 430/567; 430/966; 430/967; 430/348; 430/350

(58) Field of Classification Search ..... 430/617–620, 430/567, 966, 967, 348, 350
See application file for complete search history.

(56) References Cited

U.S. PATENT DOCUMENTS

| | | | | |
|---|---|---|---|---|
| 2005/0069827 | A1* | 3/2005 | Nariyuki et al. | 430/619 |
| 2005/0079457 | A1* | 4/2005 | Naruyuki | 430/619 |
| 2005/0118542 | A1* | 6/2005 | Mori et al. | 430/619 |
| 2005/0208437 | A1* | 9/2005 | Ohzeki | 430/619 |

FOREIGN PATENT DOCUMENTS

| | | |
|---|---|---|
| JP | 11-133531 | 5/1999 |

* cited by examiner

*Primary Examiner*—Geraldine Letscher
(74) *Attorney, Agent, or Firm*—Sheldon J. Moss; Margaret A. Burke

(57) ABSTRACT

A photothermographic material having, on at least one side of a support, an image forming layer containing at least a photosensitive silver halide, a non-photosensitive organic silver salt, a reducing agent, and a binder, and an X-ray image forming method using the same, wherein 50% or more of a total projected area of the photosensitive silver halide is occupied by tabular grains having an aspect ratio of 2 or more, and the grains have at least one epitaxial junction portion having a multifold structure. A photothermographic material with high sensitivity and excellent storage stability, and an image forming method using the material are provided.

17 Claims, No Drawings

PHOTOTHERMOGRAPHIC MATERIAL AND IMAGE FORMING METHOD

CROSS-REFERENCE TO RELATED APPLICATION

This application claims priority under 35 USC 119 from Japanese Patent Application No. 2004-232751, the disclosure of which is incorporated by reference herein.

BACKGROUND OF THE INVENTION

1. Field of the Invention

The present invention relates to a photothermographic material using a tabular silver halide photographic emulsion having an epitaxial junction and an image forming method.

2. Description of the Related Art

In recent years, in the medical field and the graphic arts field, there has been a strong desire for providing a dry photographic process from the viewpoints of protecting the environment and economy of space. Further, the development of digitization in these fields has resulted in the rapid development of systems in which image information is captured and stored in a computer, and then when necessary processed and output by transmitting it to a desired location. Here the image information is output onto a photosensitive material using a laser image setter or a laser imager, and developed to form an image at the location. It is necessary for the photosensitive material to be able to record an image with high-intensity laser exposure and that a clear black-tone image with a high resolution and sharpness can be formed. While various kinds of hard copy systems using pigments or dyes, such as ink-jet printers or electrophotographic systems, have been distributed as general image forming systems using such digital imaging recording materials, images on the digital imaging recording materials obtained by such general image forming systems are insufficient in terms of the image quality (sharpness, granularity, gradation, and tone) needed for medical images used in making diagnoses, and high recording speeds (sensitivity). These kinds of digital imaging recording materials have not reached a level at which they can replace medical silver halide film processed with conventional wet development.

Photothermographic materials utilizing organic silver salts are already known. Photothermographic materials have an image forming layer in which a reducible silver salt (for example, an organic silver salt), a photosensitive silver halide, and if necessary, a toner for controlling the color tone of developed silver images are dispersed in a binder.

Photothermographic materials form a black silver image by being heated to a high temperature (for example, 80° C. or higher) after imagewise exposure to cause an oxidation-reduction reaction between a silver halide or a reducible silver salt (functioning as an oxidizing agent) and a reducing agent. The oxidation-reduction reaction is accelerated by the catalytic action of a latent image on the silver halide generated by exposure. As a result, a black silver image is formed on the exposed region. There is much literature in which photothermographic materials are described, and the Fuji Medical Dry Imager FM-DPL is an example of a medical image forming system that has been made commercially available.

Since this kind of image forming system utilizing an organic silver salt has no fixing step, undeveloped silver halide remains inside the film after thermal development. Thus, there have intrinsically been two serious problems in the system.

One of them involves image instorability after a thermal developing process, particularly fogging due to print-out when the material is exposed to light. As a means to improve print-out, a method of using silver iodide is known. Silver iodide has the characteristic of causing less print-out than silver bromide or silver iodobromide having an iodide content of 5 mol % or less, and has a potential for fundamentally solving the problem. However, the sensitivity of silver iodide grains known until now is extremely low, and the silver iodide grains do not achieve a level of sensitivity that is applicable for an actual system. When means of preventing recombination between photoelectrons and holes is performed to improve the sensitivity, it is an inherent problem that the characteristic of being excellent in the print-out property will be lost.

As means of increasing the sensitivity of a silver iodide photographic emulsion, the literature such as Journal of Photographic Science, vol. 8, page 119, 1960, Journal of Photographic Science, vol. 28, page 163, 1980, Photographic Science And Engineering, vol. 5, page 216, 1961, and the like disclose addition of a halogen acceptor such as sodium nitrite, pyrogallol, hydroquinone or the like, immersion in an aqueous silver nitrate solution, sulfur sensitization at a pAg of 7.5, and the like. However, the effect of these halogen acceptors is very small and insufficient for practical use.

Another problem is that light scattering due to the remaining silver halide grains may cause cloudiness whereby the film turns translucent or opaque and image quality is degraded. To solve this problem, means in which the grain size of photosensitive silver halide grains is made fine (to within a range of practical use of 0.08 μm to 0.15 μm) and the addition amount is reduced as much as possible to suppress the cloudiness caused by the silver halide have been practically employed. However, the compromise results in decreasing the sensitivity further, the problem of cloudiness is not completely solved, and a dark milky color continues to remain and generate haze in the film.

In the case of a conventional wet developing process, the remaining silver halide is removed by processing with a fixing solution containing a silver halide solvent after the developing process. For the silver halide solvent, many kinds of inorganic and organic compounds are known which can form complexes with silver ions. Even in the case of a dry thermal developing process, many attempts to introduce similar fixing measures in the material have been made. For example, a method has been proposed where a compound capable of forming complexes with silver ions is incorporated in the film and the silver halide is solubilized (usually referred to as fixing) through thermal development. However, this proposal only applies to silver bromide and silver chlorobromide, and the process also requires an additional heat treatment step for fixing, and the heating conditions require a high temperature within a range of from 155° C. to 160° C. Thus, the system is one in which fixing is difficult to achieve.

In another proposal, a separate sheet (referred to as a fixing sheet) that includes a compound able to form complexes with silver ions is prepared, and after thermally developing the photothermographic material to form an image, the fixing sheet is overlaid on the developed photothermographic material, heating is carried out, and the remaining silver halide is dissolved and removed. However, since this proposal requires two sheets, from a practical viewpoint the obstacles are that the processing step is complicated and the operational stability of the process is hard to maintain, and that there is a necessity to discard the fixing sheets after processing, resulting in generation of waste.

As another fixing method usable in thermal development, a method is proposed where a fixing agent for the silver halide is encapsulated in microcapsules, and thermal development releases the fixing agent and causes it to act. However, it is difficult to achieve a design that effectively releases the fixing agent. A method for fixing using a fixing solution after thermal development is also proposed, but it requires a wet process and therefore is not adequate for a completely dry process.

As described above, known methods for improving the turbidity of film have negative effects, and there have been substantial difficulties in their practical application.

On the other hand, attempts have also been made at applying the above-mentioned photothermographic material as photosensitive material for photographing. The term "photosensitive material for photographing" as used herein means a photosensitive material on which images are recorded by a one-shot exposure through a lens, rather than by writing the image information by a scanning exposure with a laser beam or the like. Conventionally, photosensitive materials for photographing are generally known in the field of wet developing photosensitive materials, and include films for medical use such as direct or indirect radiography films, mammography films and the like, various kinds of photomechanical films used in printing, industrial recording films, films for photographing with general-purpose cameras, and the like.

For example, an X-ray photothermographic material coated on both sides using a blue fluorescent intensifying screen, a photothermographic material containing tabular silver iodobromide grains described in Japanese Patent Application Laid-Open (JP-A) No. 59-142539, and a photosensitive material for medical use containing tabular grains that have a high content of silver chloride and have (100) major faces, and that are coated on both sides of a support, which is described in JP-A No. 10-282606, are known. Double-sided coated photothermographic materials are also disclosed in JP-A Nos. 2000-227642, 2001-22027, 2001-109101, and 2002-90941.

However, according to these disclosed examples, fine silver halide grains having a grain size of 0.1 μm or less are used, and the sensitivity is very low. Therefore, it has been difficult to obtain a sensitivity required for use in photographing. On the other hand, in the case of using silver halide grains having a grain size of 0.3 μm or more, because the remaining silver halide may increase the haze and worsen the print-out, deterioration of the image quality is severe, and the grains are not applicable for practical use.

SUMMARY OF THE INVENTION

A first aspect of the invention is to provide a photothermographic material comprising, on at least one side of a support, an image forming layer comprising at least a photosensitive silver halide, a non-photosensitive organic silver salt, a reducing agent, and a binder, wherein 50% or more of a total projected area of the photosensitive silver halide is occupied by tabular grains having an aspect ratio of 2 or more, and the grains have at least one epitaxial junction portion having a multifold structure.

A second aspect of the invention is to provide an image forming method using a photothermographic material comprising, on both sides of a support, an image forming layer comprising at least a photosensitive silver halide, a non-photosensitive organic silver salt, a reducing agent, and a binder, wherein 50% or more of a total projected area of the photosensitive silver halide is occupied by tabular grains having an aspect ratio of 2 or more, and the grains have at least one epitaxial junction portion having a multifold structure, wherein the method comprises:

(a) providing an assembly for forming an image by placing the photothermographic material between a pair of fluorescent intensifying screens, (b) putting an analyte between the assembly and an X-ray source, (c) irradiating the analyte with X-rays having an energy level in a range of 25 kVp to 125 kVp, (d) taking the photothermographic material out of the assembly, and (e) heating the removed photothermographic material in a temperature range of 90° C. to 180° C.

DETAILED DESCRIPTION OF THE INVENTION

An object of the present invention relates to a photothermographic material and an image forming method which exhibit high sensitivity and excellent storability.

It is well known in the art that introduction of an epitaxial junction can improve the sensitivity of silver halide grains. However, the use of tabular silver halide grains as the photosensitive silver halide for a photothermographic material may present problems such as insufficient increase in sensitivity and change in photographic properties during storage of the photothermographic material.

As a result of intense research regarding an epitaxial junction portion which can attain high sensitivity and excellent storage stability while overcoming the above-described problems, the inventor found that the use of an epitaxial junction portion having a multifold structure is effective in solving the problems described above, and thereby arrived at the present invention.

The present invention will be described in detail below.

1. Photothermographic Material (Photosensitive Silver Halide)

The photosensitive silver halide in the present invention comprises tabular grains, wherein 50% or more of the total projected area is occupied by tabular grains having an aspect ratio of 2 or more, and each tabular grain has at least one epitaxial junction portion. Preferably 60% or more, more preferably 70% or more, and most preferably 80% or more of the total projected area is occupied by tabular grains having an aspect ratio of 2 or more and the tabular grains have at least one epitaxial junction portion in a grain. Here, it is advantageous to the enhancement in sensitivity that the epitaxial junctions are formed uniformly among grains.

The photosensitive silver halide grains used for the present invention are explained below in more detail.

1) Tabular Silver Halide Grain

The tabular grain used herein means a silver halide grain having two facing parallel principal planes (hereinafter referred as "tabular grain").

On viewing the tabular grain from the vertical direction with respect to the principal plane, the tabular gain often have a shape such as a hexagonal form, a triangle form, a square form, a rectangular form or a circular form with rounded corner. Any form beside the above forms may be used. However, in order to apply uniformly an epitaxial sensitization among grains, monodisperse in size and form is preferred.

The tabular silver halide grain used in the present invention is defined as a silver halide grain having an aspect ratio (equivalent circular diameter of the major plane/grain thickness) of 2 or more. The equivalent circular diameter of a tabular silver halide grain is determined from a diameter (equivalent circular diameter) of a circle having the same area as projected area of a silver halide grain, for example, measured by photomicrographs of transmission electron microscope image with a replica method. The grain thickness can not be easily derived from a length of the shadow of the replica because of their epitaxial junction portion. However, the thickness may be derived from the measurement of a length of the shadow of the replica before the formation of epitaxial junction portion. Or even after the formation of epitaxial junction portion, the grain thickness can be easily derived from electron photomicrographs of the cross section of sliced specimens of a coated sample containing tabular grains.

The tabular grain in the present invention has an aspect ratio of 2 or more, and preferably the tabular grain used in the present invention has an aspect ratio of 5 or more, more preferably 7 or more, and most preferably 10 or more.

2) Halogen Composition

For the tabular silver halide grains used in the invention, there is no particular restriction on the halogen composition but silver halide grains having a high silver iodide content of 40 mol % or higher are preferably used. Other components are not particularly limited and can be selected from silver halides such as silver chloride, silver bromide, and the like and organic silver salts such as silver thiocyanate, silver phosphate, and the like. Among them, silver bromide, silver chloride, and silver thiocyanate are preferably used. The silver iodide content used herein means a content of silver iodide comprised in silver halide grains including epitaxial portions. Using such silver halide grains having a high silver iodide content, the photothermographic materials exhibiting excellent properties in the image storability after thermal development, especially the remarkable depression of fog increase caused by light exposure can be attained.

The halogen composition of the tabular grains used in the present invention more preferably has a silver iodide content of 80 mol % or higher, and most preferably 90 mol % or higher.

The X-ray diffraction method is well known in the art as for the technique of determination of halogen composition in silver halide crystals. The X-ray diffraction method is fully described in "X-Ray Diffraction Method" of Kiso Bunseki Kagaku Kouza (Lecture Series on Basic Analytical Chemistry), No. 24. Normally, an angle of diffraction is measured by the powder method with copper Kβ radiation as a beam source.

The lattice constant a can be calculated from Bragg's equation by finding the angle of diffraction 2θ as follows.

$$2\underline{d}\sin\theta=\lambda$$

$$\underline{d}=\underline{a}/(h^2+k^2+1^2)^{1/2}$$

wherein, 2θ is an angle of diffraction of (hkl) face, λ is a wavelength of X-ray beam used, d is spacing between (hkl) faces. The relation between the halogen composition of silver halide solid solution and the lattice constant a is already known (for example, described in T. H. James, "THE THEORY OF THE PHOTOGRAPHIC PROCESS, FOURTH EDITION" (Macmillan New York). Therefore, the halogen composition can be determined from the lattice constant obtained.

The tabular grain of the invention can assume any of a β phase or a γ phase. The term "β phase" described above means a high silver iodide structure having a wurtzite structure of a hexagonal system and the term "γ phase" means a high silver iodide structure having a zinc blend structure of a cubic crystal system. An average content of γ phase in the present invention is determined by a method presented by C. R. Berry. In the method, an average content of γ phase is calculated from the peak ratio of the intensity owing to γ phase (111) to that owing to β phase (100), (101), (002) in powder X ray diffraction method. Detail description, for example, is described in Physical Review, volume 161 (No. 3), pages 848 to 851 (1967).

Concerning the tabular grains used in the present invention, the distribution of the halogen composition in a host tabular grain may be uniform or the halogen composition may be changed stepwise, or it may be changed continuously.

Further, a silver halide grain having a core/shell structure can be preferably used. Preferred structure is a twofold to fivefold structure and, more preferably, core/shell grain having a twofold to fourfold structure can be used.

A core-high-silver iodide-structure which has a high content of silver iodide in the core part, and a shell-high-silver iodide-structure which has a high content of silver iodide in the shell part can also be preferably used. In order to attain the photothermographic material exhibiting excellent image storability after development and depression of fog increase caused by light exposure, tabular host grains having a higher silver iodide content are preferred, and more preferred are tabular grains having a silver iodide content of 90 mol % or higher.

3) Grain Size

Concerning the tabular grains used in the present invention, any grain size enough to reach the required high sensitivity can be selected. In the present invention, preferred silver halide grains are those having a mean equivalent spherical diameter of 0.3 μm to 5.0 μm, and more preferred are those having a mean equivalent spherical diameter of 0.35 μm to 3.0 μm. The term "equivalent spherical diameter" used here means a diameter of a sphere having the same volume as the volume of a silver halide grain.

As for measurement method, an equivalent spherical diameter is calculated from measuring equvalent circular diameter and thickness similar to the aforesaid measurement of an aspect ratio.

The smaller equivalent circular diameter and the thinner grain thickness may normally result in increasing the number of grains and broadening the distribution of epitaxial junctions among grains. Thereby, the effect of the present invention becomes more remarkable.

4) Epitaxial Junction Portion

The tabular silver halide grain according to the present invention has at least one epitaxial junction portion having a multifold structure. The multifold structure may be a twofold structure, threefold structure, or higher dimension of multifold structure. One example is a twofold structure consisted of a core part and a shell part, in which preferably the core part has a silver chloride content of 40 mol % or higher and the shell part has a silver chloride content of 30 mol % or lower, and more preferably the core part comprises silver chloride and the shell part comprises silver bromide.

Concerning threefold structure, the epitaxial junction portion is consisted of a core part, an intermediate part, and a shell part, in which preferably at least one of the core part and the intermediate part has a silver iodide content of 4 mol % or higher. More preferably the intermediate part has a silver iodide content of 10 mol % or higher, and even more preferably the core part comprises silver chloride or silver bromide, the intermediate part comprises silver iodide, and the shell part comprises silver bromide, and most preferably the core part comprises silver chloride.

In the present invention, the epitaxial junction portion can be formed onto an apex portion, a major plane, or an edge portion of the tabular grain, and more preferably onto the apex portion. The tabular grain has at least one epitaxial junction portion, preferably two or more epitaxial junction portions, and most preferably four or more epitaxial junction portions.

The tabular grain having an epitaxial junction portion of the present invention preferably has a dislocation line in the epitaxial junction portion. The dislocation line is often formed accidentally in the epitaxial portion caused by the composition difference between the tabular host grain and the epitaxial portion, but the intended introduction of dislocation lines in the grains by controlling the condition for forming the epitaxial junction portion is more preferred.

Here, it is preferred that no dislocation line is substantially observed in the tabular host grain. The coexistence of the dislocation lines in both the tabular host grain and the epitaxial portion is not preferred because the efficiency of latent image formation is depressed to give a low sensitivity.

The surface indices (Miller indices) of the epitaxial portion of the epitaxial tabular grain of the invention is preferable that the ratio occupied by the [100] face is large, because of showing high spectral sensitization efficiency when a spectral sensitizing dye is adsorbed. The ratio is preferably 50% or more, more preferably, 65% or more and, further preferably, 80% or more. The ratio of the [100] face, Miller indices, can be determined by a method described in T. Tani; J. Imaging Sci., vol. 29, page 165, (1985) utilizing adsorption dependency of the [111] face and [100] face in adsorption of a sensitizing dye.

The size of epitaxial junction portion according to the present invention, with respect to host grain portion, is preferably in a range of from 1 mol % to 60 mol %, based on mole of silver ion, more preferably from 3 mol % to 50 mol %, even more preferably from 5 mol % to 30 mol %, and most preferably from 10 mol % to 20 mol %.

5) Coating Amount

Generally, in the case of photothermographic material where silver halide are remained thereon after thermal development, the coating amount of silver halide is limited to a lower level in spite of the requirement for high sensitivity. It is because the increase of the coating amount of silver halide may result in decreasing the film transparency and deteriorating the image quality. However, according to the present invention, more amount of silver halide can be coated because thermal development can decrease the haze of film caused by the residual silver halide. In the present invention, the preferred coating amount is in a range from 0.5 mol % to 100 mol %, per 1 mol of non-photosensitive organic silver salt, and more preferably from 5 mol % to 50 mol %.

6) Method of Grain Formation

The specific method for preparing the above-mentioned silver halide emulsion having an epitaxial junction portion (thereafter, referred as "epitaxial emulsion") of the present invention is described in detail below in two parts, the one is for the preparation of host tabular grain and the other for the preparation of epitaxial junction.

<Method for Forming Host Grain>

The method of forming photosensitive silver halide is well known in the relevant art and, for example, methods described in Research Disclosure No. 10729, June 1978, and U.S. Pat. No. 3,700,458 can be used. Specifically, a method of preparing a photosensitive silver halide by adding a silver-supplying compound and a halogen-supplying compound in a gelatin or other polymer solution and then mixing them with an organic silver salt is used.

Further, a method described in JP-A No. 11-119374 (paragraph Nos. 0217 to 0224) and methods described in JP-A Nos. 11-352627 and 2000-347335 are also preferred. As for the method of forming tabular grains of silver iodide, the method described in JP-A Nos. 59-119350 and 59-119344 are preferably used.

As for the preparation of tabular host grain of the present invention, any grain forming procedure including three steps such as nucleation, ripening, and grain growth, two steps of nucleation and grain growth, and single step combined of nucleation and grain growth is preferably applicable.

The nucleation can be executed in a short time, preferably at low pI in the nucleating step. Here the pI is defined as a logarithm of a reciprocal of $I^-$ ion concentration in the system. According to the present invention, especially the preparation where silver nitrate solution and halide solution are added in the presence of gelatin while stirring at a temperature of from 20° C. to 80° C. is preferably executed. Where the pI in the system is preferably 3 or lower, and the pH is preferably 7 or lower. The concentration of the aqueous silver nitrate solution is preferably at the concentration of 1.5 mol/L or less. By applying the above nucleating method, the formation of the epitaxial emulsion can be easily attained.

In the ripening step, the preferred temperature is in a range of from 50° C. to 80° C. The additional gelatin is preferably added thereto, during soon after the nucleation to the finish of the ripening process. Especially, a phthalated gelatin is used as the preferred gelatin. By using the gelatin, the preparation of the epitaxial emulsion of the present invention can be easily executed.

In the grain growth step of the present invention, an aqueous solution containing silver nitrate and an aqueous solution containing iodide may be added by a simultaneously adding method, or a silver iodide fine grain emulsion may be added. Preferably, a silver iodide fine grain emulsion is added or an aqueous silver nitrate solution, an aqueous solution containing iodide, and a silver iodide fine grain emulsion are added simultaneously.

The silver iodide fine grain emulsion used are substantially those comprising silver iodide, but at least one of silver bromide and silver chloride may be included as far as the mixed crystal can be formed. Preferably the emulsion comprises pure silver iodide. As for the crystal structure of silver iodide grain, there are crystal structures such as β phase and γ phase, and also α phase and α-like phase described in U.S. Pat. No. 4,672,026. The crystal structure used for the present invention are not particularly limited, but preferably the mixture of β phase and γ phase, and more preferably β phase structure is used. The silver iodide fine grain emulsion used may be an emulsion prepared prior to the addition as described in U.S. Pat. No. 5,004,679, or an emulsion after normal water washing step. The emulsion after normal water washing step is preferably used for the present invention.

The silver iodide fine grain emulsion can be easily prepared by the method described in U.S. Pat. No. 4,672,026. A method of double jet addition where an aqueous silver nitrate solution and an iodide salt aqueous solution are added while keeping the pI at a constant value at grain formation is preferably applied. The desired fine grains can be prepared by adjusting the conditions such as the temperature, the pI, the pH, the kind, and concentration of protective colloids such as gelatin, and with or without, the kind and concentration of silver halide solvent. The grain size is not particularly limited but preferrd is in a range of 0.1 μm or less, and more preferred is 0.07 μm or less for the present invention. It is very difficult to specify the grain shape precisely because of the fine particle, but a variation coefficient of a grain size distribution is preferably 25% or less. Especially in the case of 20% or less, the effect of the present invention is more pronounced. The size and size distribution of the silver iodide fine grain emulsion can be determined by the method where silver iodide fine grains are placed on the mesh used for electron microscope observation and observed directly by a transmission method, not by a replica method. Because the grain size is too small, the observation by a carbon replica method may give a big measuring error. Here the grain size is defined as a diameter of a circle having the same projected area equivalent to the grain to be examined. In respect to the grain size distribution, the size distribution is derived from a diameter of a circle equal to the projected area.

According to the present invention, most effective silver iodide fine grains have a grain size from 0.02 μm to 0.06 μm and a variation coefficient of a grain size distribution of 18% or less.

The most preferred grain grow the step used for the present invention is the grain grow the step similar to the procedures described in JP-A No.2-188741, where silver halide ultrafine grain emulsion comprising silver iodide, silver iodobromide, or silver chloroiodide prepared prior to the addition are added successively during the grain growing process of the tabular silver halide grains, and the tabular grains are grown up by dissolving the ultrafine grains added. The outer mixing apparatus for the preparation of the ultrafine grains must install a powerful stirring devise where the aqueous silver nitrate solution, the aqueous halogen solution, and the aqueous gelatin solution are mixed thereto.

The gelatin may be added by the mixed solution prepared prior to the addition with the aqueous silver nitrate solution and/or the aqueous halogen solution, or by the aqueous gelatin solution alone. The gelatin having a lower molecular weight than usual is preferably used. The gelatin having a molecular weight of from 10,000 to 50,000 is particularly preferably used. Particularly preferred gelatin used in the present invention is the gelatin where 90% of the amino group is modified by phthalic acid, succinic acid, or trimellitic acid, and the oxidized gelatin reduced in the methionine content. Among them, phthalated gelatin is most preferably used. Using the above method, the epitaxial emulsion of the present invention can be easily prepared.

Various kinds of gelatin may be used as the protective colloid in the preparation of the tabular host grains used in the present invention. The stability of dispersing state of the silver halide emulsion in coating solution containing organic silver salt is required, and therefore low molecular gelatin having a molecular weight of from 10,000 to 100,000 is preferably used. Moreover, phthalated gelatin may be preferably used. These gelatins can be used at grain formation and/or at dispersion after desalting process, but particularly preferably used at grain formation.

Various kinds of silver halide solvents or surface adsorbing agents can be used in the preparation of the tabular host grains used in the present invention. In order to form the grains having the required grain size and aspect ratio, the conditions such as the temperature, the pH, the pAg can be selected arbitrary. The tabular host grains are preferably monodispersed for easy performing the preparation of the epitaxial emulsion according to the present invention.

<Method for Preparing Epitaxial Junction Portion>

The tabular silver halide grain according to the present invention has at least one epitaxial junction portion having multifold structure in a grain. The formation of the epitaxial junction portion having an arbitrary halogen composition in a multifold structure can be controlled by adjusting the halogen ions added during formation of the epitaxial junction portion or the halogen composition of the fine grain silver halide emulsion.

In the practice of the present invention, as halogen composition of the epitaxial junction portion, a high silver chloride content is especially preferred for the improvement in storability. However, when the silver chloride content in the outermost surface of the epitaxial junction portion is too high, it is not preferred for high sensitization. Thereby, it is important to control the formation of epitaxial junction portion so as the core part of the epitaxial junction portion has higher silver chloride content as possible.

Furthermore, according to the present invention, high sensitivity can be attained by introducing a dislocation line intendedly onto the epitaxial junction portion. The dislocation line can be easily formed by disposing a high silver iodide content layer in an intermediate part of the epitaxial junction portion.

However, it is not preferred for high sensitization that the silver iodide content in the outermost surface of the epitaxial junction portion is too high.

By optimizing the halogen composition in the core part within the intermediate layer and the shell part in the outer part of the intermediate layer, the dislocation line can be formed without increasing the silver iodide content in the outermost surface of epitaxial junction portion. Thereby high sensitivity can be attained. Moreover, the silver iodide-containing layer in the epitaxial portion where the introduction of dislocation line is intended may be either in the core part or the shell part.

The epitaxial junction portion may be formed soon after the formation of tabular host grain or after performing normal desalting which is performed after the formation of tabular host grain. The epitaxial junction portion is preferably formed after performing normal desalting. Preferably, the tabular host grain emulsion of the present invention is washed with water for desalting and dispersed in a newly prepared protective colloid. As the protective colloid, gelatin is advantageously used.

The temperature of water washing can be selected according to the purpose, but is preferably selected in a range of from 5° C. to 50° C. The pH at water washing can also be selected according to the purpose, but is preferably selected from 2 to 10, and more preferably selected from 3 to 8. The pAg at water washing can also be selected according to the purpose, but is preferably selected from 4 to 10. Especially, more careful selection is required in the case of the tabular host grain having a high silver iodide content, because a slightly shape change occurred during the water washing step may give a big influence upon the formation of epitaxial junction portion set forth below. The water washing method may be selected from a noodle washing method, dialysis method using a semipermeable membrane, centrifugal separating method, coagulation precipitating method, and ion exchanging method. In the case of the coagulation precipitation, the method can be selected from a method of using a sulfate, a method of using an organic solvent, a method of using a water-soluble polymer, and a method of using a gelatin derivative.

For the dispersing step after desalting, the pH, the pAg, and the kind, concentration and viscosity of gelatin used are selected to prepare the epitaxial emulsion of the present invention. According to the present invention, the pH is preferably in a range of from 5 to 8, more preferably from 5.3 to 7, and particularly preferably from 5.5 to 6.8. By setting the pH to the above range, the epitaxial junction portion can be uniformly formed among grains and the effect of the present invention can be remarkably brought out. As for the kind of gelatin being used, the use of phthalated gelatin is especially preferable to the condition of the formation of the epitaxial junction portion of the present invention.

The most influential factors which affect the condition of the formation of the epitaxial junction portion are the degree of supersaturation, the temperature, and the pAg. Higher degree of supersaturation and higher temperature are preferred to the condition of the formation of the epitaxial junction portion in order to have uniform epitaxial junctions. However, optimization is required because too high degree of supersaturation may increase the number of epitaxial junction made on the place other than apex portions of the tabular host grains and too high temperature may cause the mix crystal formation by undesirable recrystalization with the tabular host grains.

According to the present invention, the temperature of the formation of epitaxial junction portion is in a range of from 20° C. to 90° C., preferably from 40° C. to 80° C., and more preferably from 50° C. to 75° C. Concerning epitaxial sensitization by the silver halide emulsion having a silver iodide content of 40 mol % or lower, the formation of the epitaxial junction portion at low temperature is generally preferred. However, in the case of silver halide emulsion having a silver iodide content of 40 mol % or higher, the formation of the epitaxial junction portion can be preferably performed at high temperature.

According to the present invention, the pAg at the formation of the epitaxial junction portion is preferably in a range of from 4.8 to 9.5, and more preferably from 6.1 to 7.8.

In the present invention, as a site director used for the epitaxial junction, a spectral sensitizing dye or an adsorptive compound which substantially has no absorption in the visible light region is preferably used. These adsorptive compounds may be used alone, but may be used preferably in combination of two or more thereof. By selecting the addition amount or the kind of the adsorptive compound, the formation site of epitaxial junction portion can be controlled. Generally, the addition amount is preferably in a range from 40% to 90% of the saturated coverage amount, and also the adsorptive compound can be further added after completion of the formation of the epitaxial junction portion.

As the spectral sensitizing dye, those capable of spectrally sensitizing silver halide grains in a desired wavelength region upon adsorption to silver halide grains having spectral sensitivity suitable to spectral characteristic of an exposure light source can be selected advantageously. The epitaxial emulsion of the present invention is preferably spectrally sensitized to have a spectral sensitive peak in a range of from 600 nm to 900 nm, or in a range of from 300 nm to 500 nm, and particularly preferably from 300 nm to 450 nm.

The sensitizing dyes and the adding method are disclosed, for example, in JP-A No. 11-65021 (paragraph Nos. 0103 to 0109), as a compound represented by formula (II) in JP-A No. 10-186572, dyes represented by formula (I) in JP-A No. 11-119374 (paragraph No. 0106), dyes described in U.S. Pat. Nos. 5,510,236 and 3,871,887 (Example 5), dyes disclosed in JP-A Nos. 2-96131 and 59-48753, as well as in page 19, line 38 to page 20, line 35 of EP-A No. 0803764A1, in JP-A Nos. 2001-272747, 2001-290238 and 2002-23306, and the like. These sensitizing dyes may be used alone or, two or more kinds of them may be used in combination.

In the epitaxial emulsion according to the present invention, super sensitizers can be used in order to improve spectral sensitizing effect. The super sensitizers usable in the invention can include those compounds described in EP-A No. 587338, U.S. Pat. Nos. 3,877,943 and 4,873,184, JP-A Nos. 5-341432, 11-109547, and 10-111543, and the like.

The size of the epitaxial portion of the present invention, with respect to the host grain portion, is preferably in a range of from 1 mol % to 60 mol %, based on mole of silver ion, more preferably from 3 mol % to 50 mol %, even more preferably from 5 mol % to 30 mol %, and most preferably from 10 mol % to 20 mol %. If the size is either bigger or smaller, the epitaxial sensitizing effect would become small.

Generally in the epitaxial emulsion, the epitaxial portions may easily suffer a shape change by recrystalization, so some shape stabilizing means is preferably needed. As the means to stabilize the shape of the epitaxial portions according to the present invention, the shape of the epitaxial portions can be stabilized by the addition of a adsorptive compound such as a water-soluble mercapto compound to adsorb on the epitaxial portions soon after the formation of epitaxial junction portion. The addition amount can preferably be selected depending on the grain size and shape used, as far as the application of the chemical sensitization mentioned below can be performed without any hindrance.

8) Heavy Metal

The photosensitive silver halide grain of the invention preferably contains a heterometal other than silver atom in the grain. As the heterometal other than silver atom, metals or complexes of metals belonging to groups 3 to 11 of the periodic table (showing groups 1 to 18) are preferred. The metal or the center metal of the metal complex from groups 3 to 11 of the periodic table is preferably ferrum, rhodium, ruthenium, or iridium.

The metal complex may be used alone, or two or more kinds of complexes comprising identical or different species of metals may be used together. The content is preferably in a range from $1\times10^{-9}$ mol to $1\times10^{-3}$ mol per 1 mol of silver. The heavy metals, metal complexes and the addition method thereof are described in JP-A No. 7-225449, in paragraph Nos. 0018 to 0024 of JP-A No.11-65021, and in paragraph Nos. 0227 to 0240 of JP-A No. 11-119374.

In the present invention, a silver halide grain having a hexacyano metal complex present on the outermost surface of the grain is preferred. The hexacyano metal complex includes, for example, $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, and $[Re(CN)_6]^{3-}$. In the invention, hexacyano Fe complex is preferred.

The hexacyano metal complex can be added while being mixed with water, as well as a mixed solvent of water and an appropriate organic solvent miscible with water (for example, alcohols, ethers, glycols, ketones, esters, amides, or the like) or gelatin.

The addition amount of the hexacyano metal complex is preferably from $1\times10^{-5}$ mol to $1\times10^{-2}$ mol and, more preferably, from $1\times10^{-4}$ mol to $1\times10^{-3}$, per 1 mol of silver in each case.

In order to allow the hexacyano metal complex to be present on the outermost surface of a silver halide grain, the hexacyano metal complex is directly added in any stage of: after completion of addition of an aqueous solution of silver nitrate used for grain formation, before completion of an emulsion formation step prior to a chemical sensitization step, of conducting chalcogen sensitization such as sulfur sensitization, selenium sensitization, and tellurium sensitization or noble metal sensitization such as gold sensitization, during a washing step, during a dispersion step and before a chemical sensitization step. In order not to grow fine silver halide grains, the hexacyano metal complex is rapidly added preferably after the grain is formed, and it is preferably added before completion of an emulsion formation step.

Metal atoms that can be contained in the silver halide grain used in the invention (for example, $[Fe(CN)_6]^{4-}$), desalting method of a silver halide emulsion and chemical sensitizing method are described in paragraph Nos. 0046 to 0050 of JP-A No.11-84574, in paragraph Nos. 0025 to 0031 of JP-A No.11-65021, and paragraph Nos. 0242 to 0250 of JP-A No.11-119374.

9) Chemical Sensitization

The photosensitive silver halide in the present invention can be used without chemical sensitization, but is preferably chemically sensitized by at least one of a chalcogen sensitizing method, gold sensitizing method, and reduction sensitizing method. The chalcogen sensitizing method includes sulfur sensitizing method, selenium sensitizing method and tellurium sensitizing method.

In sulfur sensitization, unstable sulfur compounds can be used. Such unstable sulfur compounds are described in Chimie et Pysique Photographique, written by P. Grafkides, (Paul Momtel, 5th ed., 1987) and Research Disclosure (vol. 307, Item 307105), and the like.

As typical examples of sulfur sensitizer, known sulfur compounds such as thiosulfates (e.g., hypo), thioureas (e.g., diphenylthiourea, triethylthiourea, N-ethyl-N'-(4-methyl-2-thiazolyl)thiourea, or carboxymethyltrimethylthiourea), thioamides (e.g., thioacetamide), rhodanines (e.g., diethylrhodanine or 5-benzylydene-N-ethylrhodanine), phosphinesulfides (e.g., trimethylphosphinesulfide), thiohydantoins, 4-oxo-oxazolidin-2-thiones, disulfides or polysulfides (e.g., dimorphorinedisulfide, cystine, or lenthionine (1,2,3,5,6-pentathiepane)), polythionates, and sulfur element, and active gelatin can be used. Specifically, thiosulfates, thioureas, and rbodanines are preferred.

In selenium sensitization, unstable selenium compounds can be used. These unstable selenium compounds are described in Japanese Patent Application Publication (JP-B) Nos. 43-13489 and 44-15748, JP-A Nos. 4-25832, 4-109340, 4-271341, 5-40324, 5-11385, 6-51415, 6-175258, 6-180478, 6-208186, 6-208184, 6-317867, 7-92599, 7-98483, and 7-140579, and the like.

As typical examples of selenium sensitizer, colloidal metal selenide, selenoureas (e.g., N,N-dimethylselenourea, trifluoromethylcarbonyl-trimethylselenourea, or acetyltrimethylselemourea), selenoamides (e.g., selenoamide or N,N-diethylphenylselenoamide), phosphineselenides (e.g., triphenylphosphineselenide or pentafluorophenyltriphenylphosphineselenide), selenophosphates (e.g., tri-p-tolylselenophosphate or tri-n-butylselenophosphate), selenoketones (e.g., selenobenzophenone), isoselenocyanates, selenocarbonic acids, selenoesters, diacylselenides, or the like can be used. Furthermore, non-unstable selenium compounds such as selenius acid, salts of selenocyanic acid, selenazoles, and selenides described in JP-B Nos. 46-4553 and 52-34492, and the like can also be used. Specifically, phosphineselenides, selenoureas, and salts of selenocyanic acids are preferred.

In tellurium sensitization, unstable tellurium compounds are used. Unstable tellurium compounds described in JP-A Nos.4-224595, 4-271341, 4-333043, 5-303157, 6-27573, 6-175258, 6-180478, 6-208186, 6-208184, 6-317867, 7-140579, 7-301879, 7-301880, and the like, can be used as a tellurium sensitizer.

As typical examples of a tellurium sensitizer, phosphinetellurides (e.g., butyl-diisopropylphosphinetelluride, tributylphosphinetelluride, tributoxyphosphinetelluride, or ethoxy-diphenylphosphinetellride), diacyl(di)tellurides (e.g., bis(diphenylcarbamoyl)ditelluride, bis(N-phenyl-N-methylcarbamoyl)ditelluride, bis(N-phenyl-N-methylcarbamoyl)ditelluride, bis(N-phenyl-N-benzylcarbamoyl)telluride, or bis(ethoxycarmonyl)telluride), telluroureas (e.g., N,N'-dimethylethylenetellurourea or N,N'-diphenylethylenetellurourea), telluramides, or telluroesters may be used. Specifically, diacyl(di)tellurides and phosphinetellurides are preferred. Especially, the compounds described in paragraph No. 0030 of JP-A No. 11-65021 and compounds represented by formulae (II), (III), or (IV) in JP-A No. 5-313284 are preferred.

Specifically, as for the chalcogen sensitization of the invention, selenium sensitization and tellurium sensitization are preferred, and tellurium sensitization is particularly preferred.

In gold sensitization, gold sensitizer described in Chimie et Physique Photographique, written by P. Grafkides, (Paul Momtel, 5th ed., 1987) and Research Disclosure (vol. 307, Item 307105) can be used. More specifically, chloroauric acid, potassium chloroaurate, potassium aurithiocyanate, gold sulfide, gold selenide, or the like can be used. In addition to these, the gold compounds described in U.S. Pat. Nos. 2,642,361, 5,049,484, 5,049,485, 5,169,751, and 5,252,455, Belg. Patent No. 691857, and the like can also be used.

Noble metal salts other than gold such as platinum, palladium, iridium and the like, which are described in Chimie et Pysique Photographique, written by P. Grafkides, (Paul Momtel, 5th ed., 1987) and Research Disclosure (vol. 307, Item 307105), can also be used.

The gold sensitization can be used independently, but it is preferably used in combination with the above chalcogen sensitization. Specifically, these sensitizations are gold-sulfur sensitization (gold-plus-sulfur sensitization), gold-selenium sensitization, gold-tellurium sensitization, gold-sulfur-selenium sensitization, gold-sulfur-tellurium sensitization, gold-selenium-tellurium sensitization and gold-sulfur-selenium-tellurium sensitization.

In the invention, chemical sensitization can be applied at any time so long as it is after grain formation and before coating and it can be applied, after desalting, (1) before spectral sensitization, (2) simultaneously with spectral sensitization, (3) after spectral sensitization, (4) just before coating, or the like.

The addition amount of chalcogen sensitizer used in the invention may vary depending on the silver halide grain used, the chemical ripening condition, and the like, and it is from $10^{-8}$ mol to $10^{-1}$ mol, and preferably from about $10^{-7}$ mol to about $10^{-2}$ mol, per 1 mol of silver halide.

Similarly, the addition amount of the gold sensitizer used in the invention may vary depending on various conditions and it is generally from $10^{-7}$ mol to $10^{-2}$ mol and, more preferably, from $10^{-6}$ mol to $5\times10^{-3}$ mol, per 1 mol of silver halide. There is no particular restriction on the condition for the chemical sensitization and, appropriately, the pAg is 8 or lower, preferably, 7.0 or lower, more preferably, 6.5 or lower and, particularly preferably, 6.0 or lower, and the pAg is 1.5 or higher, preferably, 2.0 or higher and, particularly preferably, 2.5 or higher; the pH is from 3 to 10, preferably, from 4 to 9; and the temperature is at from 20° C. to 95° C., preferably, from 25° C. to 80° C.

In the invention, reduction sensitization can also be used in combination with the chalcogen sensitization or the gold sensitization. It is specifically preferred to use in combination with the chalcogen sensitization.

As the specific compound for the reduction sensitization, ascorbic acid, thiourea dioxide, or dimethylamine borane is preferred, as well as use of stannous chloride, aminoimino methane sulfonic acid, hydrazine derivatives, borane compounds, silane compounds, polyamine compounds, and the like are preferred. The reduction sensitizer may be added at any stage in the photosensitive emulsion producing process from crystal growth to the preparation step just before coating.

Further, it is preferred to apply reduction sensitization by ripening while keeping the pH to 8 or higher and the pAg to 4 or lower for the emulsion, and it is also preferred to apply reduction sensitization by introducing a single addition portion of silver ions during grain formation.

The addition amount of the reduction sensitizer may also vary depending on various conditions and it is generally from $10^{-7}$ mol to $10^{-1}$ mol and, more preferably, from $10^{-6}$ mol to $5\times10^{-2}$ mol per 1 mol of silver halide.

In the silver halide emulsion used in the invention, a thiosulfonate compound may be added by the method shown in EP-A No. 293917.

The photosensitive silver halide grain in the invention is preferably chemically sensitized by at least one method of gold sensitizing method and chalcogen sensitizing method for the purpose of designing a high-sensitivity photothermographic material.

10) Compound that Can Be One-electron-oxidized to Provide a One-electron Oxidation Product which Releases One or More Electrons The photothermographic material of the invention preferably contains a compound that can be one-electron-oxidized to provide a one-electron oxidation product which releases one or more electrons. The said compound can be used alone or in combination with various chemical sensitizers described above to increase the sensitivity of silver halide.

As the compound that can be one-electron-oxidized to provide a one-electron oxidation product which releases one or more electrons is preferably a compound selected from the following Groups 1 or 2.

(Group 1) a compound that can be one-electron-oxidized to provide a one-electron oxidation product which further releases one or more electrons, due to being subjected to a subsequent bond cleavage reaction;

(Group 2) a compound that can be one-electron-oxidized to provide a one-electron oxidation product, which further releases one or more electrons after being subjected to a subsequent bond formation reaction.

The compound of Group 1 will be explained below.

In the compound of Group 1, as for a compound that can be one-electron-oxidized to provide a one-electron oxidation product which further releases one electron, due to being subjected to a subsequent bond cleavage reaction, specific examples include examples of compound referred to as "one photon two electrons sensitizer" or "deprotonating electron-donating sensitizer" described in JP-A No. 9-211769 (Compound PMT-1 to S-37 in Tables E and F, pages 28 to 32); JP-A No. 9-211774; JP-A No. 11-95355 (Compound INV 1 to 36); JP-W No. 2001-500996 (Compound 1 to 74, 80 to 87, and 92 to 122); U.S. Pat. Nos. 5,747,235 and 5,747,236; EP No. 786692A1 (Compound INV 1 to 35); EP No. 893732A1; U.S. Pat. Nos. 6,054,260 and 5,994,051; etc.

Preferred ranges of these compounds are the same as the preferred ranges described in the quoted specifications.

In the compound of Group 1, as for a compound that can be one-electron-oxidized to provide a one-electron oxidation product which further releases one or more electrons, due to being subjected to a subsequent bond cleavage reaction, specific examples include the compounds represented by formula (1) (same as formula (1) described in JP-A No. 2003-114487), formula (2) (same as formula (2) described in JP-A No. 2003-114487), formula (3) (same as formula (1) described in JP-A No. 2003-114488), formula (4) (same as formula (2) described in JP-A No. 2003-114488), formula (5) (same as formula (3) described in JP-A No. 2003-114488), formula (6) (same as formula (1) described in JP-A No. 2003-75950), formula (7) (same as formula (2) described in JP-A No. 2003-75950), and formula (8), and the compound represented by formula (9) among the compounds which can undergo the chemical reaction represented by reaction formula (1). And the preferable range of these compounds is the same as the preferable range described in the quoted specification.

Formula (1)

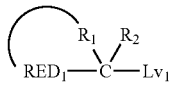

Formula (2)

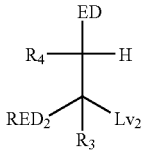

In formulae (1) and (2), $RED_1$ and $RED_2$ each independently represent a reducing group. $R_1$ represents a nonmetallic atomic group forming a cyclic structure equivalent to a tetrahydro derivative or an octahydro derivative of a 5 or 6-membered aromatic ring (including a hetero aromatic ring) with a carbon atom (C) and $RED_1$. $R_2$, $R_3$, and $R_4$ each independently represent a hydrogen atom or a substituent. $Lv_1$ and $Lv_2$ each independently represent a leaving group. ED represents an electron-donating group.

Formula (3)

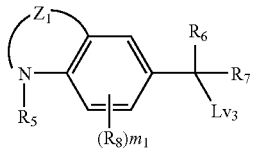

Formula (4)

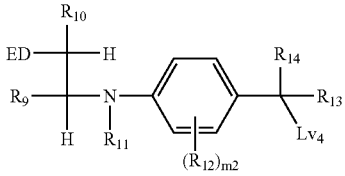

-continued

Formula (5)

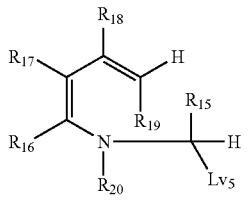

In formulae (3), (4), and (5), $Z_1$ represents an atomic group capable to form a 6-membered ring with a nitrogen atom and two carbon atoms of a benzene ring. $R_5$, $R_6$, $R_7$, $R_9$, $R_{10}$, $R_{11}$, $R_{13}$, $R_{14}$, $R_{15}$, $R_{16}$, $R_{17}$, $R_{18}$, and $R_{19}$ each independently represent a hydrogen atom or a substituent. $R_{20}$ represents a hydrogen atom or a substituent, however, in the case where $R_{20}$ represents a group other than an aryl group, $R_{16}$ and $R_{17}$ bind each other to form an aromatic ring or a hetero aromatic ring. $R_8$ and $R_{12}$ represent a substituent capable of substituting for a hydrogen atom on a benzene ring. $m_1$ represents an integer of 0 to 3, and m2 represents an integer of 0 to 4. $Lv_3$, $Lv_4$, and $Lv_5$ each independently represent a leaving group.

Formula (6)

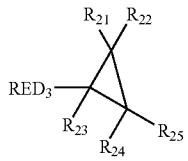

Formula (7)

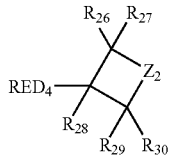

In formulae (6) and (7), $RED_3$ and $RED_4$ each independently represent a reducing group. $R_{21}$ to $R_{30}$ each independently represent a hydrogen atom or a substituent. $Z_2$ represents one selected from —$CR_{111}R_{112}$—, —$NR_{113}$—, or —O—. $R_{111}$ and $R^{112}$ each independently represent a hydrogen atom or a substituent. $R_{113}$ represents one selected from a hydrogen atom, an alkyl group, an aryl group, or a heterocyclic group.

Formula (8)

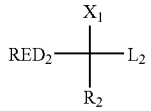

In formula (8), $RED_5$ is a reducing group and represents an arylamino group or a heterocyclic amino group. $R_{31}$ represents a hydrogen atom or a substituent. X represents one selected from an alkoxy group, an aryloxy group, a heterocyclic oxy group, an alkylthio group, an arylthio group, a heterocyclic thio group, an alkylamino group, an arylamino group, or a heterocyclic amino group. $Lv_6$ is a leaving group and represents a carboxyl group or a salt thereof, or a hydrogen atom.

Reaction formula (1)

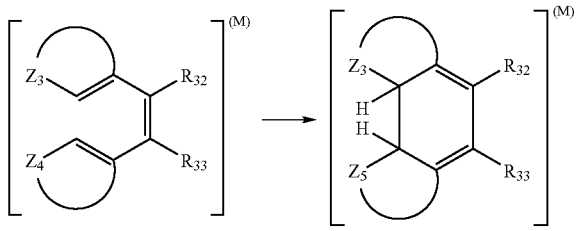

Formula (9)

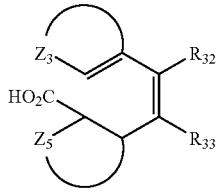

The compound represented by formula (9) is a compound that undergoes a bonding reaction represented by reaction fomula (1) after undergoing two-electrons-oxidation accompanied by decarbonization and further oxidized. In reaction formula (1), $R_{32}$ and $R_{33}$ represent a hydrogen atom or a substituent. $Z_3$ represents a group to form a 5 or 6-membered heterocycle with C═C. $Z_4$ represents a group to form a 5 or 6-membered aryl group or heterocyclic group with C═C. M represents one selected from a radical, a radical cation, and a cation. In formula (9), $R_{32}$, $R_{33}$, and $Z_3$ are the same as those in reaction formula (1). $Z_5$ represents a group to form a 5 or 6-membered cyclic aliphatic hrdrocarbon group or heterocyclic group with C—C.

Next, the compound of Group 2 is explained.

In the compound of Group 2, as for a compound that can be one-electron-oxidized to provide a one-electron oxidation product which further releases one or more electrons, after being subjected to a subsequent bond cleavage reaction, specific examples can include the compound represented by formula (10) (same as formula (1) described in JP-A No. 2003-140287), and the compound represented by formula (11) which can undergo the chemical reaction represented by reaction formula (1). The preferable range of these compounds is the same as the preferable range described in the quoted specification.

$RED_6$-Q-Y Formula (10)

In formula (10), $RED_6$ represents a reducing group which can be one-electron-oxidized. Y represents a reactive group containing a carbon-carbon double bond part, a carbon-carbon triple bond part, an aromatic group part, or benzo-condensed nonaromatic heterocyclic part which can react with one-electron-oxidized product formed by one-electron-oxidation of $RED_6$ to form a new bond. Q represents a linking group to link $RED_6$ and Y.

Reaction formula (1)

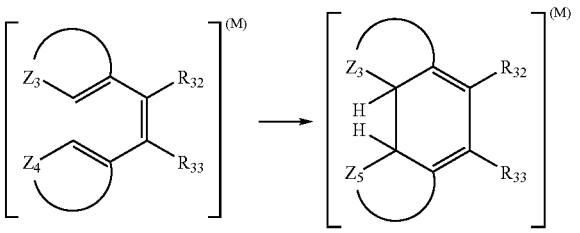

Formula (11)

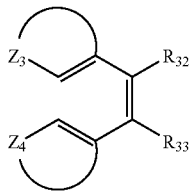

The compound represented by formula (11) is a compound that undergoes a bonding reaction represented by reaction formula (1) by being oxidized. In reaction formula (1), $R_{32}$ and $R_{33}$ each independently represent a hydrogen atom or a substituent. $Z_3$ represents a group to form a 5 or 6-membered heterocycle with C═C. $Z_4$ represents a group to form a 5 or 6-membered aryl group or heterocyclic group with C═C. $Z_5$ represents a group to form a 5 or 6-membered cyclic aliphatic hydrocarbon group or heterocyclic group with C—C. M represents one selected from a radical, a radical cation, and a cation. In formula (11), $R_{32}$, $R_{33}$, $Z_3$, and $Z_4$ are the same as those in reaction formula (1).

The compounds of Groups 1 or 2 preferably are "the compound having an adsorptive group to silver halide in a molecule" or "the compound having a partial structure of a spectral sensitizing dye in a molecule".

The representative adsorptive group to silver halide is the group described in JP-A No. 2003-156823, page 16 right, line 1 to page 17 right, line 12. A partial structure of a spectral sensitizing dye is the structure described in JP-A No. 2003-156823, page 17 right, line 34 to page 18 right, line 6.

As the compound of Groups 1 or 2, "the compound having at least one adsorptive group to silver halide in a molecule" is more preferred, and "the compound having two or more adsorptive groups to silver halide in a molecule" is further preferred. In the case where two or more adsorptive groups exist in a single molecule, those adsorptive groups may be identical or different from each other.

As preferable adsorptive group, a mercapto-substituted nitrogen-containing heterocyclic group (e.g., a 2-mercaptothiazole group, a 3-mercapto-1,2,4-triazole group, a 5-mercaptotetrazole group, a 2-mercapto-1,3,4-oxadiazole group, a 2-mercaptobenzoxazole group, a 2-mercaptobenzothiazole group, a 1,5-dimethyl-1,2,4-triazolium-3-thiolate group, or the like) or a nitrogen-containing heterocyclic group having —NH— group as a partial structure of heterocycle capable to form a silver imidate (>NAg) (e.g., a benzotriazole group, a benzimidazole group, an indazole group, or the like) are described. A 5-mercaptotetrazole group, a 3-mercapto-1,2,4-triazole group and a benzotriazole group are particularly preferable and a 3-mercapto-1,2,4-triazole group and a 5-mercaptotetrazole group are most preferable.

As an adsorptive group, the group which has two or more mercapto groups as a partial structure in a molecule is also particularly preferable. Herein, a mercapto group (—SH) may become a thione group in the case where it can tautomerize. Preferred examples of an adsorptive group having two or more mercapto groups as a partial structure (dimercapto-substituted nitrogen-containing heterocyclic group and the like) are a 2,4-dimercaptopyrimidine group, a 2,4-dimercaptotriazine group and a 3,5-dimercapto-1,2,4-triazole group.

Further, a quaternary salt structure of nitrogen or phosphorus is also preferably used as an adsorptive group. As typical quaternary salt structure of nitrogen, an ammonio group (a trialkylammonio group, a dialkylarylammonio group, a dialkylheteroarylammonio group, an alkyldiarylammonio group, an alkyldiheteroarylammonio group, or the like) and a nitrogen-containing heterocyclic group containing quaternary nitrogen atom can be used. As a quaternary salt structure of phosphorus, a phosphonio group (a trialkylphosphonio group, a dialkylarylphosphonio group, a dialkylheteroarylphosphonio group, an alkyldiarylphosphonio group, an alkyldiheteroarylphosphonio group, a triarylphosphonio group, a triheteroarylphosphonio group, or the like) is described. A quaternary salt structure of nitrogen is more preferably used and a 5 or 6-membered aromatic heterocyclic group containing a quaternary nitrogen atom is further preferably used. Particularly preferably, a pyrydinio group, a quinolinio group and an isoquinolinio group are used. These nitrogen-containing heterocyclic groups containing a quaternary nitrogen atom may have any substituent.

Examples of counter anions of quaternary salt are a halogen ion, carboxylate ion, sulfonate ion, sulfate ion, perchlorate ion, carbonate ion, nitrate ion, $BF_4^-$, $PF_6^-$, $Ph_4B^-$, and the like. In the case where the group having negative charge at carboxylate group and the like exists in a molecule, an inner salt may be formed with it. As a counter ion outside of a molecule, chloro ion, bromo ion and methanesulfonate ion are particularly preferable.

The preferred structure of the compound represented by Groups 1 or 2 having a quaternary salt of nitrogen or phosphorus as an adsorptive group is represented by formula (X).

$$(P\text{-}Q_1\text{-})_i\text{—}R(\text{-}Q_2\text{-}S)_j \qquad \text{Formula (X)}$$

In formula (X), P and R each independently represent a quaternary salt structure of nitrogen or phosphorus, which is not a partial structure of a spectral sensitizing dye. $Q_1$, and $Q_2$ each independently represent a linking group and typically represent a single bond, an alkylene group, an arylene group, a heterocyclic group, —O—, —S—, —$NR_N$, —C(═O)—, —$SO_2$—, —SO—, —P(═O)— or combinations of these groups.

Herein, $R_N$ represents one selected from a hydrogen atom, an alkyl group, an aryl group, or a heterocyclic group. S represents a residue which is obtained by removing one atom from the compound represented by Group 1 or 2. i and j are an integer of one or more and are selected in a range of i+j=2 to 6.

The case where i is 1 to 3 and j is 1 to 2 is preferable, the case where i is 1 or 2 and j is 1 is more preferable, and the case where i is 1 and j is 1 is particularly preferable. The compound represented by formula (X) preferably has 10 to 100 carbon atoms in total, more preferably 10 to 70 carbon atoms, further preferably 11 to 60 carbon atoms, and particularly preferably 12 to 50 carbon atoms in total.

Specific examples of the compounds of Groups 1 or 2 according to the invention are shown below without intention of restricting the scope of the invention.

1
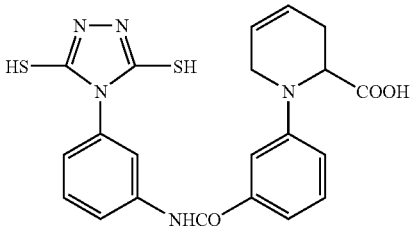
2
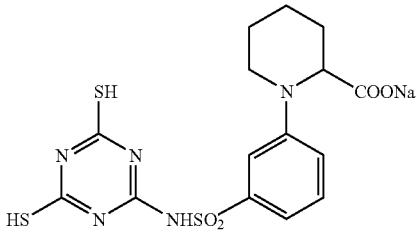
3
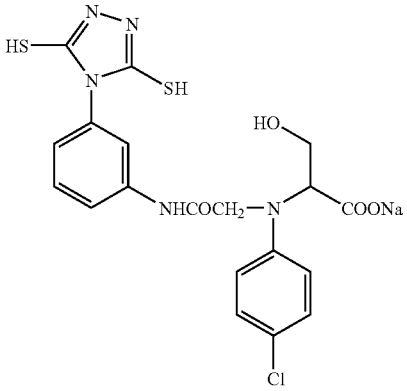
4
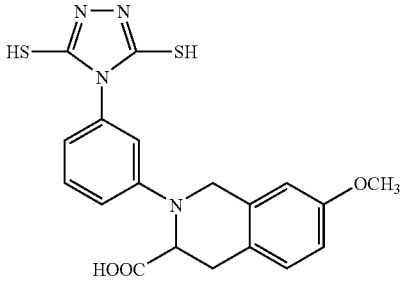
5
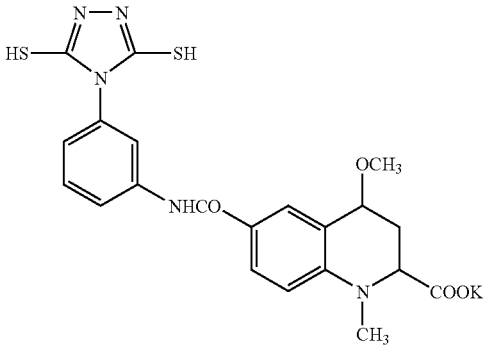
6
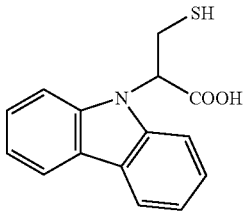
7
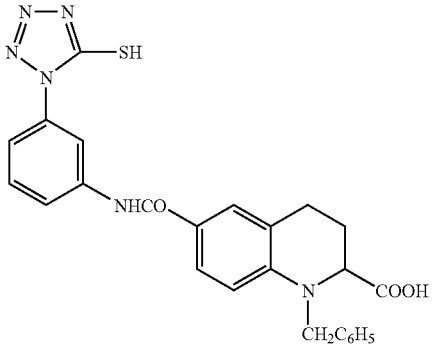
8
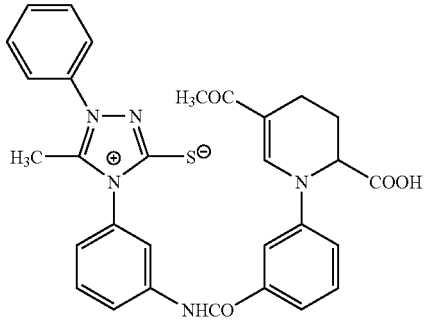

-continued
9
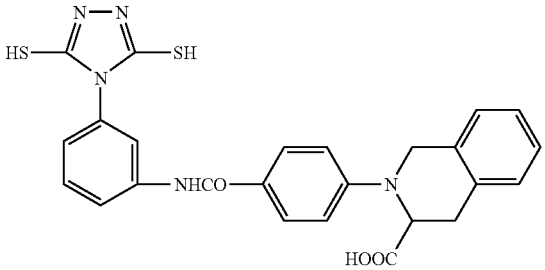
10
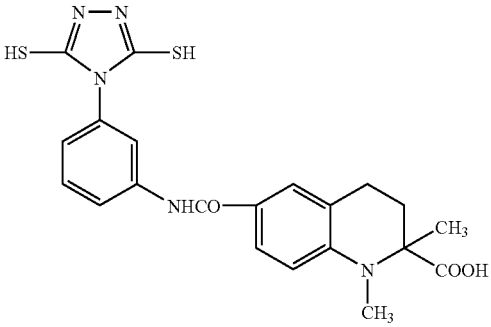
11
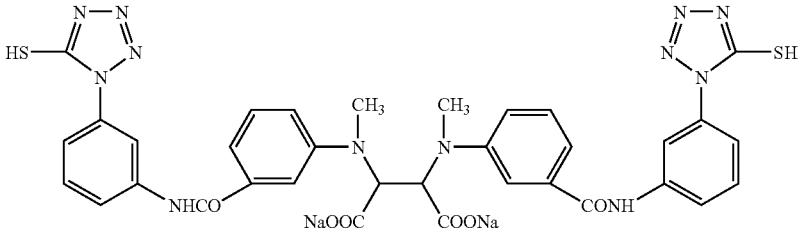
11
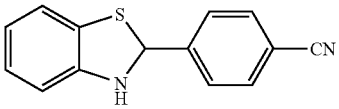
13
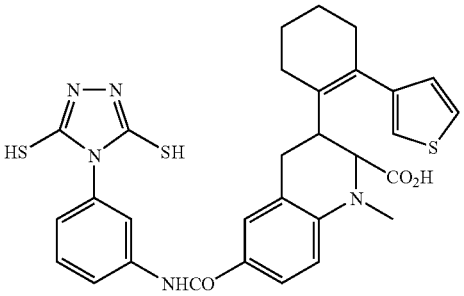
14
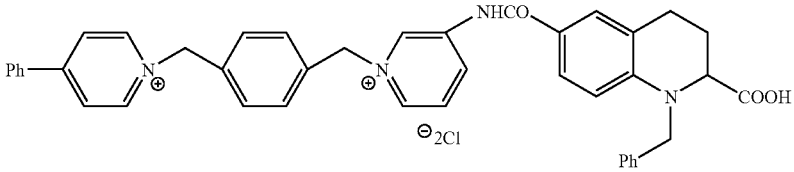
15
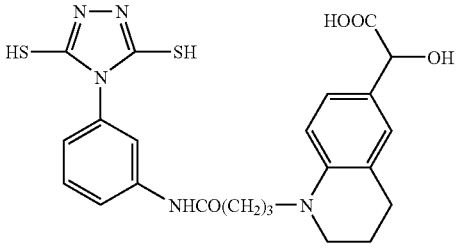
16
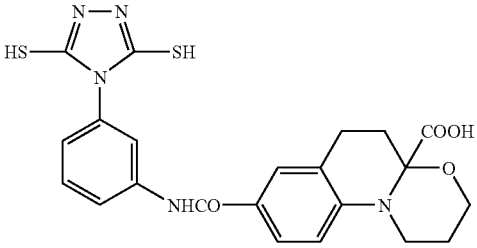

-continued
17
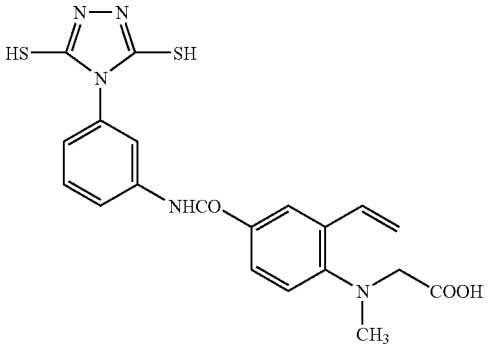
18
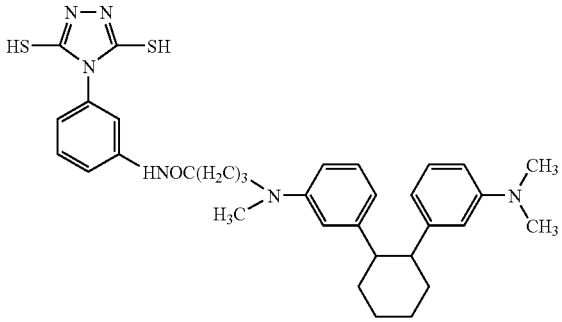
19
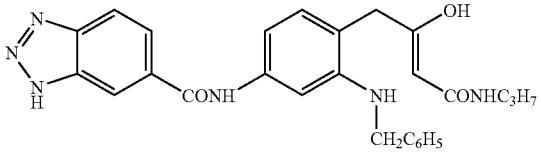
20
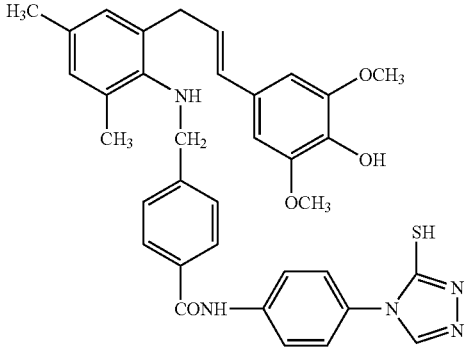
21
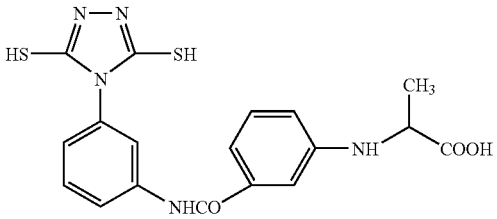
22
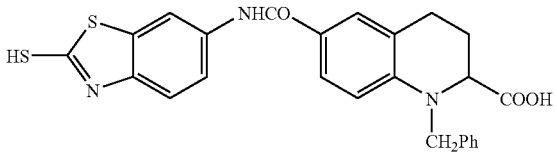
23
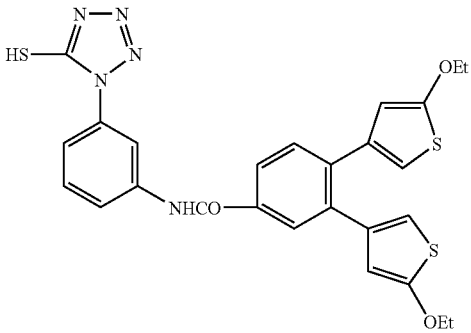
24
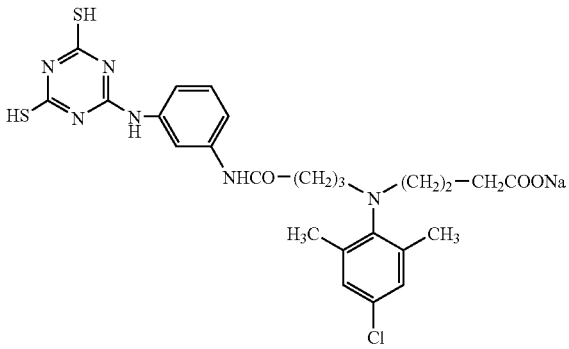

-continued
25
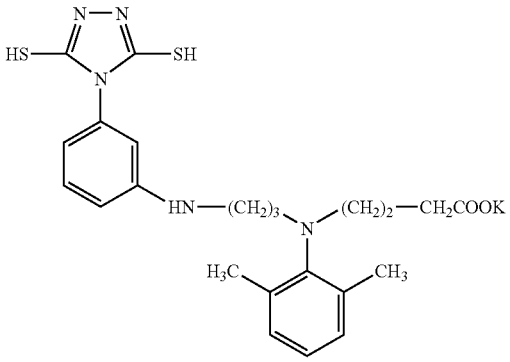
26
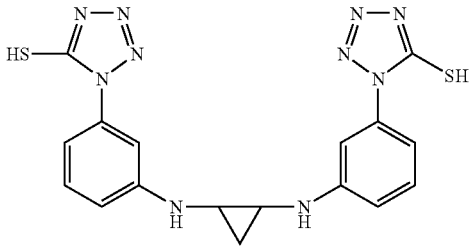
27
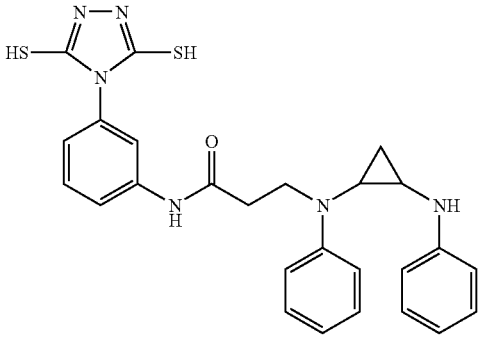
28
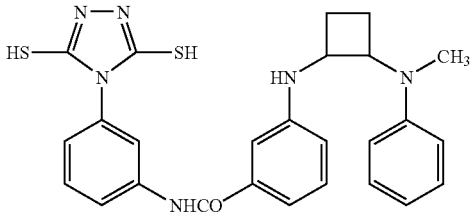
29
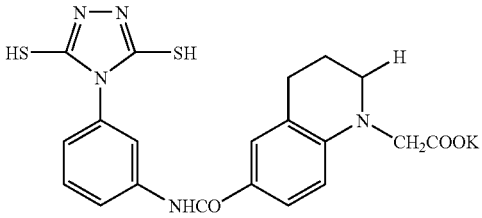
30
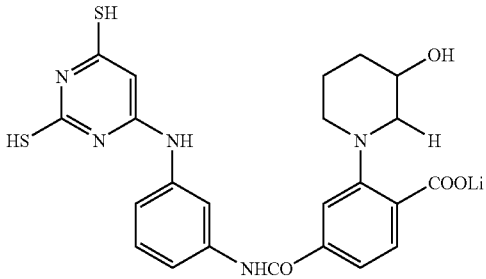
31
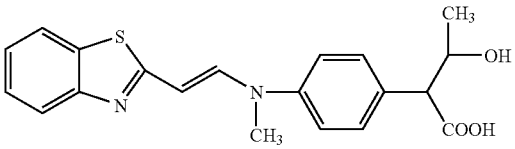
32
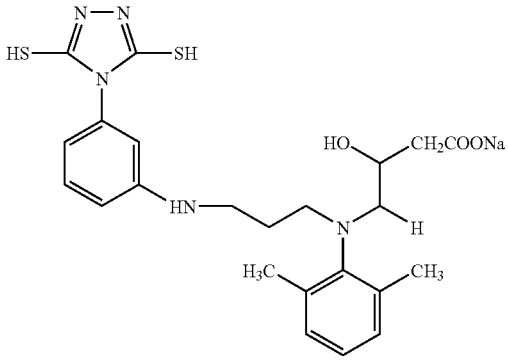

-continued
33
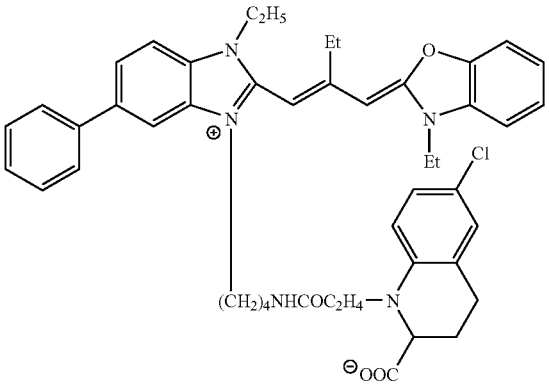
34
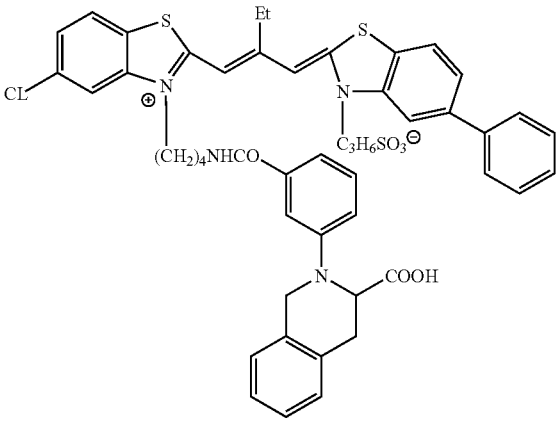
35
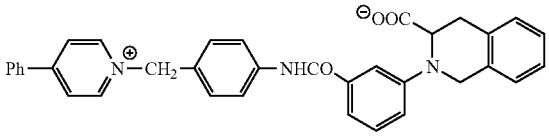
36
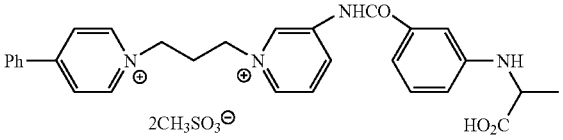
37
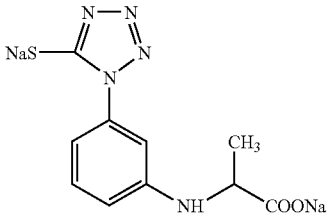
38
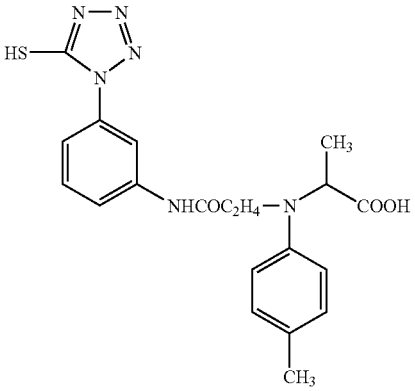
39
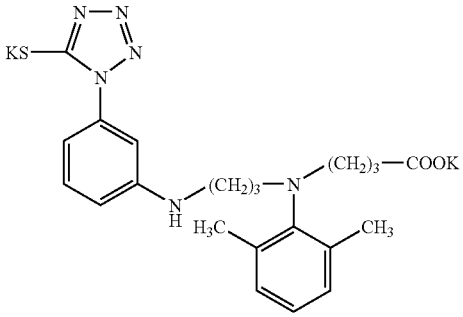
40
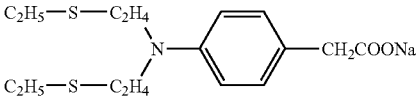

-continued

41

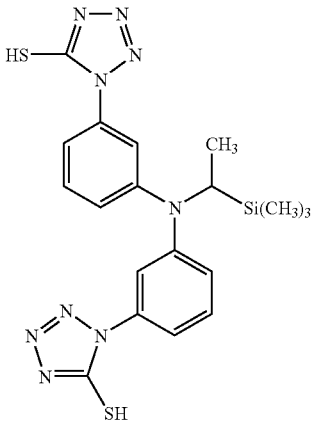

42

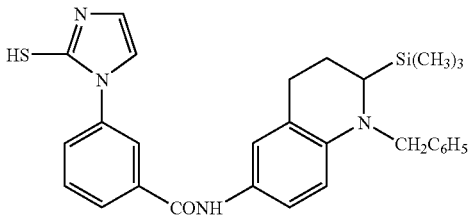

43

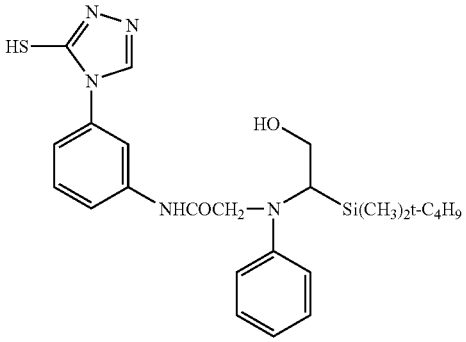

44

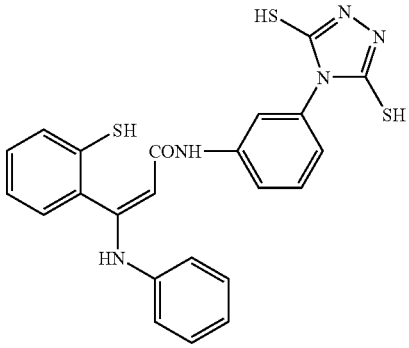

45

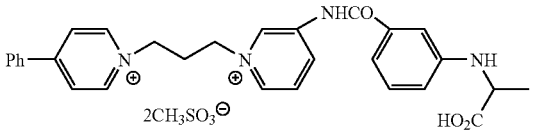

46

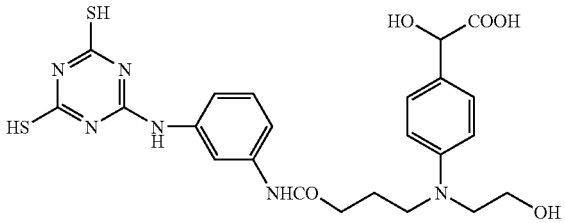

47

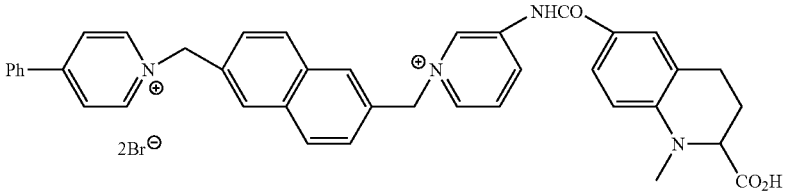

The compounds of Groups 1 or 2 may be used at any time during preparation of the photosensitive silver halide emulsion and production of the photothermographic material. For example, the compound may be used in a photosensitive silver halide grain formation step, in a desalting step, in a chemical sensitization step, before coating, or the like. The compound may be added in several times during these steps. The compound is preferably added after the photosensitive silver halide grain formation step and before the desalting step; at the chemical sensitization step (just before the chemical sensitization to immediately after the chemical sensitization); or before coating. The compound is more preferably added at the chemical sensitization step or before coating.

It is preferred that the compound of Groups 1 or 2 according to the invention is dissolved in water, a water-soluble solvent such as methanol and ethanol, or a mixed solvent thereof. In the case where the compound is dissolved in water and solubility of the compound is increased by increasing or decreasing a pH value of the solvent, the pH value may be increased or decreased to dissolve and add the compound.

The compound of Groups 1 or 2 according to the invention is preferably used in the image forming layer. The compound may be added to a surface protective layer, or an intermediate layer, as well as the image forming layer, to be diffused to the image forming layer in the coating step. The compound may be added before or after addition of a sensitizing dye. Each compound is contained in the image forming layer preferably in an amount of from $1\times10^{-9}$ mol to $5\times10^{-2}$ mol, more preferably from $1\times10^{-8}$ mol to $2\times10^{-3}$ mol, per 1 mol of silver halide.

11) Compound Having Adsorptive Group and Reducing Group

The photothermographic material of the present invention preferably comprises a compound having an adsorptive group to silver halide and a reducing group in a molecule. It is preferred that the compound is represented by the following formula (I).

A-(W)n-B Formula (I)

In formula (I), A represents a group capable of adsorption to a silver halide (hereafter, it is called an adsorptive group); W represents a divalent linking group; n represents 0 or 1; and B represents a reducing group.

In formula (I), the adsorptive group represented by A is a group to adsorb directly to a silver halide or a group to promote adsorption to a silver halide. As typical examples, a mercapto group (or a salt thereof), a thione group (—C(═S)—), a nitrogen atom, a heterocyclic group containing at least one atom selected from a nitrogen atom, a sulfur atom, a selenium atom, or a tellurium atom, a sulfide group, a disulfide group, a cationic group, an ethynyl group, and the like are described.

The mercapto group as an adsorptive group means a mercapto group (and a salt thereof) itself and simultaneously more preferably represents a heterocyclic group or an aryl group or an alkyl group substituted by at least one mercapto group (or a salt thereof). Herein, as the heterocyclic group, a monocyclic or a condensed aromatic or nonaromatic heterocyclic group having at least a 5 to 7-membered ring, for example, an imidazole ring group, a thiazole ring group, an oxazole ring group, a benzimidazole ring group, a benzothiazole ring group, a benzoxazole ring group, a triazole ring group, a thiadiazole ring group, an oxadiazole ring group, a tetrazole ring group, a purine ring group, a pyridine ring group, a quinoline ring group, an isoquinoline ring group, a pyrimidine ring group, a triazine ring group, and the like are described. A heterocyclic group having a quaternary nitrogen atom may also be adopted, wherein a mercapto group as a substituent may dissociate to form a mesoion. When the mercapto group forms a salt, a counter ion of the salt may be a cation of an alkaline metal, an alkaline earth metal, a heavy metal, or the like, such as $Li^+$, $Na^+$, $K^+$, $Mg^{2+}$, $Ag^+$ and $Zn^{2+}$; an ammonium ion; a heterocyclic group containing a quaternary nitrogen atom; a phosphonium ion; or the like.

Further, the mercapto group as an adsorptive group may become a thione group by a tautomerization.

The thione group used as the adsorptive group also include a linear or cyclic thioamide group, thiouredide group, thiourethane group, and dithiocarbamate ester group.

The heterocyclic group, as an adsorptive group, which contains at least one atom selected from a nitrogen atom, a sulfur atom, a selenium atom, or a tellurium atom represents a nitrogen-containing heterocyclic group having —NH— group, as a partial structure of a heterocycle, capable to form a silver iminate (>NAg) or a heterocyclic group, having an —S— group, a —Se— group, a —Te— group or a ═N— group as a partial structure of a heterocycle, and capable to coordinate to a silver ion by a chelate bonding. As the former examples, a benzotriazole group, a triazole group, an indazole group, a pyrazole group, a tetrazole group, a benzimidazole group, an imidazole group, a purine group, and the like are described. As the latter examples, a thiophene group, a thiazole group, an oxazole group, a benzophthiophene group, a benzothiazole group, a benzoxazole group, a thiadiazole group, an oxadiazole group, a triazine group, a selenoazole group, a benzoselenazole group, a tellurazole group, a benzotellurazole group, and the like are described.

The sulfide group or disulfide group as an adsorptive group contains all groups having "—S—" or "—S—S—" as a partial structure.

The cationic group as an adsorptive group means the group containing a quaternary nitrogen atom, such as an ammonio group or a nitrogen-containing heterocyclic group including a quaternary nitrogen atom. As examples of the heterocyclic group containing a quaternary nitrogen atom, a pyridinio group, a quinolinio group, an isoquinolinio group, an imidazolio group, and the like are described.

The ethynyl group as an adsorptive group means —C≡CH group and the said hydrogen atom may be substituted.

The adsorptive group described above may have any substituent.

Further, as typical examples of an adsorptive group, the compounds described in pages 4 to 7 in the specification of JP-A No. 11-95355 are described.

As an adsorptive group represented by A in formula (I), a heterocyclic group substituted by a mercapto group (e.g., a 2-mercaptothiadiazole group, a 2-mercapto-5-aminothiadiazole group, a 3-mercapto-1,2,4-triazole group, a 5-mercaptotetrazole group, a 2-mercapto-1,3,4-oxadiazole group, a 2-mercaptobenzimidazole group, a 1,5-dimethyl-1,2,4-triazorium-3-thiolate group, a 2,4-dimercaptopyrimidine group, a 2,4-dimercaptotriazine group, a 3,5-dimercapto-1,2,4-triazole group, a 2,5-dimercapto-1,3-thiazole group, or the like) and a nitrogen atom containing heterocyclic group having an —NH— group capable to form an imino-silver (>NAg) as a partial structure of heterocycle (e.g., a benzotriazole group, a benzimidazole group, an indazole group, or the like) are preferable, and more preferable as an adsorptive group are a 2-mercaptobenzimidazole group and a 3,5-dimercapto-1,2,4-triazole group.

In formula (I), W represents a divalent linking group. The said linking group may be any divalent linking group, as far as it does not give a bad effect toward photographic properties. For example, a divalent linking group which includes a carbon atom, a hydrogen atom, an oxygen atom, a nitrogen atom, or a sulfur atom, can be used. As typical examples, an alkylene group having 1 to 20 carbon atoms (e.g., a methylene group, an ethylene group, a trimethylene group, a tetramethylene group, a hexamethylene group, or the like), an alkenylene group having 2 to 20 carbon atoms, an alkynylene group having 2 to 20 carbon atoms, an arylene group having 6 to 20 carbon atoms (e.g., a phenylene group, a naphthylene group, or the like), —CO—, —$SO_2$—, —O—, —S—, —$NR_1$—, and the combinations of these linking groups are described. Herein, $R_1$ represents a hydrogen atom, an alkyl group, a heterocyclic group, or an aryl group.

The linking group represented by W may have any substituent.

In formula (I), a reducing group represented by B represents the group capable to reduce a silver ion. As the examples, a formyl group, an amino group, a triple bond group such as an acetylene group, a propargyl group and the like, a mercapto group, and residues which are obtained by removing one hydrogen atom from hydroxylamines, hydroxamic acids, hydroxyureas, hydroxyurethanes, hydroxysemicarbazides, reductones (reductone derivatives are contained), anilines, phenols (chroman-6-ols, 2,3-dihydrobenzofuran-5-ols, aminophenols, sulfonamidophenols, and polyphenols such as hydroquinones, catechols, resorcinols, benzenetriols, bisphenols are included), acylhydrazines, carbamoylhydrazines, 3-pyrazolidones, and the like can be described. They may have any substituent.

The oxidation potential of a reducing group represented by B in formula (I), can be measured by using the measuring method described in Akira Fujishima, "DENKIKAGAKU SOKUTEIHO", pages 150 to 208, GIHODO SHUPPAN and The Chemical Society of Japan, "ZIKKEN KAGAKUKOZA", 4th ed., vol. 9, pages 282 to 344, MARUZEN. For example, the method of rotating disc voltammetry can be used; namely the sample is dissolved in the solution (methanol: pH 6.5 Britton-Robinson buffer=10%: 90% (% by volume)) and after bubbling with nitrogen gas during 10 minutes the voltamograph can be measured under the conditions of 1000 rotations/minute, the sweep rate 20 mV/second, at 25° C. by using a rotating disc electrode (RDE) made by glassy carbon as a working electrode, a platinum electrode as a counter electrode and a saturated calomel electrode as a reference electrode. The half wave potential (E1/2) can be calculated by that obtained voltamograph.

When a reducing group represented by B in the present invention is measured by the method described above, an oxidation potential is preferably in a range of from about −0.3 V to about 1.0 V, more preferably from about −0.1 V to about 0.8 V, and particularly preferably from about 0 V to about 0.7 V.

In formula (I), a reducing group represented by B is preferably a residue which is obtained by removing one hydrogen atom from hydroxylamines, hydroxamic acids, hydroxyureas, hydroxysemicarbazides, reductones, phenols, acylhydrazines, carbamoylhydrazines, or 3-pyrazolidones.

The compound of formula (I) according to the present invention may have the ballasted group or polymer chain in it generally used in the non-moving photographic additives as a coupler. And as a polymer, for example, the polymer described in JP-A No. 1-100530 can be selected.

The compound of formula (I) according to the present invention may be bis or tris type of compound. The molecular weight of the compound represented by formula (I) according to the present invention is preferably from 100 to 10000, more preferably from 120 to 1000, and particularly preferably from 150 to 500.

The examples of the compound represented by formula (I) according to the present invention are shown below, but the present invention is not limited in these.

(1)

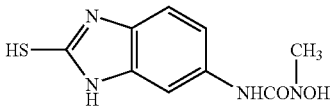

(2)

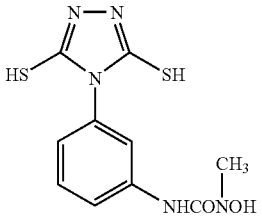

-continued (3)

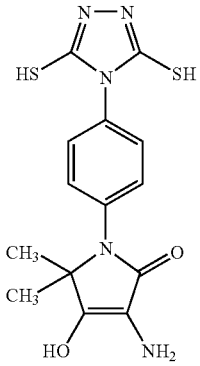

(4)

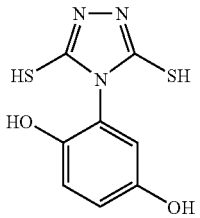

(5)

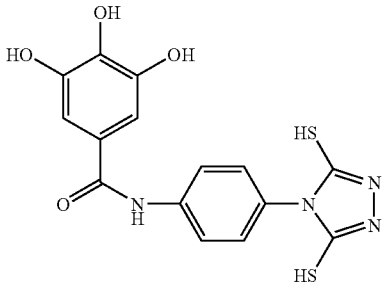

(6)

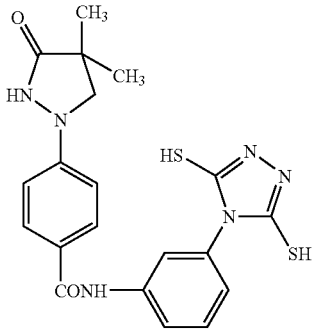

(7)

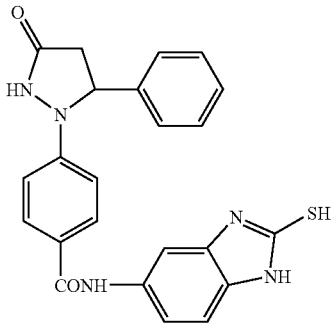

-continued (8)

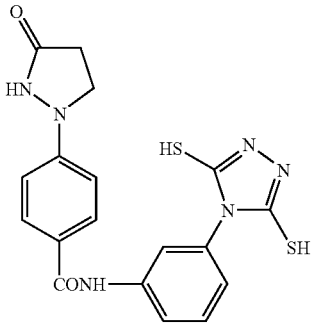

(9)

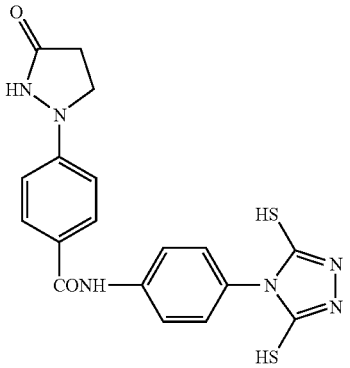

(10)

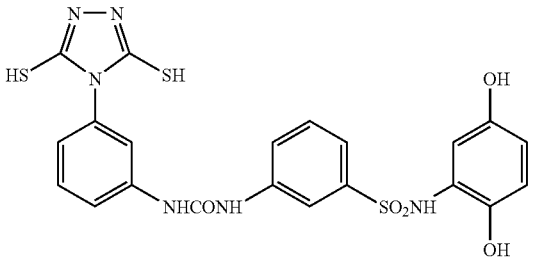

(11)

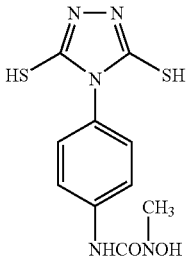

(12)

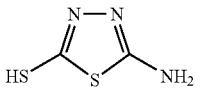

(13)

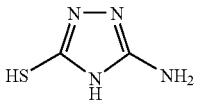

Further, example compounds 1 to 30 and 1"-1 to 1"-77 shown in EP No. 1308776A2, pages 73 to 87 are also described as preferable examples of the compound having an adsorptive group and a reducing group according to the invention.

These compounds can be easily synthesized by any known method. The compound of formula (I) in the present invention can be used alone, but it is preferred to use two or more kinds of the compounds in combination. When two or more kinds of the compounds are used in combination, those may be added to the same layer or the different layers, whereby adding methods may be different from each other.

The compound represented by formula (I) according to the present invention is preferably added to an image forming layer and more preferably is to be added at an emulsion preparing process. In the case, where these compounds are added at an emulsion preparing process, these compounds may be added at any step in the process. For example, the compounds may be added during the silver halide grain formation step, the step before starting of desalting step, the desalting step, the step before starting of chemical ripening, the chemical ripening step, the step before preparing a final emulsion, or the like. The compound can be added in several times during these steps. It is preferred to be added in the image forming layer. But the compound may be added to a surface protective layer or an intermediate layer, in combination with its addition to the image forming layer, to be diffused to the image forming layer in the coating step.

The preferred addition amount is largely dependent on the adding method described above or the kind of the compound, but generally from $1\times10^{-6}$ mol to 1 mol, preferably from $1\times10^{-5}$ mol to $5\times10^{-1}$ mol, and more preferably from $1\times10^{-4}$ mol to $1\times10^{-1}$ mol, per 1 mol of photosensitive silver halide in each case.

The compound represented by formula (I) according to the present invention can be added by dissolving in water or water-soluble solvent such as methanol, ethanol and the like or a mixed solution thereof. At this time, the pH may be arranged suitably by an acid or an alkaline and a surfactant can coexist. Further, these compounds can be added as an emulsified dispersion by dissolving them in an organic solvent having a high boiling point and also can be added as a solid dispersion.

(Compound which Substantially Reduces Visible Light Absorption by Photosensitive Silver Halide After Thermal Development)

In the present invention, it is preferred that the photothermographic material contains a compound which substantially reduces visible light absorption by photosensitive silver halide after thermal development relative to that before thermal development.

In the present invention, it is particularly preferred that a silver iodide complex-forming agent is used as the compound which substantially reduces visible light absorption by photosensitive silver halide after thermal development.

<Silver Iodide Complex-forming Agent>

In the present invention, it is preferred to use a compound which substantially reduces ultra violet-visible light absorption by photosensitive silver halide after thermal development versus before thermal development, and particularly, it is preferred to use a silver iodide complex-forming agent.

Concerning the silver iodide complex-forming agent according to the present invention, at least one of a nitrogen atom or a sulfur atom in the compound can contribute to a Lewis acid-base reaction which gives an electron to a silver ion, as a ligand atom (electron donor: Lewis base). The stability of the complex is defined by successive stability constant or total stability constant, but it depends on the combination of silver ion, iodo ion, and the silver complex forming agent. As a general guide, it is possible to obtain a large stability constant by a chelate effect from intramolecular chelate ring formation, by means of increasing the acid-base dissociation constant and the like.

In the present invention, the ultra violet-visible light absorption spectrum of the photosensitive silver halide can be measured by a transmission method or a reflection method. When the absorption derived from other compounds added to the photothermographic material overlaps with the absorption of photosensitive silver halide, the ultra violet-visible light absorption spectrum of photosensitive silver halide can be observed by using, independently or in combination, the means of difference spectrum or removal of other compounds by solvent, or the like.

As a silver iodide complex-forming agent according to the present invention, a 5 to 7-membered heterocyclic compound containing at least one nitrogen atom is preferable. In the case where the compound does not have a mercapto group, a sulfide group, or a thione group as a substituent, the said nitrogen containing 5 to 7-membered heterocycle may be saturated or unsaturated, and may have another substituent. The substituent on a heterocycle may bind to each other to form a ring.

As preferable examples of 5 to 7-membered heterocyclic compounds, pyrrole, pyridine, oxazole, isoxazole, thiazole, isothiazole, imidazole, pyrazole, pyrazine, pyrimidine, pyridazine, indole, isoindole, indolizine, quinoline, isoquinoline, benzimidazole, 1H-imidazole, quinoxaline, quinazoline, cinnoline, phthalazine, naphthylizine, purine, pterizine, carbazole, acridine, phenanthoridine, phenanthroline, phenazine, phenoxazine, phenothiazine, benzothiazole, benzoxazole, 1,2,4-triazine, 1,3,5-triazine, pyrrolidine, imidazolidine, pyrazolidine, piperidine, piperazine, morpholine, indoline, isoindoline, and the like can be described. More preferably, pyridine, imidazole, pyrazole, pyrazine, pyrimidine, pyridazine, indole, isoindole, indolizine, quinoline, isoquinoline, benzimidazole, 1H-imidazole, quinoxaline, quinazoline, cinnoline, phthalazine, 1,8-naphthylizine, 1,10-phenanthroline, benzotriazole, 1,2,4-triazine, 1,3,5-triazine, and the like can be described. Particularly preferably, pyridine, imidazole, pyrazine, pyrimidine, pyridazine, phtharazine, triazine, 1,8-naphthylizine, 1,10-phenanthroline, and the like can be described.

These rings may have a substituent and any substituent can be used as far as it does not negatively impact the photographic property. As preferable examples, a halogen atom (fluorine atom, chlorine atom, bromine atom, or iodine atom), an alkyl group (a straight, a branched, a cyclic alkyl group containing a bicycloalkyl group and an active methine group), an alkenyl group, an alkynyl group, an aryl group, a heterocyclic group (substituted position is not asked), an acyl group, an alkoxycarbonyl group, an aryloxycarbonyl group, a heterocyclic oxycarbonyl group, a carbamoyl group, an N-acylcarbamoyl group, an N-sulfonylcarbamoyl group, an N-carbamoylcarbamoyl group, an N-sulfamoylcarbamoyl group, a carbazoyl group, a carboxyl group and a salt thereof, an oxalyl group, an oxamoyl group, a cyano group, a carbonimidoyl group, a formyl group, a hydroxy group, an alkoxy group (including the group in which ethylene oxy group units or propylene oxy group units are repeated), an aryloxy group, a heterocyclic oxy group, an acyloxy group, an alkoxycarbonyloxy group, an aryloxycarbonyloxy group, a carbamoyloxy group, a sulfonyloxy group, an amino group, an alkylamino group, an arylamino group, a heterocyclic amino group, an acylamino group, a sulfonamide group, a ureido group, a thioureido group, an imide group, an alkoxycarbonylamino group, an aryloxycarbonylamino group, a sulfamoylamino group, a semicarbazide group, an ammonio group, an oxamoylamino group, an N-alkylsulfonylureido group, an N-arylsulfonylureido group, an N-acylureido group, an N-acylsulfamoylamino group, a nitro group, a heterocyclic group containing a quaternary nitrogen atom (e.g., a pyridinio group, an imidazolio group, a quinolinio group, or an isoquinolinio group), an isocyano group, an imino group, an alkylsulfonyl group, an arylsulfonyl group, an alkylsulfinyl group, an arylsulfinyl group, a sulfo group and a salt thereof, a sulfamoyl group, an N-acylsulfamoyl group, an N-sulfonylsulfamoyl group and a salt thereof, a phosphino group, a phosphinyl group, a phosphinyloxy group, a phosphinylamino group, a silyl group, and the like are described. Here, an active methine group means a methine group substituted by two electron-attracting groups, wherein the electron-attracting group means an acyl group, an alkoxycarbonyl group, an aryloxycarbonyl group, a carbamoyl group, an alkylsulfonyl group, an arylsulfonyl group, a sulfamoyl group, a trifluoromethyl group, a cyano group, a nitro group, a carbonimidoyl group.

Herein, two electron-attracting groups may bind each other to form a cyclic structure. And, the salt means a salt formed with positive ion such as an alkaline metal, an alkaline earth metal, a heavy metal, or the like, or organic positive ion such as an ammonium ion, a phosphonium ion, or the like. These substituents may be further substituted by these substituents.

These heterocycles may be further condensed by another ring. In the case where the substituent is an anion group (e.g., $—CO_2^-$, $—SO_3^-$, $—S^-$, or the like), the heterocycle containing nitrogen atom of the invention may become a positive ion (e.g., pyridinium, 1,2,4-triazolium, or the like) and may form an intramolecular salt.

In the case where a heterocyclic compound is pyridine, pyrazine, pyrimidine, pyridazine, phthalazine, triazine, naththilizine, or phenanthroline derivative, the acid dissociation constant (pKa) of a conjugated acid of nitrogen containing heterocyclic part in acid dissociation equilibrium of the said compound is preferably from 3 to 8 in the mixture solution of tetrahydrofuran/water (3/2) at 25° C., and more preferably, the pKa is from 4 to 7.

As the heterocyclic compound, pyridine, pyridazine, and a phtharazine derivative are preferable, and particularly preferable are pyridine and a phthalazine derivative.

In the case where these heterocyclic compounds have a mercapto group, a sulfide group, or a thione group as the substituent, pyridine, thiazole, isothiazole, oxazole, isoxazole, imidazole, pyrazole, pyrazine, pyrimidine, pyridazine, triazine, triazole, thiadiazole, and oxadiazole derivatives are preferable, and thiazole, imidazole, pyrazole, pyrazine, pyrimidine, pyridazine, triazine, and triazole derivatives are particularly preferable.

For example, as the said silver iodide complex-forming agent, the compound represented by the following formulae (1) or (2) can be used.

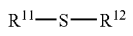

Formula (1)

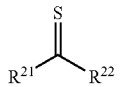

Formula (2)

In formula (1), $R^{11}$ and $R^{12}$ each independently represent a hydrogen atom or a substituent. In formula (2), $R^{21}$ and $R^{22}$ each independently represent a hydrogen atom or a substituent. However, both of $R^{11}$ and $R^{12}$ are not hydrogen atoms together and both of $R^{21}$ and $R^{22}$ are not hydrogen atoms together. As the substituent herein, the substituent explained as the substituent of a 5 to 7-membered nitrogen containing heterocyclic type silver iodide complex-forming agent mentioned above can be described.

Further, the compound represented by formula (3) described below can also be used preferably.

Formula (3)

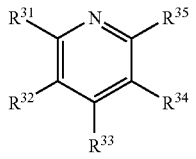

In formula (3), $R^{31}$ to $R^{35}$ each independently represent a hydrogen atom or a substituent. As the substituent represented by $R^{31}$ to $R^{35}$, the substituent of a 5 to 7-membered nitrogen containing heterocyclic type silver iodide complex-forming agent mentioned above can be used. In the case where the compound represented by formula (3) has a substituent, preferred substituting position is $R^{32}$ to $R^{hu\ 34}$. $R^{31}$ to $R^{35}$ may bind each other to form a saturated or an unsaturated ring. A preferred substituent is a halogen atom, an alkyl group, an aryl group, a carbamoyl group, a hydroxy group, an alkoxy group, an aryloxy group, a carbamoyloxy group, an amino group, an acylamino group, a ureido group, an alkoxycarbonylamino group, an aryloxycarbonylamino group, or the like.

In the compound represented by formula (3), the acid dissociation constant (pKa) of conjugated acid of pyridine ring part is preferably from 3 to 8 in the mixed solution of tetrahydrofuran/water (3/2) at 25° C., and particularly preferably, from 4 to 7. Furthermore, the compound represented by formula (4) is also preferable.

Formula (4)

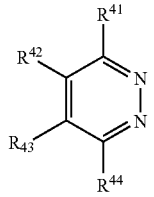

In formula (4), $R^{41}$ to $R^{44}$ each independently represent a hydrogen atom or a substituent. $R^{41}$ to $R^{44}$ may bind each other to form a saturated or an unsaturated ring. As the substituent represented by $R^{41}$ to $R^{44}$, the substituent of a 5 to 7-membered nitrogen containing heterocyclic type silver iodide complex-forming agent mentioned above can be described. As preferred group, an alkyl group, an alkenyl group, an alkynyl group, an aryl group, a hydroxy group, an alkoxy group, an aryloxy group a heterocyclic oxy group, and a group which forms a phthalazine ring by benzo-condensation are described. In the case where a hydroxy group exists at the carbon atom adjacent to nitrogen atom of the compound represented by formula (4), there exists equilibrium between pyridazinone.

The compound represented by formula (4) more preferably forms a phthalazine ring represented by the following formula (5), and furthermore, this phthalazine ring particularly preferably has at least one subsutituent. As examples of $R^{51}$ to $R^{56}$ in formula (5), the substituent of a 5 to 7-membered nitrogen containing heterocyclic type silver iodide complex-forming agent mentioned above can be described. And as more preferable examples of the substituent, an alkyl group, an alkenyl group, an alkynyl group, an aryl group, a hydroxy group, an alkoxy group, an aryloxy group, and the like are described. An alkyl group, an alkenyl group, an aryl group, an alkoxy group, and an aryloxy group are preferable and an alkyl group, an alkoxy group, and an aryloxy group are more preferable.

Formula (5)

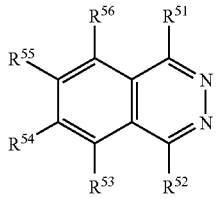

Further, the compound represented by formula (6) described below is also a preferable embodiment.

Formula (6)

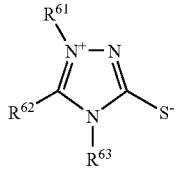

In formula (6), $R^{61}$ to $R^{63}$ each independently represent a hydrogen atom or a substituent. As examples of the substituent, the substituent of a 5 to 7-membered nitrogen containing heterocyclic type silver iodide complex-forming agent mentioned above can be described.

As the compound preferably used, the compound represented by the following formula (7) is described.

$$R^{71}—S—(L)_n—S—R^{72} \quad \text{Formula (7)}$$

In formula (7), $R^{71}$ and $R^{72}$ each independently represent a hydrogen atom or a substituent. L represents a divalent linking group. n represents 0 or 1. As the substituent represented by $R^{71}$ and $R^{72}$, an alkyl group (containing a cycloalkyl group), an alkenyl group (containing a cycloalkenyl group), an alkynyl group, an aryl group, a heterocyclic group, an acyl group, an aryloxycarbonyl group, an alkoxycarbonyl group, a carbamoyl group, an imido group and a complex substituent containing these groups are described as examples. A divalent linking group represented by L preferably has the length of 1 to 6 atoms and more preferably has the length of 1 to 3 atoms, and furthermore, may have a substituent.

One more of the compounds preferably used is a compound represented by formula (8).

Formula (8)

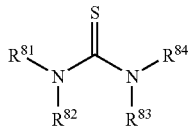

In formula (8), $R^{81}$ to $R^{84}$ each independently represent a hydrogen atom or a substituent. As the substituent represented by $R^{81}$ to $R^{84}$, an alkyl group (including a cycloalkyl group), an alkenyl group (including a cycloalkenyl group), an alkynyl group, an aryl group, a heterocyclic group, an acyl group, an aryloxycarbonyl group, an alkoxycarbonyl group, a carbamoyl group, an imide group, and the like are described as examples.

Among the silver iodide complex-forming agents described above, the compounds represented by formulae (3), (4), (5), (6), or (7) are more preferable and, the compounds represented by formulae (3) or (5) are particularly preferable.

Preferable examples of silver iodide complex-forming agent are described below, however the present invention is not limited in these.

(1)

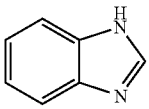

(2)

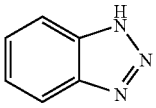

(3)

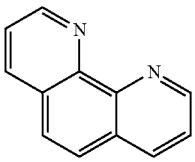

(4)

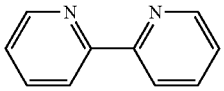

(5)

$C_5H_{11}SC_5H_{11}$ (6)

$C_4H_9SCH_2CH_2SC_4H_9$ (7)

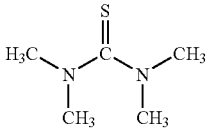

(8)

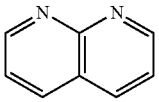

(9)

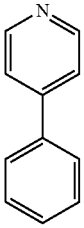

(10)

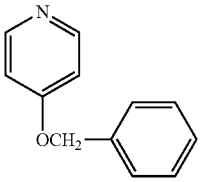

-continued (11)

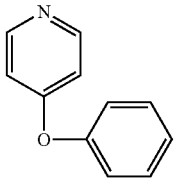

(12)

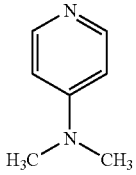

(13)

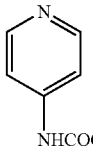

(14)

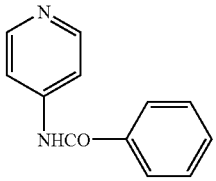

(15)

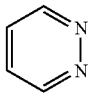

(16)

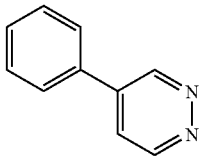

(17)

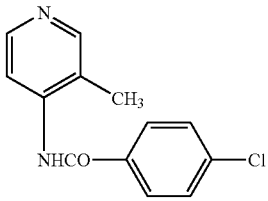

(18)

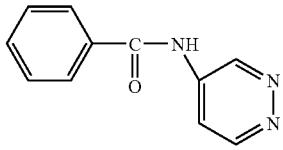

(19)

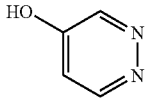

(20)

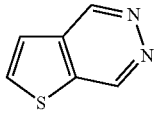

-continued
(21)
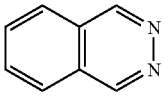
(22)
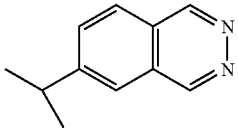
(23)
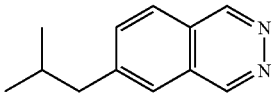
(24)
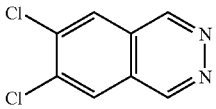
(25)
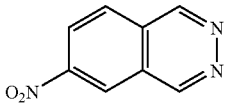
(26)
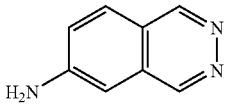
(27)
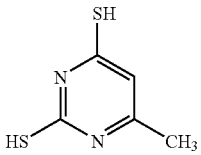
(28)
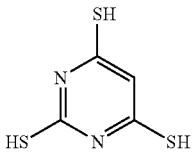
(29)
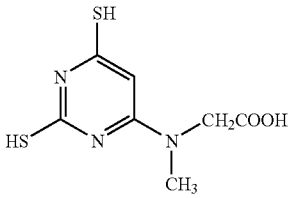
(30)
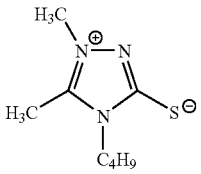
(31)
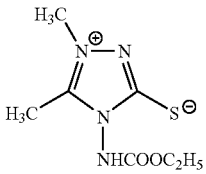
-continued
(32)
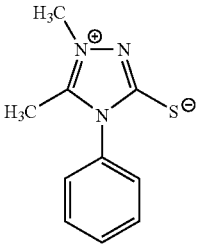
(33)
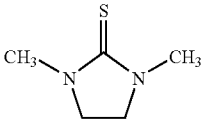
(34)
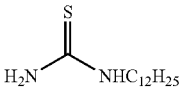
(35)
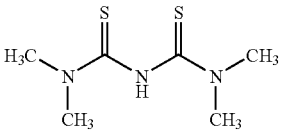
(36)
$HO(CH_2)_3S(CH_2)_2S(CH_2)_3OH$
(37)
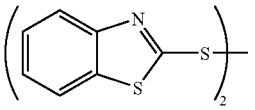
(38)
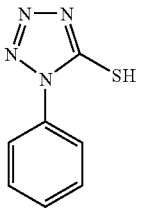
(39)
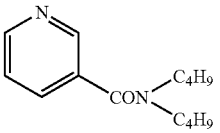
(40)
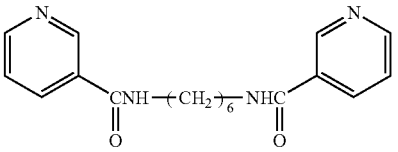
(41)
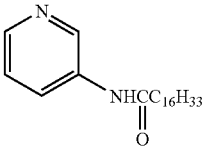
(42)
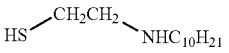
The silver iodide complex-forming agent according to the present invention can also be a compound common to a toner, in the case where the agent achieves the function of conventionally known toner. The silver iodide complex-forming agent according to the present invention can be used in combination with a toner. And, two or more kinds of the silver iodide complex-forming agents may be used in combination.

The silver iodide complex-forming agent according to the present invention preferably exists in a film under the state separated from a photosensitive silver halide, such as a solid state or the like. It is also preferably added to the layer adjacent to the image forming layer. Concerning the silver iodide complex-forming agent according to the present invention, a melting point of the compound is preferably adjusted to a suitable range so that it can be dissolved when heated at thermal developing temperature.

In the present invention, the absorption intensity of ultra violet-visible light absorption after thermal development is preferably decreased to 80% or less of that before thermal development. More preferably, it is decreased to 40% or less of that before thermal development, and particularly preferably 10% or less.

The silver iodide complex-forming agent according to the invention may be incorporated into a photothermographic material by being added into the coating solution, such as in the form of a solution, an emulsion dispersion, a solid fine particle dispersion, or the like.

Well known emulsion dispersing methods include a method comprising dissolving the silver iodide complex-forming agent in an oil such as dibutylphthalate, tricresylphosphate, glyceryl triacetate, diethylphthalate, or the like, using an auxiliary solvent such as ethyl acetate, cyclohexanone, or the like, followed by mechanically forming an emulsified dispersion.

Solid fine particle dispersing methods include a method comprising dispersing the powder of the silver iodide complex-forming agent according to the invention in a proper solvent such as water or the like, by means of ball mill, colloid mill, vibrating ball mill, sand mill, jet mill, roller mill, or ultrasonics, thereby obtaining a solid dispersion. In this case, there may also be used a protective colloid (such as poly(vinyl alcohol)), or a surfactant (for instance, an anionic surfactant such as sodium triisopropylnaphthalenesulfonate (a mixture of compounds having the three isopropyl groups in different substitution sites)). In the mills enumerated above, generally used as the dispersion media are beads made of zirconia or the like, and Zr or the like eluting from the beads may be incorporated in the dispersion. Depending on the dispersing conditions, the amount of Zr or the like incorporated in the dispersion is generally in a range of from 1 ppm to 1000 ppm. It is practically acceptable as far as Zr is incorporated in the photothermographic material in an amount of 0.5 mg or less per 1 g of silver.

Preferably, an antiseptic (for instance, benzisothiazolinone sodium salt) is added in an aqueous dispersion.

The silver iodide complex-forming agent according to the invention is preferably used in the form of a solid dispersion.

The silver iodide complex-forming agent according to the invention is preferably used in a range of from 1 mol % to 5000 mol %, more preferably, from 10 mol % to 1000 mol % and, even more preferably, from 50 mol % to 300 mol %, with respect to the photosensitive silver halide in each case.

(Organic Silver Salt)

The non-photosensitive organic silver salt used in the invention is relatively stable to light but serves as to supply silver ions and forms silver images when heated to 80° C. or higher in the presence of an exposed photosensitive silver halide and a reducing agent. The organic silver salt may be any organic material containing a source capable of reducing silver ions. Such a non-photosensitive organic silver salt is disclosed, for example, in JP-A No. 10-62899 (paragraph Nos. 0048 to 0049), EP No. 0803764A1 (page 18, line 24 to page 19, line 37), EP No. 0962812A1, JP-A Nos. 11-349591, 2000-7683, and 2000-72711, and the like.

A silver salt of an organic acid, particularly, a silver salt of long chained fatty acid carboxylic acid (having 10 to 30 carbon atoms, preferably, having 15 to 28 carbon atoms) is preferable. Preferred examples of the organic silver salt can include, for example, silver behenate, silver arachidinate, silver stearate, silver oleate, silver laurate, silver capronate, silver myristate, silver palmitate and mixtures thereof. In the present invention, among the organic silver salts, it is preferred to use an organic silver salt with a silver behenate content of 50 mol % or higher.

In particular, it is preferred that the silver behenate content is fom 75 mol % to 98 mol %.

There is no particular restriction on the shape of the organic silver salt usable in the invention and it may be needle-like, bar-like, tabular, or flake shaped.

In the invention, a flake shaped organic silver salt is preferred. In the present specification, the flake shaped organic silver salt is defined as described below. When an organic acid silver salt is observed under an electron microscope, calculation is made while approximating the shape of an organic acid silver salt particle to a rectangular body and assuming each side of the rectangular body as a, b, c from the shorter side (c may be identical with b) and determining x based on numerical values a, b for the shorter side as below.

$$x=b/a$$

As described above, x is determined for the particles by the number of about 200 and those capable of satisfying the relation: x (average)≧1.5 as an average value x is defined as a flake shape. The relation is preferably: 30≧x (average)≧1.5 and, more preferably, 15≧x (average)≧1.5. By the way, needle-like is expressed as 1≦x (average)<1.5.

In the flake shaped particle, a can be regarded as a thickness of a tabular particle having a major plane with b and c being as the sides. a in average is preferably from 0.01 μm to 0.3 μm and, more preferably, from 0.1 μm to 0.23 μm. c/b in average is preferably from 1 to 6, more preferably from 1 to 4, further preferably from 1 to 3 and, particularly preferably from 1 to 2.

As the particle size distribution of the organic silver salt, monodispersion is preferred. In the monodispersion, the percentage for the value obtained by dividing the standard deviation for the length of minor axis and major axis by the minor axis and the major axis respectively is, preferably, 100% or less, more preferably, 80% or less and, further preferably, 50% or less. The shape of the organic silver salt can be measured by analyzing a dispersion of an organic silver salt as transmission type electron microscopic images. Another method of measuring the monodispersion is a method of determining of the standard deviation of the volume weighted mean diameter of the organic silver salt in which the percentage for the value defined by the volume weight mean diameter (variation coefficient), is preferably, 100% or less, more preferably, 80% or less and, further preferably, 50% or less. The monodispersion can be determined from particle size (volume weighted mean diameter) obtained, for example, by a measuring method of irradiating a laser beam to an organic silver salt dispersed in a liquid, and determining a self correlation function of the fluctuation of scattered light to the change of time.

Methods known in the art may be applied to the method for producing the organic silver salt used in the invention and to the dispersing method thereof. For example, reference can be made to JP-A No. 10-62899, EP Nos. 0803763A1 and 0962812A1, JP-A Nos. 11-349591, 2000-7683, 2000-72711, 2001-163827, 2001-163889, 2001-163890, 11-203413, 2001-188313, 2001-83652, 2002-6442, 2002-31870, 2000-214155, 2002-6442, and the like.

In the invention, the photothermographic material can be prepared by mixing an aqueous dispersion of an organic silver salt and an aqueous dispersion of a photosensitive silver salt. A method of mixing two or more kinds of aqueous dispersions of organic silver salts and two or more kinds of aqueous dispersions of photosensitive silver salts upon mixing are used preferably for controlling the photographic properties.

While an organic silver salt in the invention can be used in a desired amount, the amount of the organic silver salt is preferably in a range of from 0.1 $g/m^2$ to 5 $g/m^2$, more preferably from 1 $g/m^2$ to 3 $g/m^2$, and particularly preferably from 1.2 $g/m^2$ to 2.5 $g/m^2$, with respect to the amount of silver.

(Reducing Agent)

The photothermographic material of the present invention contains a reducing agent for organic silver salts as a thermal developing agent. The reducing agent for organic silver salts can be any substance (preferably, organic substance) capable of reducing silver ions into metallic silver. Examples of the reducing agent are described in JP-A No. 11-65021 (column Nos. 0043 to 0045) and EP No. 0803764 (p. 7, line 34 to p. 18, line 12).

The reducing agent according to the invention is preferably a so-called hindered phenolic reducing agent or a bisphenol agent having a substituent at the ortho-position to the phenolic hydroxy group. Particularly, it is preferably a reducing agent represented by the following formula (R).

Formula (R)

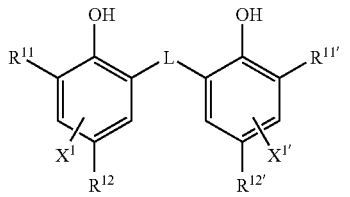

In formula (R), $R^{11}$ and $R^{11'}$ each independently represent an alkyl group having 1 to 20 carbon atoms. $R^{12}$ and $R^{12'}$ each independently represent a hydrogen atom or a group capable of substituting for a hydrogen atom on a benzene ring. L represents an —S— group or a —$CHR^{13}$— group. $R^{13}$ represents a hydrogen atom or an alkyl group having 1 to 20 carbon atoms. $X^1$ and $X^{1'}$ each independently represent a hydrogen atom or a group capable of substituting for a hydrogen atom on a benzene ring.

Formula (R) is to be described in detail.

1) $R^{11}$ and $R^{11'}$ $R^{11}$ and $R^{11'}$ each independently represent a substituted or unsubstituted alkyl group having 1 to 20 carbon atoms. The substituent for the alkyl group has no particular restriction and can include, preferably, an aryl group, a hydroxy group, an alkoxy group, an aryloxy group, an alkylthio group, an arylthio group, an acylamino group, a sulfonamide group, a sulfonyl group, a phosphoryl group, an acyl group, a carbamoyl group, an ester group, a ureido group, a urethane group, a halogen atom, and the like.

2) $R^{12}$ and $R^{12'}$, $X^1$ and $X^{1'}$ $R^{12}$ and $R^{12'}$ each independently represent a hydrogen atom or a group capable of substituting for a hydrogen atom on a benzene ring.

$X^1$ and $X^{1'}$ each independently represent a hydrogen atom or a group capable of substituting for a hydrogen atom on a benzene ring. As each of the groups capable of substituting for a hydrogen atom on the benzene ring, an alkyl group, an aryl group, a halogen atom, an alkoxy group, and an acylamino group are preferably described.

3) L

L represents an —S— group or a —$CHR^{13}$— group. $R^{13}$ represents a hydrogen atom or an alkyl group having 1 to 20 carbon atoms in which the alkyl group may have a substituent.

Specific examples of the unsubstituted alkyl group for $R^{13}$ can include, for example, a methyl group, an ethyl group, a propyl group, a butyl group, a heptyl group, an undecyl group, an isopropyl group, a 1-ethylpentyl group, a 2,4,4-trimethylpentyl group, and the like.

Examples of the substituent for the alkyl group can include, similar to substituent of $R^{11}$, a halogen atom, an alkoxy group, an alkylthio group, an aryloxy group, an arylthio group, an acylamino group, a sulfonamide group, a sulfonyl group, a phosphoryl group, an oxycarbonyl group, a carbamoyl group, a sulfamoyl group, and the like.

4) Preferred Substituents $R^{11}$ and $R^{11'}$ are preferably a secondary or tertiary alkyl group having 3 to 15 carbon atoms. Specifically, an isopropyl group, an isobutyl group, a t-butyl group, a t-amyl group, a t-octyl group, a cyclohexyl group, a cyclopentyl group, a 1-methylcyclohexyl group, a 1-methylcyclopropyl group, and the like can be described. $R^{11}$ and $R^{11'}$ are, more preferably, a tertiary alkyl group having 4 to 12 carbon atoms and, among them, a t-butyl group, a t-amyl group, and a 1-methylcyclohexyl group are further preferred and, a t-butyl group is most preferred.

$R^{12}$ and $R^{12'}$ are preferably an alkyl group having 1 to 20 carbon atoms and can include, specifically, a methyl group, an ethyl group, a propyl group, a butyl group, an isopropyl group, a t-butyl group, a t-amyl group, a cyclohexyl group, a 1-methylcyclohexyl group, a benzyl group, a methoxymethyl group, a methoxyethyl group, and the like. More preferred are methyl group, ethyl group, propyl group, isopropyl group, and t-butyl group.

$X^1$ and $X^{1'}$ are preferably a hydrogen atom, a halogen atom, or an alkyl group, and more preferably, a hydrogen atom.

L is preferably a —$CHR^{13}$— group.

$R^{13}$ is preferably a hydrogen atom or an alkyl group having 1 to 15 carbon atoms. Preferable examples of the alkyl group can include a methyl group, an ethyl group, a propyl group, an isopropyl group, and a 2,4,4-trimethylpentyl group. Particularly preferable $R^{13}$ is a hydrogen atom, a methyl group, a propyl group, or an isopropyl group.

When $R^{13}$ is a hydrogen atom, $R^{12}$ and $R^{12'}$ are preferably an alkyl group having 2 to 5 carbon atoms, more preferably an ethyl group or a propyl group, and most preferably, an ethyl group.

When $R^{13}$ is a primary or secondary alkyl group having 1 to 8 carbon atoms, $R^{12}$ and $R^{12'}$ are preferably a methyl group. The primary or secondary alkyl group having 1 to 8 carbon atoms as $R^{13}$ is preferably a methyl group, an ethyl group, a propyl group, or an isopropyl group, and more preferably a methyl group, an ethyl group, or a propyl group.

When all of $R^{11}$, $R^{11'}$, $R^{12}$, and $R^{12'}$ are a methyl group, $R^{13}$ is preferably a secondary alkyl group. In this case, the secondary alkyl group as $R^{13}$ is preferably an isopropyl group, an isobutyl group, or a 1-ethylpentyl group, and more preferably, an isopropyl group.

The above reducing agent has different thermal development properties depending on the combination of $R^{11}$, $R^{11'}$, $R^{12}$, $R^{12'}$, and $R^{13}$. Since these properties can be controlled by using two or more kinds of the reducing agents in combination in various mixing ratios, it is preferable to use two or more kinds of the reducing agents depending on the purpose.

While examples of the compound represented by formula (R) of the invention are listed below, the invention is not restricted to these.

R-1

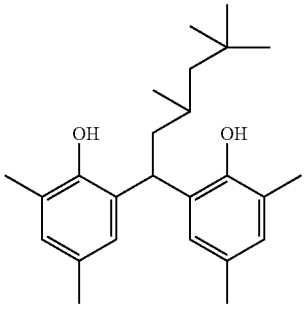

R-2

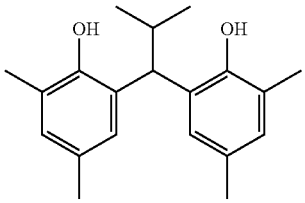

R-3

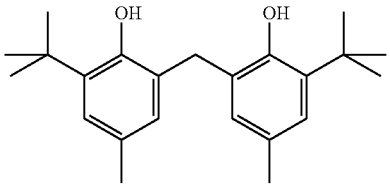

R-4

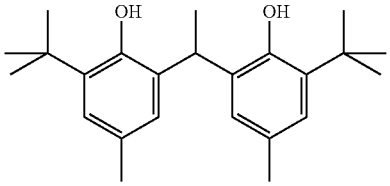

R-5

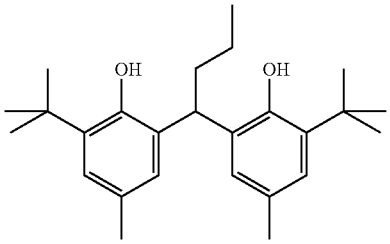

-continued

R-6

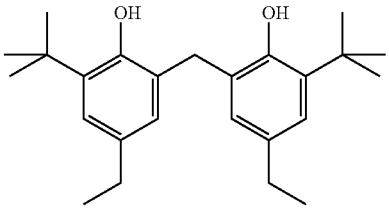

R-7

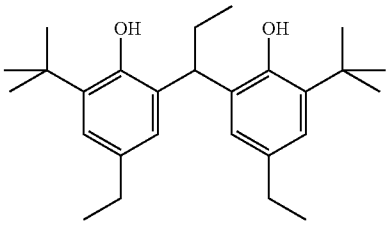

R-8

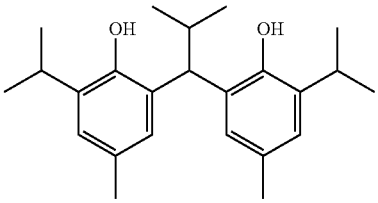

R-9

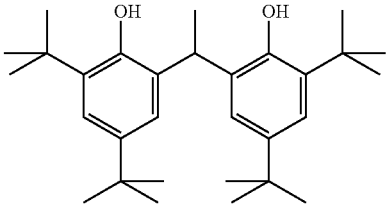

R-10

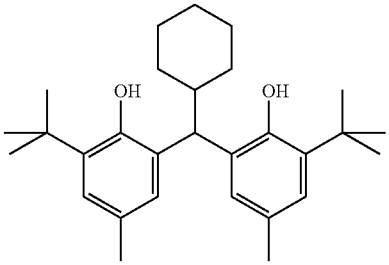

R-11

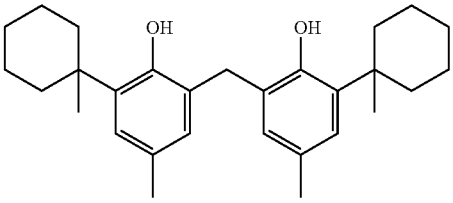

R-12

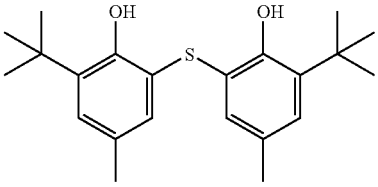

-continued

R-13

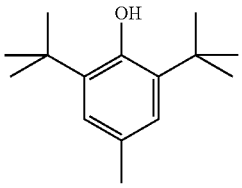

R-14

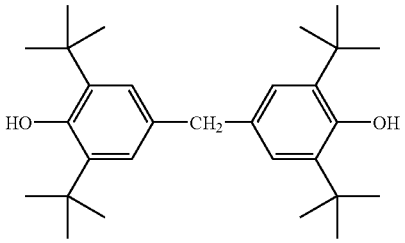

R-15

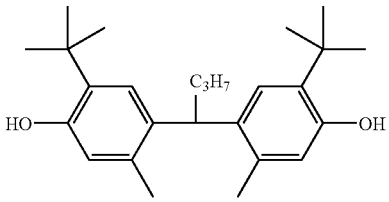

R-16

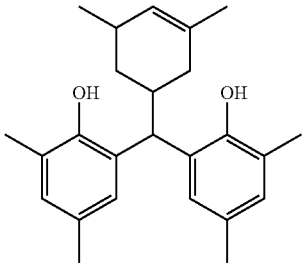

R-17

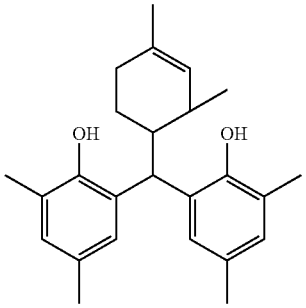

R-18

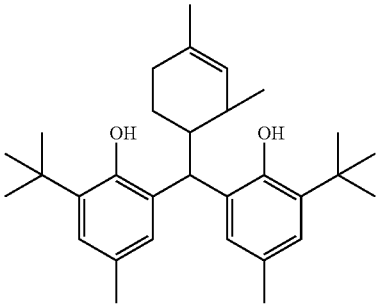

In the invention, the addition amount of the reducing agent is preferably in a range from 0.01 g/m$^2$ to 5.0 g/m$^2$, and more preferably, from 0.1 g/m$^2$ to 3.0 g/m$^2$. It is preferably contained in a range from 5 mol % to 50 mol %, and more preferably from 10 mol % to 40 mol %, per 1 mol of silver in the image forming layer.

The reducing agent of the invention can be added in the image forming layer which comprises an organic silver salt and a photosensitive silver halide, or in the layer adjacent to the image forming layer, but it is preferably contained in the image forming layer.

In the invention, the reducing agent may be incorporated into a photothermographic material by being added into the coating solution, such as in the form of a solution, an emulsion dispersion, a solid fine particle dispersion, or the like.

As well known emulsion dispersing method, there can be mentioned a method comprising dissolving the reducing agent in an oil such as dibutylphthalate, tricresylphosphate, glyceryl triacetate, diethylphthalate, or the like, and an auxiliary solvent such as ethyl acetate, cyclohexanone, or the like, followed by mechanically forming an emulsified dispersion.

As solid fine particle dispersing method, there can be mentioned a method comprising dispersing the reducing agent in a proper solvent such as water or the like, by means of ball mill, colloid mill, vibrating ball mill, sand mill, jet mill, roller mill, or ultrasonics, thereby obtaining solid dispersion. A dispersing method using a sand mill is preferable. There may also be used a protective colloid (such as poly(vinyl alcohol)), or a surfactant (for instance, an anionic surfactant such as sodium triisopropylnaphthalenesulfonate (a mixture of compounds having the three isopropyl groups in different substitution sites)). An antiseptic (for instance, benzisothiazolinone sodium salt) can be added in an aqueous dispersion.

In the invention, the reducing agent is particularly preferably used as a solid particle dispersion, and the reducing agent is added in the form of fine particles having average particle size from 0.01 μm to 10 μm, more preferably, from 0.05 μm to 5 μm and, further preferably, from 0.1 μm to 1 μm. In the invention, other solid dispersions are preferably used with this particle size range.

(Development Accelerator)

In the photothermographic material of the invention, sulfonamidophenolic compounds described in the specification of JP-A No. 2000-267222, and represented by formula (A) described in the specification of JP-A No. 2000-330234; hindered phenolic compounds represented by formula (II) described in JP-A No. 2001-92075; hydrazine compounds described in the specification of JP-A No. 10-62895, represented by formula (I) described in the specification of JP-A No. 11-15116, represented by formula (D) described in the specification of JP-A No. 2002-156727, and represented by formula (1) described in the specification of JP-A No. 2002-278017; and phenolic or naphthalic compounds represented by formula (2) described in the specification of JP-A No. 2001-264929 are used preferably as a development accelerator.

Further, phenolic compounds described in JP-A Nos. 2002-311533 and 2002-341484 are also preferable. Naphthalic compounds described in JP-A No. 2003-66558 are particularly preferable. The development accelerator described above is used in a range from 0.1 mol % to 20 mol %, preferably, in a range from 0.5 mol % to 10 mol % and, more preferably, in a range from 1 mol % to 5 mol % with respect to the reducing agent.

The introducing methods to the photothermographic material can include similar methods as those for the reducing agent and, it is particularly preferred to add as a solid dispersion or an emulsion dispersion. In the case of adding as an emulsion dispersion, it is preferred to add as an emulsion dispersion dispersed by using a high boiling solvent which is solid at a normal temperature and an auxiliary solvent at a low boiling point, or to add as a so-called oilless emulsion dispersion not using the high boiling solvent.

In the present invention, among the development accelerators described above, it is more preferred to use hydrazine compounds described in the specification of JP-A Nos. 2002-156727 and 2002-278017, and naphtholic compounds described in the specification of JP-A No. 2003-66558.

Particularly preferred development accelerators of the invention are compounds represented by the following formulae (A-1) or (A-2).

$Q_1$-NHNH-$Q_2$ Formula (A-1)

wherein, $Q_1$ represents an aromatic group or a heterocyclic group which bonds to —NHNH-$Q_2$ at a carbon atom, and $Q_2$ represents one selected from a carbamoyl group, an acyl group, an alkoxycarbonyl group, an aryloxycarbonyl group, a sulfonyl group, or a sulfamoyl group.

In formula (A-1), the aromatic group or the heterocyclic group represented by $Q_1$ is preferably a 5 to 7-membered unsaturated ring. Preferred examples are benzene ring, pyridine ring, pyrazine ring, pyrimidine ring, pyridazine ring, 1,2,4-triazine ring, 1,3,5-triazine ring, pyrrole ring, imidazole ring, pyrazole ring, 1,2,3-triazole ring, 1,2,4-triazole ring, tetrazole ring, 1,3,4-thiadiazole ring, 1,2,4-thiadiazole ring, 1,2,5-thiadiazole ring, 1,3,4-oxadiazole ring, 1,2,4-oxadiazole ring, 1,2,5-oxadiazole ring, thiazole ring, oxazole ring, isothiazole ring, isooxazole ring, and thiophene ring. Condensed rings, in which the rings described above are condensed to each other, are also preferred. The rings described above may have substituents and in a case where they have two or more substituents, the substituents may be identical or different with each other. Examples of the substituents can include halogen atom, alkyl group, aryl group, carbonamide group, alkylsulfonamide group, arylsulfonamide group, alkoxy group, aryloxy group, alkylthio group, arylthio group, carbamoyl group, sulfamoyl group, cyano group, alkylsulfonyl group, arylsulfonyl group, alkoxycarbonyl group, aryloxycarbonyl group and acyl group. In a case where the substituents are groups capable of substitution, they may have further substituents and examples of preferred substituents can include halogen atom, alkyl group, aryl group, carbonamide group, alkylsulfonamide group, arylsulfonamide group, alkoxy group, aryloxy group, alkylthio group, arylthio group, acyl group, alkoxycarbonyl group, aryloxycarbonyl group, carbamoyl group, cyano group, sulfamoyl group, alkylsulfonyl group, arylsulfonyl group, and acyloxy group. The carbamoyl group represented by $Q_2$ is a carbamoyl group preferably having 1 to 50 carbon atoms and, more preferably, having 6 to 40 carbon atoms, and examples can include not-substituted carbamoyl, methyl carbamoyl, N-ethylcarbamoyl, N-propylcarbamoyl, N-sec-butylcarbamoyl, N-octylcarbamoyl, N-cyclohexylcarbamoyl, N-tert-butylcarbamoyl, N-dodecylcarbamoyl, N-(3-dodecyloxypropyl)carbamoyl, N-octadecylcarbamoyl, N-{3-(2,4-tert-pentylphenoxy) propyl}carbamoyl, N-(2-hexyldecyl)carbamoyl, N-phenylcarbamoyl, N-(4-dodecyloxyphenyl)carbamoyl, N-(2-chloro-5-dodecyloxycarbonylphenyl)carbamoyl, N-naphthylcarbaoyl, N-3-pyridylcarbamoyl, and N-benzylcarbamoyl.

The acyl group represented by $Q_2$ is an acyl group having preferably 1 to 50 carbon atoms and, more preferably 6 to 40 carbon atoms and can include, for example, formyl, acetyl, 2-methylpropanoyl, cyclohexylcarbonyl, octanoyl, 2-hexyldecanoyl, dodecanoyl, chloroacetyl, trifluoroacetyl, benzoyl, 4-dodecyloxybenzoyl, and 2-hydroxymethylbenzoyl. Alkoxycarbonyl group represented by $Q_2$ is an alkoxycarbonyl group having preferably 2 to 50 carbon atoms, and more preferably, 6 to 40 carbon atoms and can include, for example, methoxycarbonyl, ethoxycarbonyl, isobutyloxycarbonyl, cyclohexyloxycarbonyl, dodecyloxycarbonyl, and benzyloxycarbonyl.

The aryloxy carbonyl group represented by $Q_2$ is an aryloxycarbonyl group preferably having 7 to 50 carbon atoms and, more preferably, having 7 to 40 carbon atoms and can include, for example, phenoxycarbonyl, 4-octyloxyphenoxycarbonyl, 2-hydroxymethylphenoxycarbonyl, and 4-dodecyloxyphenoxycarbonyl. The sulfonyl group represented by $Q_2$ is a sulfonyl group, preferably having 1 to 50 carbon atoms and, more preferably, having 6 to 40 carbon atoms and can include, for example, methylsulfonyl, butylsulfonyl, octylsulfonyl, 2-hexadecylsulfonyl, 3-dodecyloxypropylsulfonyl, 2-octyloxy-5-tert-octylphenyl sulfonyl, and 4-dodecyloxyphenyl sulfonyl.

The sulfamoyl group represented by $Q_2$ is sulfamoyl group preferably having 0 to 50 carbon atoms, and more preferably, 6 to 40 carbon atoms and can include, for example, not-substituted sulfamoyl, N-ethylsulfamoyl group, N-(2-ethylhexyl)sulfamoyl, N-decylsulfamoyl, N-hexadecylsulfamoyl, N-{3-(2-ethylhexyloxy) propyl}sulfamoyl, N-(2-chloro-5-dodecyloxycarbonylphenyl)sulfamoyl, and N-(2-tetradecyloxyphenyl)sulfamoyl. The group represented by $Q_2$ may further have a group mentioned as the example of the substituent of 5 to 7-membered unsaturated ring represented by $Q_1$ at the position capable of substitution. In a case where the group has two or more substituents, such substituents may be identical or different from each other.

Then, preferred range for the compounds represented by formula (A-1) is to be described. A 5 to 6-membered unsaturated ring is preferred for $Q_1$, and benzene ring, pyrimidine ring, 1,2,3-triazole ring, 1,2,4-triazole ring, tetrazole ring, 1,3,4-thiadiazole ring, 1,2,4-thiadiazole ring, 1,3,4-oxadiazole ring, 1,2,4-oxadiazole ring, thioazole ring, oxazole ring, isothiazole ring, isooxazole ring, and a ring in which the ring described above is condensed with a benzene ring or unsaturated hetero ring are further preferred.

Further, $Q_2$ is preferably a carbamoyl group and, particularly, a carbamoyl group having hydrogen atom on the nitrogen atom is particularly preferred.

Formula (A-2)

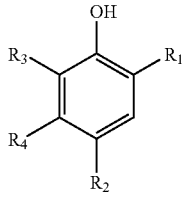

In formula (A-2), $R_1$ represents one selected from an alkyl group, an acyl group, an acylamino group, a sulfonamide group, an alkoxycarbonyl group, or a carbamoyl group. $R_2$ represents one selected from a hydrogen atom, a halogen atom, an alkyl group, an alkoxy group, an aryloxy group, an alkylthio group, an arylthio group, an acyloxy group, or a carbonate ester group. $R_3$ and $R_4$ each independently represent a group capable of substituting for a hydrogen atom on a benzene ring which is mentioned as the example of the substituent for formula (A-1). $R_3$ and $R_4$ may link together to form a condensed ring.

$R_1$ is preferably an alkyl group having 1 to 20 carbon atoms (for example, a methyl group, an ethyl group, an isopropyl group, a butyl group, a tert-octyl group, a cyclohexyl group, or the like), an acylamino group (for example, an acetylamino group, a benzoylamino group, a methylureido group, a 4-cyanophenylureido group, or the like), and a carbamoyl group (for example, a n-butylcarbamoyl group, an N,N-diethylcarbamoyl group, a phenylcarbamoyl group, a 2-chlorophenylcarbamoyl group, a 2,4-dichlorophenylcarbamoyl group, or the like). Among them, an acylamino group (including a ureido group or a urethane group) is more preferred. $R_2$ is preferably a halogen atom (more preferably, a chlorine atom, a bromine atom), an alkoxy group (for example, a methoxy group, a butoxy group, a n-hexyloxy group, a n-decyloxy group, a cyclohexyloxy group, a benzyloxy group, or the like), or an aryloxy group (for example, a phenoxy group, a naphthoxy group, or the like).

$R_3$ is preferably a hydrogen atom, a halogen atom, or an alkyl group having 1 to 20 carbon atoms, and most preferably a halogen atom. $R_4$ is preferably a hydrogen atom, alkyl group, or an acylamino group, and more preferably an alkyl group or an acylamino group. Examples of the preferred substituent thereof are similar to those for $R_1$. In a case where $R_4$ is an acylamino group, $R_4$ may preferably link with $R_3$ to form a carbostyryl ring.

In a case where $R_3$ and $R_4$ in formula (A-2) link together to form a condensed ring, a naphthalene ring is particularly preferred as the condensed ring. The same substituent as the example of the substituent referred to for formula (A-1) may bond to the naphthalene ring. In a case where formula (A-2) is a naphtholic compound, $R_1$, is, preferably, a carbamoyl group. Among them, benzoyl group is particularly preferred. $R_2$ is, preferably, one of an alkoxy group and an aryloxy group and, particularly preferably an alkoxy group.

Preferred specific examples for the development accelerator of the invention are to be described below. The invention is not restricted to them.

A-1

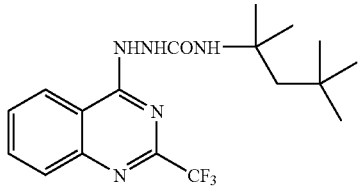

A-2

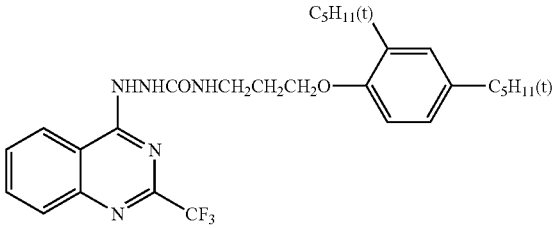

-continued

A-3

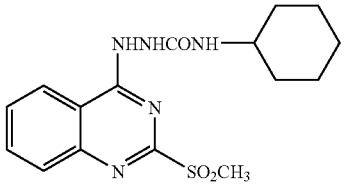

A-4

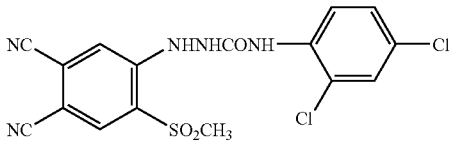

A-5

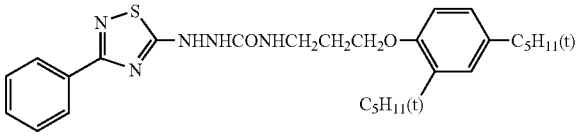

A-6

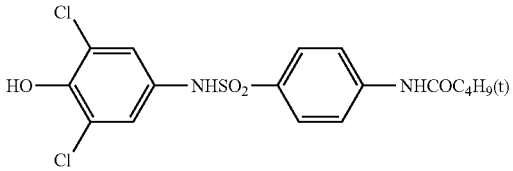

A-7

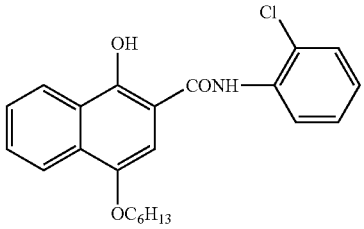

A-8

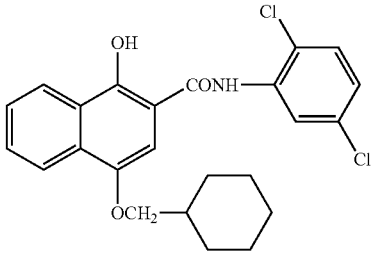

A-9

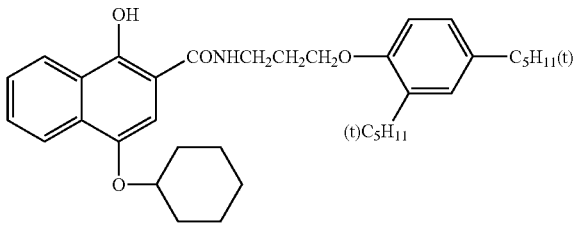

-continued

A-10

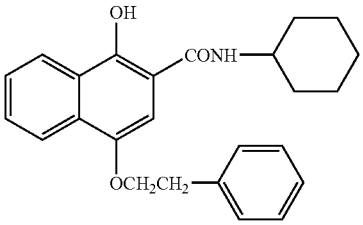

A-11

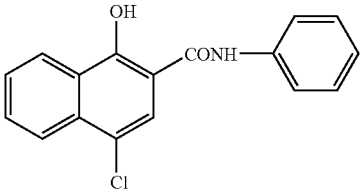

A-12

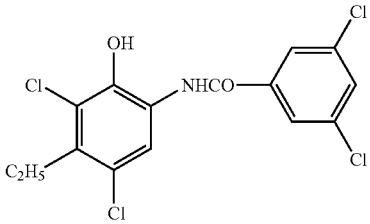

(Hydrogen Bonding Compound)

In the invention, in the case where the reducing agent has an aromatic hydroxy group (—OH) or an amino group, it is preferred to use in combination, a non-reducing compound having a group capable of reacting with these groups of the reducing agent, and that is also capable of forming a hydrogen bond therewith.

As a group capable of forming a hydrogen bond, there can be mentioned a phosphoryl group, a sulfoxide group, a sulfonyl group, a carbonyl group, an amide group, an ester group, a urethane group, a ureido group, a tertiary amino group, a nitrogen-containing aromatic group, and the like. Preferred among them are a phosphoryl group, a sulfoxide group, an amide group (not having >N—H moiety but being blocked in the form of >N-Ra (where, Ra represents a substituent other than H)), a urethane group (not having >N—H moiety but being blocked in the form of >N-Ra (where, Ra represents a substituent other than H)), and a ureido group (not having >N—H moiety but being blocked in the form of >N-Ra (where, Ra represents a substituent other than H)).

In the invention, particularly preferable as the hydrogen bonding compound is the compound expressed by formula (D) shown below.

Formula (D)

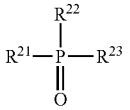

In formula (D), $R^{21}$ to $R^{23}$ each independently represent one selected from an alkyl group, an aryl group, an alkoxy group, an aryloxy group, an amino group, or a heterocyclic group, which may be substituted or unsubstituted.

In the case where $R^{21}$ to $R^{23}$ have a substituent, examples of the substituent include a halogen atom, an alkyl group, an aryl group, an alkoxy group, an amino group, an acyl group, an acylamino group, an alkylthio group, an arylthio group, a sulfonamide group, an acyloxy group, an oxycarbonyl group, a carbamoyl group, a sulfamoyl group, a sulfonyl group, a phosphoryl group, and the like, in which preferred as the substituents are an alkyl group or an aryl group, e.g., a methyl group, an ethyl group, an isopropyl group, a t-butyl group, a t-octyl group, a phenyl group, a 4-alkoxyphenyl group, a 4-acyloxyphenyl group, and the like.

Specific examples of an alkyl group expressed by $R^{21}$ to $R^{23}$ include a methyl group, an ethyl group, a butyl group, an octyl group, a dodecyl group, an isopropyl group, a t-butyl group, a t-amyl group, a t-octyl group, a cyclohexyl group, a 1-methylcyclohexyl group, a benzyl group, a phenetyl group, a 2-phenoxypropyl group, and the like.

As an aryl group, there can be mentioned a phenyl group, a cresyl group, a xylyl group, a naphthyl group, a 4-t-butylphenyl group, a 4-t-octylphenyl group, a 4-anisidyl group, a 3,5-dichlorophenyl group, and the like.

As an alkoxyl group, there can be mentioned a methoxy group, an ethoxy group, a butoxy group, an octyloxy group, a 2-ethylhexyloxy group, a 3,5,5-trimethylhexyloxy group, a dodecyloxy group, a cyclohexyloxy group, a 4-methylcyclohexyloxy group, a benzyloxy group, and the like.

As an aryloxy group, there can be mentioned a phenoxy group, a cresyloxy group, an isopropylphenoxy group, a 4-t-butylphenoxy group, a naphthoxy group, a biphenyloxy group, and the like.

As an amino group, there can be mentioned are a dimethylamino group, a diethylamino group, a dibutylamino group, a dioctylamino group, an N-methyl-N-hexylamino group, a dicyclohexylamino group, a diphenylamino group, an N-methyl-N-phenylamino, and the like.

Preferred as $R^{21}$ to $R^{23}$ are an alkyl group, an aryl group, an alkoxy group, and an aryloxy group. Concerning the effect of the invention, it is preferred that at least one or more of $R^{21}$ to $R^{23}$ are an alkyl group or an aryl group, and more preferably, two or more of them are an alkyl group or an aryl group. From the viewpoint of low cost availability, it is preferred that $R^{21}$ to $R^{23}$ are of the same group.

Specific examples of hydrogen bonding compounds represented by formula (D) of the invention and others are shown below, but it should be understood that the invention is not limited thereto.

D-1

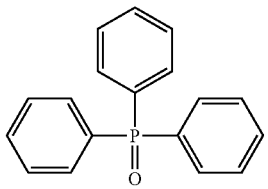

D-2

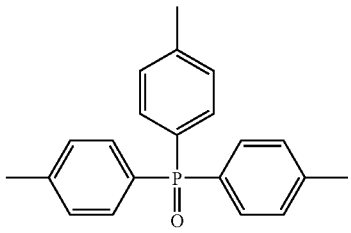

-continued

D-3

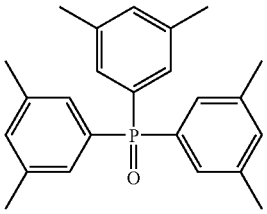

D-4

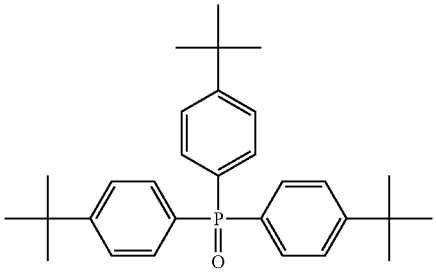

D-5

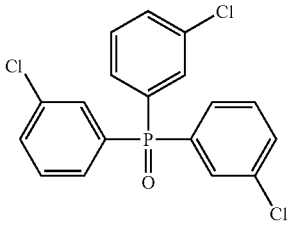

D-6

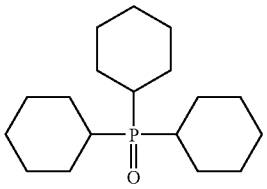

D-7

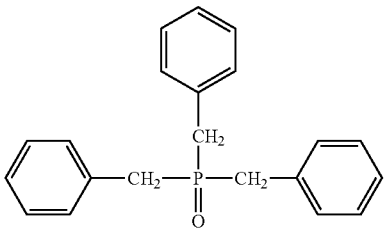

D-8

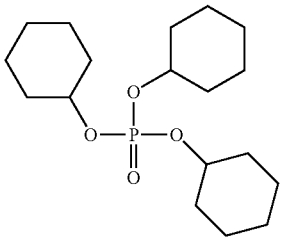

D-9

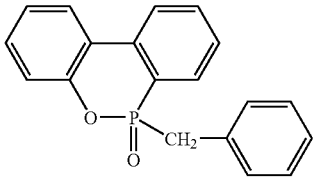

-continued

D-10

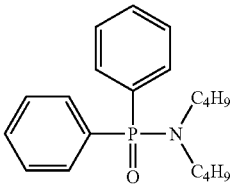

D-11

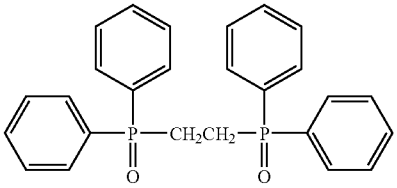

D-12

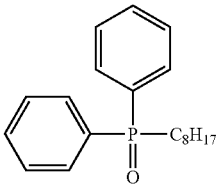

D-13

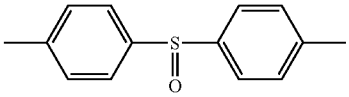

D-14

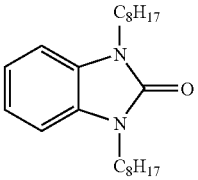

D-15

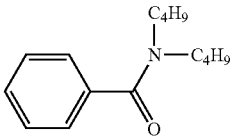

Specific examples of hydrogen bonding compounds other than those enumerated above can be found in those described in JP-A Nos. 2001-281793 and 2002-14438.

The hydrogen bonding compound of the invention can be used in the photothermographic material by being incorporated into a coating solution in the form of solution, emulsion dispersion, or solid fine particle dispersion, similar to the case of the reducing agent. In the solution, the hydrogen bonding compound of the invention forms a hydrogen-bonded complex with a compound having a phenolic hydroxy group, and can be isolated as a complex in crystalline state depending on the combination of the reducing agent and the compound expressed by formula (D).

It is particularly preferred to use the crystal powder thus isolated in the form of a solid fine particle dispersion, because it provides stable performance. Further, it is also preferred to use a method of leading to form complex during dispersion by mixing the reducing agent and the hydrogen bonding compound of the invention in the form of powders and dispersing them with a proper dispersing agent using a sand grinder mill or the like.

The hydrogen bonding compound of the invention is preferably used in a range of from 1 mol % to 200 mol %, more preferably from 10 mol % to 150 mol %, and even more preferably, from 30 mol % to 100 mol %, with respect to the reducing agent.

(Binder)

Any kind of polymer may be used as the binder for the image forming layer of the invention, as far as it has a glass transition temperature in a range of from 0° C. to 80° C. Suitable as the binder are those that are transparent or translucent, and that are generally colorless, such as natural resin or polymer and their copolymers; synthetic resin or polymer and their copolymer; or media forming a film; for example, included are gelatins, rubbers, poly(vinyl alcohols), hydroxyethyl celluloses, cellulose acetates, cellulose acetate butyrates, poly(vinyl pyrrolidones), casein, starch, poly(acrylic acids), poly(methylmethacrylic acids), poly(vinyl chlorides), poly(methacrylic acids), styrene-maleic anhydride copolymers, styrene-acrylonitrile copolymers, styrene-butadiene copolymers, poly(vinyl acetals) (e.g., poly(vinyl formal) or poly(vinyl butyral)), polyesters, polyurethanes, phenoxy resin, poly(vinylidene chlorides), polyepoxides, polycarbonates, poly(vinyl acetates), polyolefins, cellulose esters, and polyamides. A binder may be used with water, an organic solvent or emulsion to form a coating solution.

The glass transition temperature (Tg) of the binder is in a range of from 0° C. to 80° C., preferably from 10° C. to 70° C. and, more preferably from 15° C. to 60° C.

In the specification, Tg is calculated according to the following equation.

$$1/Tg=\Sigma(Xi/Tgi)$$

where the polymer is obtained by copolymerization of n monomer compounds (from i=1 to i=n); Xi represents the mass fraction of the ith monomer ($\Sigma Xi=1$), and Tgi is the glass transition temperature (absolute temperature) of the homopolymer obtained with the ith monomer. The symbol $\Sigma$ stands for the summation from i=1 to i=n. Values for the glass transition temperature (Tgi) of the homopolymers derived from each of the monomers were obtained from J. Brandrup and E. H. Immergut, Polymer Handbook (3rd Edition) (Wiley-Interscience, 1989).

The binder may be of two or more kinds of polymers depending on needs. And, the polymer having Tg of 20° C. or more and the polymer having Tg of less than 20° C. can be used in combination. In the case where two or more kinds of polymers differing in Tg may be blended for use, it is preferred that the weight-average Tg is in the range mentioned above.

In the invention, the image forming layer is prefrably formed by applying a coating solution containing 30% by weight or more of water in the solvent and by then drying.

In the invention, in the case where the image forming layer is formed by first applying a coating solution containing 30% by weight or more of water in the solvent and by then drying, furthermore, in the case where the binder of the image forming layer is soluble or dispersible in an aqueous solvent (water solvent), and particularly in the case where a polymer latex having an equilibrium water content of 2% by weight or lower under 25° C. and 60% RH is used, the performance can be enhanced. Most preferred embodiment is such prepared to yield an ion conductivity of 2.5 mS/cm or lower, and as such a preparing method, there can be mentioned a refining treatment using a separation function membrane after synthesizing the polymer.

The aqueous solvent in which the polymer is soluble or dispersible, as referred herein, signifies water or water containing mixed therein 70% by weight or less of a water-miscible organic solvent. As water-miscible organic solvents, there can be used, for example, alcohols such as methyl alcohol, ethyl alcohol, propyl alcohol, and the like; cellosolves such as methyl cellosolve, ethyl cellosolve, butyl cellosolve, and the like; ethyl acetate, dimethylformamide, and the like.

The term "aqueous solvent" is also used in the case the polymer is not thermodynamically dissolved, but is present in a so-called dispersed state.

The term "equilibrium water content under 25° C. and 60% RH" as referred herein can be expressed as follows:

$$\text{Equilibrium water content under 25° C. and 60\% RH}=[(W1-W0)/W0]\times 100\ (\%\text{ by weight})$$

wherein, W1 is the weight of the polymer in moisture-controlled equilibrium under the atmosphere of 25° C. and 60% RH, and W0 is the absolutely dried weight at 25° C. of the polymer.

For the definition and the method of measurement for water content, reference can be made to Polymer Engineering Series 14, "Testing methods for polymeric materials" (The Society of Polymer Science, Japan, published by Chijin Shokan).

The equilibrium water content under 25° C. and 60% RH is preferably 2% by weight or lower, but is more preferably, from 0.01% by weight to 1.5% by weight, and is most preferably, from 0.02% by weight to 1% by weight.

The binders used in the invention are, particularly preferably, polymers capable of being dispersed in an aqueous solvent. Examples of dispersed states may include a latex, in which water-insoluble fine particles of hydrophobic polymer are dispersed, or such in which polymer molecules are dispersed in molecular states or by forming micelles, but preferred are latex-dispersed particles. The average particle size of the dispersed particles is in a range of from 1 nm to 50,000 nm, preferably from 5 nm to 1,000 nm, more preferably from 10 nm to 500 nm, and even more preferably from 50 nm to 200 nm. There is no particular limitation concerning particle size distribution of the dispersed particles, and they may be widely distributed or may exhibit a monodisperse particle size distribution.

From the viewpoint of controlling the physical properties of the coating solution, preferred mode of usage includes mixing two or more types of dispersed particles each having monodisperse particle distribution.

In the invention, preferred embodiment of the polymers capable of being dispersed in aqueous solvent includes hydrophobic polymers such as acrylic polymers, polyesters, rubbers (e.g., SBR resin), polyurethanes, poly(vinyl chlorides), poly(vinyl acetates), poly(vinylidene chlorides), polyolefins, or the like. As the polymers above, usable are straight chain polymers, branched polymers, or crosslinked polymers; also usable are the so-called homopolymers in which one kind of monomer is polymerized, or copolymers in which two or more kinds of monomers are polymerized. In the case of a copolymer, it may be a random copolymer or a block copolymer.

The molecular weight of these polymers is, in number average molecular weight, in a range of from 5,000 to 1,000,000, preferably from 10,000 to 200,000. Those having too small a molecular weight exhibit insufficient mechanical strength on forming the image forming layer, and those having too large a molecular weight are also not preferred because the resulting film-forming properties are poor. Further, crosslinking polymer latexes are particularly preferred for use.

<Examples of Latex>

Specific examples of preferred polymer latexes are given below, which are expressed by the starting monomers with % by weight given in parenthesis. The molecular weight is given in number average molecular weight. In the case polyfunctional monomer is used, the concept of molecular weight is not applicable because they build a crosslinked structure. Hence, they are denoted as "crosslinking", and the molecular weight is omitted. Tg represents glass transition temperature.

P-1; Latex of -MMA(70)-EA(27)-MAA(3)- (molecular weight 37000, Tg 61° C.)

P-2; Latex of -MMA(70)-2EHA(20)-St(5)-AA(5)- (molecular weight 40000, Tg 59° C.)

P-3; Latex of -St(50)-Bu(47)-MAA(3)- (crosslinking, Tg −17° C.)

P-4; Latex of -St(68)-Bu(29)-AA(3)- (crosslinking, Tg 17° C.)

P-5; Latex of -St(71)-Bu(26)-AA(3)- (crosslinking, Tg 24° C.)

P-6; Latex of -St(70)-Bu(27)-IA(3)- (crosslinking)

P-7; Latex of -St(75)-Bu(24)-AA(1)- (crosslinking, Tg 29° C.)

P-8; Latex of -St(60)-Bu(35)-DVB(3)-MAA(2)- (crosslinking)

P-9; Latex of -St(70)-Bu(25)-DVB(2)-AA(3)- (crosslinking)

P-10; Latex of -VC(50)-MMA(20)-EA(20)-AN(5)-AA(5)- (molecular weight 80000)

P-11; Latex of -VDC(85)-MMA(5)-EA(5)-MAA(5)- (molecular weight 67000)

P-12; Latex of -Et(90)-MAA(10)- (molecular weight 12000)

P-13; Latex of -St(70)-2EHA(27)-AA(3)- (molecular weight 130000, Tg 43° C.)

P-14; Latex of -MMA(63)-EA(35)-AA(2)- (molecular weight 33000, Tg 47° C.)

P-15; Latex of -St(70.5)-Bu(26.5)-AA(3)- (crosslinking, Tg 23° C.)

P-16; Latex of -St(69.5)-Bu(27.5)-AA(3)- (crosslinking, Tg 20.5° C.)

In the structures above, abbreviations represent monomers as follows. MMA: methyl metacrylate, EA: ethyl acrylate, MAA: methacrylic acid, 2EHA: 2-ethylhexyl acrylate, St: styrene, Bu: butadiene, AA: acrylic acid, DVB: divinylbenzene, VC: vinyl chloride, AN: acrylonitrile, VDC: vinylidene chloride, Et: ethylene, IA: itaconic acid.

The polymer latexes above are commercially available, and polymers below are usable. As examples of acrylic polymers, there can be mentioned Cevian A-4635, 4718, and 4601 (all manufactured by Daicel Chemical Industries, Ltd.), Nipol Lx811, 814, 821, 820, and 857 (all manufactured by Nippon Zeon Co., Ltd.), and the like; as examples of polyester, there can be mentioned FINETEX ES650, 611, 675, and 850 (all manufactured by Dainippon Ink and Chemicals, Inc.), WD-size and WMS (all manufactured by Eastman Chemical Co.), and the like; as examples of polyurethane, there can be mentioned HYDRAN AP10, 20, 30, and 40 (all manufactured by Dainippon Ink and Chemicals, Inc.), and the like; as examples of rubber, there can be mentioned LACSTAR 7310K, 3307B, 4700H, and 7132C (all manufactured by Dainippon Ink and Chemicals, Inc.), Nipol Lx416, 410, 438C, and 2507 (all manufactured by Nippon Zeon Co., Ltd.), and the like; as examples of poly(vinyl chloride), there can be mentioned G351 and G576 (all manufactured by Nippon Zeon Co., Ltd.), and the like; as examples of poly(vinylidene chloride), there can be mentioned L502 and L513 (all manufactured by Asahi Chemical Industry Co., Ltd.), and the like; as examples of polyolefin, there can be mentioned Chemipearl S120 and SA100 (all manufactured by Mitsui Petrochemical Industries, Ltd.), and the like.

The polymer latex above may be used alone, or may be used by blending two or more kinds depending on needs.

<Preferable Latexes>

Particularly preferable as the polymer latex for use in the invention are that of styrene-butadiene copolymer. The mass ratio of monomer unit for styrene to that of butadiene constituting the styrene-butadiene copolymer is preferably in a range of from 40:60 to 95:5. Further, the monomer unit of styrene and that of butadiene preferably account for 60% by weight to 99% by weight with respect to the copolymer.

Further, the polymer latex of the invention preferably contains acrylic acid or methacrylic acid in a range of from 1% by weight to 6% by weight with respect to the sum of styrene and butadiene, and more preferably from 2% by weight to 5% by weight. The polymer latex of the invention preferably contains acrylic acid. Preferable range of molecular weight is similar to that described above.

As the latex of styrene-butadiene copolymer preferably used in the invention, there can be mentioned P-3 to P-8, and P-15, or commercially available LACSTAR 3307B, LACSTAR 7132C, Nipol Lx416, and the like.

In the image forming layer of the photothermographic material according to the invention, if necessary, there can be added hydrophilic polymers such as gelatin, poly(vinyl alcohol), methyl cellulose, hydroxypropyl cellulose, carboxymethyl cellulose, or the like. These hydrophilic polymers are added at an amount of 30% by weight or less, and preferably 20% by weight or less, with respect to the total weight of the binder incorporated in the image forming layer.

According to the invention, the layer containing organic silver salt (image forming layer) is preferably formed by using polymer latex for the binder. According to the amount of the binder for the image forming layer, the mass ratio of total binder to organic silver salt (total binder/organic silver salt) is preferably in a range of from 1/10 to 10/1, more preferably from 1/3 to 5/1, and even more preferably from 1/1 to 3/1.

The image forming layer is, in general, a photosensitive layer (image forming layer) containing a photosensitive silver halide, i.e., the photosensitive silver salt; in such a case, the mass ratio of total binder to silver halide (total binder/silver halide) is in a range of from 400 to 5, and more preferably, from 200 to 10.

The total amount of binder in the image forming layer of the invention is preferably in a range of from 0.2 $g/m^2$ to 30 $g/m^2$, more preferably from 1 $g/m^2$ to 15 $g/m^2$, and even more preferably from 2 $g/m^2$ to 10 $g/m^2$. As for the image forming layer of the invention, there may be added a crosslinking agent for crosslinking, or a surfactant and the like to improve coating properties.

(Preferred Solvent of Coating Solution)

In the invention, a solvent of a coating solution for the image forming layer in the photothermographic material of the invention (wherein a solvent and water are collectively described as a solvent for simplicity) is preferably an aqueous solvent containing water at 30% by weight or more. Examples of solvents other than water may include any of water-miscible organic solvents such as methyl alcohol, ethyl alcohol, isopropyl alcohol, methyl cellosolve, ethyl cellosolve, dimethylformamide and ethyl acetate. A water content in a solvent is more preferably 50% by weight or more, and even more preferably 70% by weight or more. Concrete examples of a preferable solvent composition, in addition to water=100, are compositions in which methyl alcohol is contained at ratios of water/methyl alcohol=90/10 and 70/30, in which dimethylformamide is further contained at a ratio of water/methyl alcohol/dimethylformamide=80/15/5, in which ethyl cellosolve is further contained at a ratio of water/methyl alcohol/ethyl cellosolve=85/10/5, and in which isopropyl alcohol is further contained at a ratio of water/methyl alcohol/isopropyl alcohol=85/10/5 (wherein the numerals presented above are values in % by weight).

(Antifoggant)

As an antifoggant, stabilizer and stabilizer precursor usable in the invention, there can be mentioned those disclosed as patents in paragraph number 0070 of JP-A No. 10-62899 and in line 57 of page 20 to line 7 of page 21 of EP-A No. 0803764A1, the compounds described in JP-A Nos. 9-281637 and 9-329864, U.S. Pat. No. 6,083,681, and EP No. 1048975.

1) Organic Polyhalogen Compound

Preferable organic polyhalogen compound that can be used in the invention is explained specifically below. In the invention, preferred organic polyhalogen compound is the compound expressed by the following formula (H).

$$Q\text{-}(Y)n\text{—}C(Z_1)(Z_2)X \qquad \text{Formula (H)}$$

In formula (H), Q represents one selected from an alkyl group, an aryl group, or a heterocyclic group; Y represents a divalent linking group; n represents 0 or 1; $Z_1$ and $Z_2$ each represent a halogen atom; and X represents a hydrogen atom or an electron-attracting group.

In formula (H), Q is preferably an alkyl group having 1 to 6 carbon atoms, an aryl group having 6 to 12 carbon atoms, or a heterocyclic group comprising at least one nitrogen atom (pyridine, quinoline, or the like).

In the case where Q is an aryl group in formula (H), Q preferably is a phenyl group substituted by an electron-attracting group whose Hammett substituent constant σp yields a positive value. For the details of Hammett substituent constant, reference can be made to Journal of Medicinal Chemistry, vol. 16, No. 11 (1973), pp. 1207 to 1216, and the like. As such electron-attracting groups, examples include, halogen atoms, an alkyl group substituted by an electron-attracting group, an aryl group substituted by an electron-attracting group, a heterocyclic group, an alkylsulfonyl group, an arylsulfonyl group, an acyl group, an alkoxycarbonyl group, a carbamoyl group, sulfamoyl group and the like. Preferable as the electron-attracting group is a halogen atom, a carbamoyl group, or an arylsulfonyl group, and particularly preferred among them is a carbamoyl group.

X is preferably an electron-attracting group. As the electron-attracting group, preferable are a halogen atom, an aliphatic arylsulfonyl group, a heterocyclic sulfonyl group, an aliphatic arylacyl group, a heterocyclic acyl group, an aliphatic aryloxycarbonyl group, a heterocyclic oxycarbonyl group, a carbamoyl group, and a sulfamoyl group; more preferable are a halogen atom and a carbamoyl group; and particularly preferable is a bromine atom.

$Z_1$ and $Z_2$ each are preferably a bromine atom or an iodine atom, and more preferably, a bromine atom.

Y preferably represents —C(═O)—, —SO—, —$SO_2$—, —C(═O)N(R)—, or —$SO_2$N(R)—; more preferably, —C(═O)—, —$SO_2$—, or —C(═O)N(R)—; and particularly preferably, —$SO_2$— or —C(═O)N(R)—. Herein, R represents a hydrogen atom, an aryl group, or an alkyl group, preferably a hydrogen atom or an alkyl group, and particularly preferably a hydrogen atom.

n represents 0 or 1, and preferably represents 1.

In formula (H), in the case where Q is an alkyl group, Y is preferably —C(═O)N(R)—. And, in the case where Q is an aryl group or a heterocyclic group, Y is preferably —$SO_2$—.

In formula (H), the form where the residues, which are obtained by removing a hydrogen atom from the compound, bind to each other (generally called bis type, tris type, or tetrakis type) is also preferably used.

In formula (H), the form having a substituent of a dissociative group (for example, a COOH group or a salt thereof, an $SO_3H$ group or a salt thereof, a $PO_3H$ group or a salt thereof, or the like), a group containing a quaternary nitrogen cation (for example, an ammonium group, a pyridinium group, or the like), a polyethyleneoxy group, a hydroxy group, or the like is also preferable.

Specific examples of the compound expressed by formula (H) of the invention are shown below.

H-1

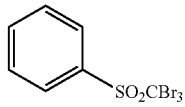

H-2

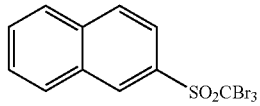

H-3

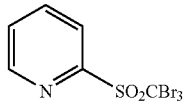

H-4

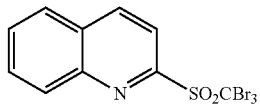

H-5

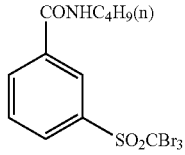

H-6

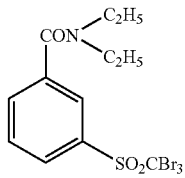

H-7

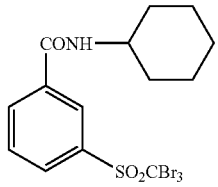

-continued

H-8

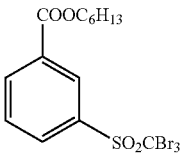

H-9

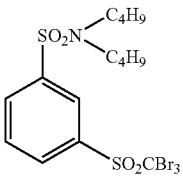

H-10

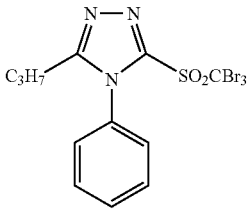

H-11

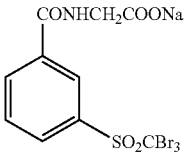

H-12

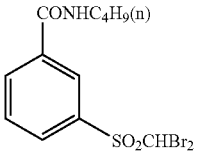

H-13

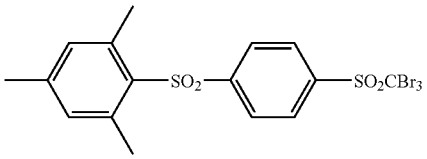

H-14

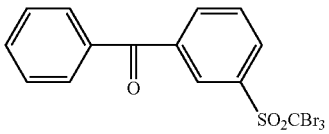

H-15

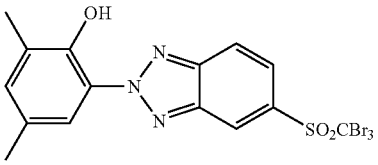

H-16

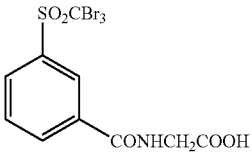

-continued

H-17

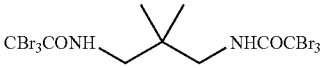

H-18

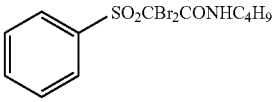

H-19

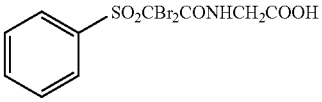

As preferred organic polyhalogen compounds of the invention other than those above, there can be mentioned compounds disclosed in U.S. Pat. Nos. 3,874,946, 4,756,999, 5,340,712, 5,369,000, 5,464,737, and 6,506,548, JP-A Nos. 50-137126, 50-89020, 50-119624, 59-57234, 7-2781, 7-5621, 9-160164, 9-244177, 9-244178, 9-160167, 9-319022, 9-258367, 9-265150, 9-319022, 10-197988, 10-197989, 11-242304, 2000-2963, 2000-112070, 2000-284410, 2000-284412, 2001-33911, 2001-31644, 2001-312027, and 2003-50441. Particularly, compounds disclosed in JP-A Nos. 7-2781, 2001-33911 and 20001-312027 are preferable.

The compound expressed by formula (H) of the invention is preferably used in an amount of from $10^{-4}$ mol to 1 mol, more preferably, from $10^{-3}$ mol to 0.5 mol, and further preferably, from $1\times10^{-2}$ mol to 0.2 mol, per 1 mol of non-photosensitive silver salt incorporated in the image forming layer.

In the invention, usable methods for incorporating the antifoggant into the photothermographic material are those described above in the method for incorporating the reducing agent, and also for the organic polyhalogen compound, it is preferably added in the form of a solid fine particle dispersion.

2) Other Antifoggants

As other antifoggants, there can be mentioned a mercury (II) salt described in paragraph number 0113 of JP-A No. 11-65021, benzoic acids described in paragraph number 0114 of the same literature, a salicylic acid derivative described in JP-A No. 2000-206642, a formaline scavenger compound expressed by formula (S) in JP-A No. 2000-221634, a triazine compound related to Claim 9 of JP-A No. 11-352624, a compound expressed by formula (III), 4-hydroxy-6-methyl-1,3,3a,7-tetrazaindene and the like, described in JP-A No. 6-11791.

The photothermographic material of the invention may further contain an azolium salt in order to prevent fogging. Azolium salts useful in the present invention include a compound expressed by formula (XI) described in JP-A No. 59-193447, a compound described in Japanese Patent Application Publication (JP-B) No. 55-12581, and a compound expressed by formula (II) in JP-A No. 60-153039. The azolium salt may be added to any part of the photothermographic material, but as an additional layer, it is preferred to select a layer on the side having thereon the image forming layer, and more preferred is to select the image forming layer itself. The azolium salt may be added at any time of the process of preparing the coating solution; in the case where the azolium salt is added into the image forming layer, any time of the process may be selected, from the preparation of the organic silver salt to the preparation of the coating solution, but preferred is to add the salt after preparing the organic silver salt and just before coating. As the method for adding the azolium salt, any method using a powder, a solution, a fine-particle dispersion, and the like, may be used.

Furthermore, it may be added as a solution having mixed therein other additives such as sensitizing agents, reducing agents, toners, and the like. In the invention, the azolium salt may be added at any amount, but preferably, it is added in a range of from $1\times10^{-6}$ mol to 2 mol, and more preferably, from $1\times10^{-3}$ mol to 0.5 mol, per 1 mol of silver.

(Other Additives)

1) Mercapto Compounds, Disulfides and Thiones

In the invention, mercapto compounds, disulfide compounds, and thione compounds can be added in order to control the development by suppressing or enhancing development, to improve spectral sensitization efficiency, and to improve storage properties before and after development. Descriptions can be found in paragraph numbers 0067 to 0069 of JP-A No. 10-62899, a compound expressed by formula (I) of JP-A No. 10-186572 and specific examples thereof shown in paragraph numbers 0033 to 0052, in lines 36 to 56 in page 20 of EP No. 0803764A1. Among them, mercapto-substituted heterocyclic aromatic compounds described in JP-A Nos. 9-297367, 9-304875, 2001-100358, 2002-303954, 2002-303951, and the like are preferred.

2) Toner

In the photothermographic material of the present invention, the addition of a toner is preferred. The description of the toner can be found in JP-A No.10-62899 (paragraph numbers 0054 to 0055), EP No. 0803764A1 (page 21, lines 23 to 48), JP-A Nos. 2000-356317 and 2000-187298. Preferred are phthalazinones (phthalazinone, phthalazinone derivatives and metal salts thereof, (e.g., 4-(1-naphthyl) phthalazinone, 6-chlorophthalazinone, 5,7-dimethoxyphthalazinone, and 2,3-dihydro-1,4-phthalazinedione); combinations of phthalazinones and phthalic acids (e.g., phthalic acid, 4-methylphthalic acid, 4-nitrophthalic acid, diammonium phthalate, sodium phthalate, potassium phthalate, and tetrachlorophthalic anhydride); phthalazines (phthalazine, phthalazine derivatives and metal salts thereof, (e.g., 4-(1-naphthyl)phthalazine, 6-isopropylphthalazine, 6-tert-butylphthalazine, 6-chlorophthalazine, 5,7-dimethoxyphthalazine, and 2,3-dihydrophthalazine); combinations of phthalazines and phthalic acids. Particularly preferred is a combination of phthalazines and phthalic acids. Among them, particularly preferable are the combination of 6-isopropylphthalazine and phthalic acid, and the combination of 6-isopropylphthalazine and 4-methylphthalic acid.

3) Plasticizer and Lubricant

In the invention, well-known plasticizer and lubricant can be used to improve physical properties of film. Particularly, to improve handling facility during manufacturing process or scratch resistance during thermal development, it is preferred to use a lubricant such as a liquid paraffin, a long chain fatty acid, an amide of fatty acid, an ester of fatty acid and the like. Paticularly preferred are a liquid paraffin obtained by removing components having low boiling point and an ester of fatty acid having a branch structure and a molecular weight of 1000 or more.

Concerning plasticizers and lubricants usable in the image forming layer and in the non-photosensitive layer, compounds described in paragraph No. 0117 of JP-A No. 11-65021 and in JP-A Nos. 2000-5137, 2004-219794, 2004-219802, and 2004-334077 are preferable.

4) Dyes and Pigments

From the viewpoint of improving color tone, preventing the generation of interference fringes and preventing irradiation on laser exposure, various kinds of dyes and pigments (for instance, C.I. Pigment Blue 60, C.I. Pigment Blue 64, and C.I. Pigment Blue 15:6) can be used in the image forming layer of the invention. Detailed description can be found in WO No. 98/36322, JP-A Nos. 10-268465 and 11-338098, and the like.

5) Nucleator

Concerning the photothermographic material of the invention, it is preferred to add a nucleator into the image forming layer. Details on the nucleators, method for their addition and addition amount can be found in paragraph No. 0118 of JP-A No. 11-65021, paragraph Nos. 0136 to 0193 of JP-A No. 11-223898, as compounds expressed by formulae (H), (1) to (3), (A), and (B) in JP-A No. 2000-284399; as for a nucleation accelerator, description can be found in paragraph No. 0102 of JP-A No. 11-65021, and in paragraph Nos. 0194 to 0195 of JP-A No. 11-223898.

In the case of using formic acid or formates as a strong fogging agent, it is preferably incorporated into the side having thereon the image forming layer containing photosensitive silver halide, at an amount of 5 mmol or less, and preferably 1 mmol or less, per 1 mol of silver.

In the case of using a nucleator in the photothermographic material of the invention, it is preferred to use an acid resulting from hydration of diphosphorus pentaoxide, or a salt thereof in combination. Acids resulting from the hydration of diphosphorus pentaoxide or salts thereof include metaphosphoric acid (salt), pyrophosphoric acid (salt), orthophosphoric acid (salt), triphosphoric acid (salt), tetraphosphoric acid (salt), hexametaphosphoric acid (salt), and the like. Particularly preferred acids obtainable by the hydration of diphosphorus pentaoxide or salts thereof include orthophosphoric acid (salt) and hexametaphosphoric acid (salt). Specifically mentioned as the salts are sodium orthophosphate, sodium dihydrogen orthophosphate, sodium hexametaphosphate, ammonium hexametaphosphate, and the like.

The addition amount of the acid obtained by hydration of diphoshorus pentaoxide or the salt thereof (i.e., the coating amount per 1 $m^2$ of the photothermographic material) may be set as desired depending on sensitivity and fogging, but preferred is an amount of from 0.1 $mg/m^2$ to 500 $mg/m^2$, and more preferably, from 0.5 $mg/m^2$ to 100 $mg/m^2$.

The reducing agent, hydrogen bonding compound, development accelerator, and organic polyhalogen compound according to the invention are preferably used in the form of a solid dispersion. Preferred methods for preparing these solid dispersions are described in JP-A No. 2002-55405.

6) Preparation of Coating Solution and Coating

The temperature for preparing the coating solution for the image forming layer of the invention is preferably from 30° C. to 65° C., more preferably, 35° C. or more and less than 60° C., and further preferably, from 35° C. to 55° C. Furthermore, the temperature of the coating solution for the image forming layer immediately after adding the polymer latex is preferably maintained in the temperature range from 30° C. to 65° C.

(Layer Constitution and Other Constituting Components)

1) Surface Protective Layer

The photothermographic material of the invention can comprise a surface protective layer with an object to prevent adhesion of the image forming layer. The surface protective layer may be a single layer, or plural layers. Description of the surface protective layer may be found in paragraph Nos. 0119 to 0120 of JP-A No. 11-65021 and in JP-A No. 2001-348546.

Preferred as the binder of the surface protective layer of the invention is gelatin, but poly(vinyl alcohol) (PVA) may be used preferably instead, or in combination. As gelatin, there can be used an inert gelatin (e.g., Nitta gelatin 750), a phthalated gelatin (e.g., Nitta gelatin 801), and the like.

Usable as PVA are those described in paragraph Nos. 0009 to 0020 of JP-A No. 2000-171936, and preferred are the completely saponified product PVA-105 and the partially saponified PVA-205 and PVA-335, as well as modified poly(vinyl alcohol) MP-203 (trade name of products from Kuraray Ltd.).

The coating amount of poly(vinyl alcohol) (per 1 $m^2$ of support) in the protective layer (per one layer) is preferably in a range of from 0.3 $g/m^2$ to 4.0 $g/m^2$, and more preferably, from 0.3 $g/m^2$ to 2.0 $g/m^2$.

The coating amount of total binder (including water-soluble polymer and latex polymer) (per 1 $m^2$ of support) in the surface protective layer (per one layer) is preferably in a range of from 0.3 $g/m^2$ to 5.0 $g/m^2$, and more preferably, from 0.3 $g/m^2$ to 2.0 $g/m^2$.

2) Antihalation Layer

It is preferred that the photothermographic material of the present invention contains a dye having absorption at the exposure wavelength region in at least one layer of an image forming layer and a non-photosensitive layer to prevent halation at the exposure. The said non-photosensitive layer is located in nearer side to a support than an image forming layer (may be an antihalation layer or an undercoat layer) or, on the backside opposite of a support from an image forming layer.

In the case where the exposure wavelength is in an infrared region, an infrared dye may be used, and in the case where the exposure wavelength is in an ultraviolet region, an ultraviolet absorbing dye may be used, whereby both dyes preferably have no absorption in the visible region or have a little visible light absorption.

In the case where the exposure wavelength is present in the visible region, it is preferred to allow substantially no color of the dye to remain after the image formation and to use a decoloring method by heating at thermal development. In particular, the non-photosensitive layer is preferably rendered to function as a thermal bleaching antihalation layer by adding thereto a thermal bleaching dye and a base precursor. These techniques are described in JP-A No. 11-231457 and the like.

The addition amount of the antihalation dye is determined depending on the usage of the dye. In general, it is used at an amount as such that the optical density (absorbance) exceeds 0.1 when measured at the desired wavelength. In particular, the optical density is preferably in a range of from 0.2 to 2. The addition amount of dyes to obtain optical density in the above range is generally about from 0.001 $g/m^2$ to 1 $g/m^2$.

In the case where the exposure source is a laser beam, it is enough that the antihalation layer has the absorption in the narrow wavelength region correspondent to the peak of the emission wavelength, therefore it is possible to be a lower coating amount of the dye and to produce photosensitive material with lower cost.

Shorter the emission peak wavelength of laser beam is, more fine definition image recording is possible. Therefore, the emission peak wavelength of laser beam is preferably from 350 nm to 430 nm, and more preferably from 380 nm to 420 nm from the practical point of view.

In the case where the laser beam as the exposure light source has the emission peak wavelength at 350 nm to 430 nm, it is preferred that the antihalation dye has the absorption maximum at the wavelength between 350 nm to 430 nm. Further, in the case where the emission peak wavelength of laser beam is present between 380 nm to 420 nm, it is preferred that the dye described above has the absorption maximum at the wavelength between 380 nm to 420 nm.

The layer comprising the dye having an absorption maximum at the wavelength between 350 nm to 430 nm preferably may be an image forming layer, a non-photosensitive layer (may be an antihalation layer) in the nearer side to the support than an image forming layer, or a non-photosensitive layer on the backside which is disposed opposite of the support from the image forming layer.

The kind of dye described above is not particularly limited as far as it has an absorption maximum between 350 nm to 430 nm. The absorption maximum measured between 350 nm to 430 nm may be either of a main absorption or a sub absorption. As specific examples of the dye having an absorption maximum between 350 nm to 430 nm, an azo dye, an azomethine dye, a quinone dye (e.g., an anthraquinone dye, a naphthoquinone dye, or the like), a quinoline dye (e.g., a quinophthalone dye or the like), a methine dye (e.g., a cyanine dye, a merocyanine dye, an oxonol dye, a styryl dye, an arylidene dye, an aminobutadiene dye, or the like and a polymethine dye is also contained), a carbonium dye (e.g., a cationic dye such as diphenylmethane dye, a triphenylmethane dye, a xanthene dye, an acridine dye, or the like), an azine dye (e.g., a cationic dye such as a thiazine dye, an oxazine dye, a phenazine dye and the like), an aza [18]▯ electron dye (e.g., a porphin dye, a tetrazaporphin dye, a phthalocyanine dye, or the like), an indigoid dye (e.g., indigo, a thioindigo dye, or the like), a squalenium dye, a croconium dye, a pyrromethene dye, a nitro-nitroso dye, a benzotriazole dye, a triazine dye, and the like can be described. An azo dye, an azomethine dye, a quinone dye, a quinoline dye, a methine dye, an aza [18]▯ electron dye, an indigoid dye, and a pyrromethene dye are preferable, an azo dye, an azomethine dye, and a methine dye are more preferable and, a methine dye is particularly preferable.

These dyes may be present in a solid fine particle dispersing state or in an aggregating state (a liquid crystal state also contained), and two or more kinds of the dyes may be used in combination.

A dye having larger absorption at the exposure wavelength is preferably used as the antihalation dye because the coating amount of the dye can be reduced. Therefore, an antihalation dye preferably has a narrow half band width and a sharp absorption peak on an absorption spectrum. In another way, it is also preferred to use a dye under the condition wherein the dye shows such absorption. In order to the dye to have larger absorption and sharper absorption spectrum, it is preferred to be used under the dispersing state of solid fine particle or the aggregating state. A dye having an ionic hydrophilic group is preferably used for formation of an aggregating state.

The half band width of the dye is preferably 100 nm or less, more preferably 75 nm or less, and even more preferably 50 nm or less.

The antihalation dye either may be decolored after the image formation or may not be decolored. In the case where the dye is not decolored (from now on, this is called non-bleaching), the dye is preferably not remarkable in visual and the ratio of the absorption at the exposure wavelength to the absorption at 425 nm is preferably larger.

For example, in the case where the photothermographic material is exposed by a laser diode having a radiation at 405 nm, the ratio of an absorption at 405 nm to the absorption at 425 nm is preferably 5 or more, more preferably 10 or more and, particularly preferably 15 or more.

As examples of these dyes, an aminobutadiene dye, a merocyanine dye in which an acidic nucleus and an alkaline nucleus directory connect with each other, or a polymethine dye can be described. And in the case of non-bleaching dye, it can be added as an aqueous solution when it might be water-soluble.

On the other hand, an antihalation dye is preferably decolored in thermal developing process. As the decoloring method, following methods are known and any method thereof can be used.

The decoloring method by the reaction of a coloring matter (dye), which contains an electron-donating color-forming organic compound and an acidic developer, and a specific decoloring agent at thermal development, described in such as JP-A Nos. 9-34077 and 2001-51371.

The decoloring method by a combination of the the radical generating compound by light irradiation or heating and the bleaching dye, described in such as JP-A Nos. 9-133984, 2000-29168, 2000-284403, and 2000-347341.

The decoloring method by a combination of the said bleaching dye and a compound which can release an alkali or a nucleophile by heating, described in U.S. Pat. Nos. 5,135,842, 5,258,724, 5,314,795, 5,324,627, and 5,384,237, JP-A Nos. 3-26765, 6-222504, 6-222505, and 7-36145.

The decoloring method of dye through an intra-molecular ring closure reaction by thermal self-decomposition of the dye, described in U.S. Pat. No. 4,894,358, JP-A Nos. 2-289856 and 59-182436.

The decoloring method of the dye by the combination of the intra-molecular ring closure bleaching dye having an excellent decoloring property and a base or a base precursor, described in JP-A Nos.6-82948, 11-231457, 2000-112058, 2000-281923, and 2000-169248.

Among them, the combination of the decoloring agent (a radical generator, a base precursor, and a nucleophile generator are also included) and the bleaching dye is preferable, because it is easy to be consistent with the decoloring property at thermal development and the stock storability before thermal development. Particularly, the combination of the intra-molecular ring closure bleaching dye and a base precursor is more preferable, because it can be consistent with the decoloring property and the stability at high level.

The intra-molecular ring closure bleaching dye is preferably a dye having a polymethine chromophore, and more preferably a polymethine dye having a group which can generate a nucleophilic group at the position where a 5 to 7-membered ring can be formed by the reaction at the polymethine part by the reaction of base. The polymethine dye having a group which can become a nucleophilic group by dissociation at the position capable of a 5 to 7-membered ring formation is particularly preferable, such as the dye represented by the following formulae (1) or (2).

Particularly, the dye represented by the following formulae (1) or (2) is preferably used.

Formula (1)

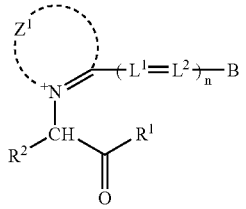

Formula (2)

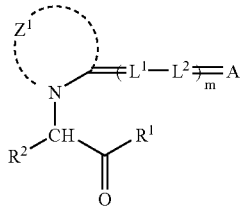

In formulae (1) and (2), $R^1$ represents one selected from a hydrogen atom, an aliphatic group, an aromatic group, $—NR^{21}R^{26}$, $—OR^{21}$, or $—SR^{21}$. $R^{21}$ and $R^{26}$ each independently represent one selected from a hydrogen atom, an aliphatic group, or an aromatic group, or $R^{21}$ and $R^{26}$ may bind each other to form a nitrogen-containing heterocycle. $R^2$ represents one selected from a hydrogen atom, an aliphatic group, or an aromatic group, or $R^1$ and $R^2$ may bind each other to form a 5 or 6-membered ring. $L^1$ and $L^2$ each independently represent a substituted or unsubstituted methine, wherein the substituents of methine may bind each other to form an unsaturated aliphatic ring or an unsaturated heterocycle.

$Z^1$ represents an atomic group necessary to form a 5 or 6-membered nitrogen-containing heterocycle, wherein the nitrogen-containing heterocycle may condense with an aromatic ring, and the nitrogen-containing heterocycle and the condensed ring may have a substituent. A represents an acidic nucleus and B represents one selected from an aromatic group, an unsaturated heterocyclic group, or a group represented by the following formula (3). n and m each represent an integer of 1 to 3. When n and m each represents 2 or more, $L^1$ and $L^2$ of 2 or more may be the same or different.

Formula (3)

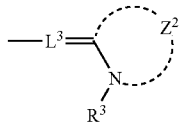

In formula (3), $L^3$ represents a substituted or unsubstituted methine and may bind with $L^2$ to form an unsaturated aliphatic ring or an unsaturated heterocycle. $R^3$ represents an aliphatic group or an aromatic group. $Z^2$ represents an atomic group necessary to form a 5 or 6-membered nitrogen-containing heterocycle, wherein the nitrogen-containing heterocycle may condense with an aromatic ring, and the nitrogen-containing heterocycle and the condensed ring may have a substituent.

In the formulae described above, $R^1$ represents one selected from a hydrogen atom, an aliphatic group, an aromatic group, —$NR^{21}R^{26}$, —$OR^{21}$, or —$SR^{21}$. $R^{21}$ and $R^{26}$ each independently represent one selected from a hydrogen atom, an aliphatic group, or an aromatic group, or $R^{21}$ and $R^{26}$ may bind each other to form a nitrogen-containing heterocycle.

$R^1$ preferably represents —$NR^{21}R^{26}$, —$OR^{21}$, or —$SR^{21}$. $R^{21}$ preferably represents an aliphatic group or an aromatic group, and more preferably an unsubstituted alkyl group, a substituted alkyl group, an unsubstituted aralkyl group, a substituted aralkyl group, an unsubstituted aryl group, or a substituted aryl group. $R^{26}$ preferably represents a hydrogen atom or an aliphatic group, and more preferably a hydrogen atom, an unsubstituted alkyl group, or a substituted alkyl group. The nitrogen-containing heterocycle formed by binding $R^{21}$ with $R^{26}$ is preferably a 5 or 6-membered ring. The nitrogen-containing heterocycle may have a heteroatom other than a nitrogen atom (e.g., an oxygen atom or a sulfur atom).

In the specification of the present invention, "an aliphatic group" means an unsubstituted alkyl group, a substituted alkyl group, an unsubstituted alkenyl group, a substituted alkenyl group, an unsubstituted alkynyl group, a substituted alkynyl group, an unsubstituted aralkyl group, and a substituted aralkyl group. In the present invention, an unsubstituted alkyl group, a substituted alkyl group, an unsubstituted alkenyl group, a substituted alkenyl group, an unsubstituted aralkyl group and a substituted aralkyl group are preferable, and an unsubstituted alkyl group, a substituted alkyl group, an unsubstituted aralkyl group and a substituted aralkyl group are more preferable.

Further, a chain aliphatic group is more preferable than an alicyclic group. A chain aliphatic group may be branched. The unsubstituted alkyl group has preferably 1 to 30 carbon atoms, more preferably 1 to 15 carbon atoms, even more preferably 1 to 10 carbon atoms, and most preferably 1 to 8 carbon atoms. The alkyl part of the substituted alkyl group is similar to that in the preferred range of the unsubstituted alkyl group.

The unsubstituted and substituted alkenyl group each have preferably 2 to 30 carbon atoms, more preferably 2 to 15 carbon atoms, even more preferably 2 to 12 carbon atoms, and most preferably 2 to 8 carbon atoms. The alkenyl part of the substituted alkenyl group and the alkynyl part of the substituted alkynyl group are similar to that in the each preferred range of the unsubstituted alkenyl group and the unsubstituted alkynyl group, respectively. The unsubstituted aralkyl group has preferably 7 to 35 carbon atoms, more preferably 7 to 20 carbon atoms, even more preferably 7 to 15 carbon atoms and, most preferably 7 to 10 carbon atoms. The aralkyl part of the substituted aralkyl group is similar to that in the preferred range of the unsubstituted aralkyl group.

Examples of a substituent of the aliphatic group (the substituted alkyl group, substituted alkenyl group, substituted alkynyl group and substituted aralkyl group) include a halogen atom (a fluorine atom, chlorine atom, or bromine atom), a hydroxy group, an alkoxy group, an aryloxy group, a silyloxy group, a heterocyclic oxy group, an acyloxy group, a carbamoyloxy group, an alkoxycarbonyloxy group, an aryloxycarbonyloxy group, a nitro group, a sulfo group, a carboxyl group, an acyl group, an alkoxycarbonyl group, an aryloxycarbonyl group, a carbamoyl group, an alkylthiocarbonyl group, a heterocyclic group, a cyano group, an amino group (an anilino group is included), an acylamino group, an aminocarbonylamino group, an alkoxycarbonylamino group, an aryloxycarbonylamino group, a sulfamoylamino group, an alkylsulfonylamino group, an arylsulfonylamino group, a mercapto group, an alkylthio group, an arylthio group, a heterocyclic thio group, a sulfamoyl group, an alkylsulfinyl group, an arylsulfinyl group, an alkylsulfonyl group, an arylsulfonyl group, an alkoxycarbonyl group, an imide group, a phosphino group, a phosphinyl group, a phosphinyloxy group, a phosphinylamino group, a phosphono group, and a silyl group. The carboxyl group, sulfo group, and phosphono group may be the corresponding salt states. The cation, which forms a salt with a carboxyl group, a phosphono group or a sulfo group, is preferably an ammonium ion or an alkali metal ion (e.g., a lithium ion, a sodium ion, or a potassium ion).

In the specification of the present invention, "an aromatic group" means an unsubstituted aryl group or a substituted aryl group. The unsubstituted aryl group preferably has 6 to 30 carbon atoms, more preferably 6 to 20 carbon atoms, even more preferably 6 to 15 carbon atoms, and most preferably 6 to 12 carbon atoms. The aryl part of the substituted aryl group is similar to that in the preferred range of the unsubstituted aryl group. As examples of a substituent of the aromatic group (a substituted aryl group), the examples in an aliphatic group and the examples in the substituent of an aliphatic group can be described.

In formulae (1) and (2) described above, $R^2$ represents one selected from a hydrogen atom, an aliphatic group, or an aromatic group, wherein $R^1$ and $R^2$ may bind each other to form a 5 or 6-membered ring. The definitions of an aliphatic group and an aromatic group are the same as those described above. $R^2$ is preferably a hydrogen atom or an aliphatic group, more preferably a hydrogen atom or an alkyl group, even more preferably a hydrogen atom or an alkyl group having 1 to 15 carbon atoms, and most preferably a hydrogen atom.

In formulae (1), (2) and (3) described above, $L^1$, $L^2$, and $L^3$ each independently represent a methine which may be substituted. The substituents of methine may bind each other to form an unsaturated aliphatic ring or an unsaturated heterocycle. Examples of the substituent of methine include a halogen atom, an aliphatic group, and an aromatic group.

The definitions of an aliphatic group and an aromatic group are the same as those described above. The substituents of methine may bind each other to form an unsaturated aliphatic ring or an unsaturated heterocycle.

An unsaturated aliphatic ring is more preferable than an unsaturated heterocycle. The formed ring is preferably a 5 or 6-membered ring, more preferably a cyclopentene ring or a cyclohexene ring. It is particularly preferred that the methine group is unsubstituted or substituted by an alkyl group or an aryl group at the meso position.

In formula (1) described above, n represents an integer from 1 to 3, and preferably 1 or 2. When n is 2 or more, the repeated methine may be the same or different. In formula (2) described above, m represents an integer from 1 to 3 and preferably 1 or 2. When m is 2 or more, the repeated methine may be the same or different.

In formulae (1) and (2) described above, $Z^1$ represents the atomic group necessary to form a 5 or 6-membered nitrogen-containing heterocycle and the nitrogen-containing heterocycle may condense with an aromatic ring, wherein the nitrogen-containing heterocycle and the condensed ring may have a substituent.

As examples of the nitrogen-containing heterocycle, an oxazole ring, a thiazole ring, a selenazole ring, a pyrrole ring, a pyrroline ring, an imidazole ring, and a pyridine ring are included. A 5-membered ring is more preferable than a 6-membered ring. The nitrogen-containing heterocycle may condense with an aromatic ring (a benzene ring or a naphthalene ring). The nitrogen-containing heterocycle and the condensed ring may have a substituent. As examples of the substituent, the substituents of the aromatic group described above can be described, but preferred are a halogen atom (a fluorine atom, a chlorine atom, or a bromine atom), hydroxy, nitro, carboxyl, sulfo, alkoxy, an aryl group, and an alkyl group.

The carboxyl and sulfo may be a salt state. As the cation which forms a salt with carboxyl or sulfo, ammonium or an alkali metal ion (e.g., a sodium ion or a potassium ion) are preferable.

In formula (1), B represents one selected from an aromatic group, an unsaturated heterocyclic group, or formula (3) described above. The definition of an aromatic group is the same as that described above. As the aromatic group represented by B, a substituted or an unsubstituted phenyl group is preferable. As the substituent, a halogen atom, an amino group, an acylamino group, an alkoxy group, an aryloxy group, an alkyl group, an alkylthio group, and an aryl group are preferable, and an amino group, an acylamino group, an alkoxy group, and an alkyl group at the 4 position are particularly preferable. As the unsaturated heterocyclic group represented by B, a 5 or 6-membered heterocyclic group comprising a carbon atom, oxygen atom, nitrogen atom or sulfer atom is preferable. Among them, a 5-membered ring is particularly preferable. As the preferred examples, a substituted or unsubstituted pyrrole, indole, thiophene, and furan can be described.

In formula (3) described above, $Z^2$ represents an atomic group necessary to form a 5 or 6-membered nitrogen-containing heterocycle and may be the same as $Z^1$ or different. The examples of the nitrogen-containing heterocycle described above can be demonstrated similar examples described in the case of $Z^1$. In formula (3) described above, $R^3$ represents an aliphatic group or an aromatic group, and an aliphatic group is preferable, and $—CHR^2(COR^1)$ that is the substituent on a nitrogen atom of formula (1) described above is most preferable.

In formula (2) described above, A represents an acidic nucleus. The acidic nucleus is preferably a group in which one or more (usually two) hydrogen atoms are removed from a cyclic ketomethylene compound or a compound having a methylene group put between two electron-attracting groups. As examples of the cyclic ketomethylene compound, 2-pyrazoline-5-one, rhodanine, hydantoin, thiohydantoin, 2,4-oxazolidinedione, isoxazolone, barbituric acid, thiobarbituric acid, indanedione, dioxopyrazolopyridine, Meldrum's acid, hydroxypyridine, pyrazolidinedione, 2,5-dihydrofuran-2-one, and pyrroline-2-one can be described. These may have a substituent.

The compounds having a methylene group put between the electron-attracting groups described above can be represented as $Z^aCH_2Z^b$. $Z^a$ and $Z^b$ each independently represents one selected from —CN, $—SO_2R^{a1}$, $—COR^{a1}$, $—COOR^{a2}$, $—CONHR^{a2}$, $—SO_2NHR^{a2}$, $—C[=C(CN)_2]R^{a1}$, or $—C[=C(CN)_2]NHR^{a1}$, wherein $R^{a1}$ represents one selected from an alkyl group, an aryl group, or a heterocyclic group, $R^{a2}$ represents one selected from a hydrogen atom, an alkyl group, an aryl group, or a heterocyclic group, and $R^{a1}$ and $R^{a2}$ each may have a substituent. Among these acidic nuclei, 2-pyrazoline-5-one, isoxazolone, barbituric acid, indanedione, hydroxypyridine, pyrazolidinedione, and dioxopyrazolopyridine are more preferable.

The dye represented by formula (1) preferably forms a salt with an anion. In the case, wherein the dye represented by formula (1) described above has an anionic group such as a carboxyl group or a sulfo group as a substituent, the dye can form an intra-moleculer salt. In the other case besides this, the dye preferably forms a salt with an anion outside of a molecule. An anion is preferably monovalent or divalent, and more preferably monovalent. As examples of the anion, a halogen ion ($Cl^-$, $Br^-$, or $I^-$), a p-toluene sulfonate ion, an ethyl sulfonate ion, a 1,5-disulfonaphthalene dianion, $PF_6^-$, $BF_4^-$, and $ClO_4^-$ are included.

The dye represented by formulae (1) or (2) described above may be used under a molecular dispersing state, but preferably under a solid fine particle dispersing state or an aggregating state. In order to form the aggregating state of the dye described above, the dye preferably has an ionic hydrophilic group. The ionic hydrophilic group contains a sulfo group, a carboxyl group, a phosphono group, a quaternary ammonium group and the like. As the ionic hydrophilic group, preferable are a carboxyl group, a phosphono group, and a sulfo group, and particularly preferable are a carboxyl group and a sulfo group.

The carboxyl group, phosphono group, and sulfo group may be a salt state and as examples of the counter ion to form a salt, an ammonium ion, an alkali metal ion (e.g., a lithium ion, a sodium ion, or a potassium ion) and an organic cation (e.g., a tetramethylammonium ion, a tetramethylguanidium ion, or a tetramethylphosphonium ion) are included.

Next, the formulae of an amino butadiene dye and a merocyanine dye as a non-bleaching dye for antihalation are shown below.

Formula (4)

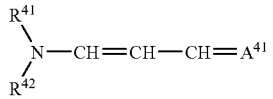

In the formula, $R^{41}$ and $R^{42}$ each independently represent one selected from a hydrogen atom, an aliphatic group, an aromatic group, or a non-metal atomic group necessary to form a 5 or 6-membered ring.

Either one of $R^{41}$ and $R^{42}$ may bind with a methine group adjacent to a nitrogen atom to form a 5 or 6-membered ring. $A^{41}$ represents an acidic nucleus.

Formula (5)

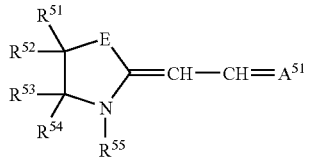

In the formula, $R^{51}$ to $R^{55}$ each independently represent one selected from a hydrogen atom, an aliphatic group, or an aromatic group, and $R^{51}$ and $R^{54}$ may join together to form a double bond. When $R^{51}$ and $R^{54}$ join together to form a double bond, $R^{52}$ and $R^{53}$ may link together to form a benzene ring or a naphthalene ring. $R^{55}$ represents an aliphatic group or an aromatic group, and E represents one selected from an oxygen atom, a sulfur atom, an ethylene group, $>N—R^{56}$, or $>C(R^{57})(R^{58})$. $R^{56}$ represents an aliphatic group or an aromatic group, and $R^{57}$ and $R^{58}$ each independently represent a hydrogen atom or an aliphatic group. $A^{51}$ represents an acidic nucleus.

Formula (6)

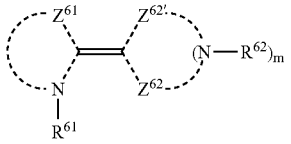

In the formula, $R^{61}$ represents one selected from a hydrogen atom, an aliphatic group, or an aromatic group. $R^{62}$ represents one selected from a hydrogen atom, an aliphatic group, or an aromatic group. $Z^{61}$ represents an atomic group necessary to form a nitrogen-containing heterocycle. $Z^{62}$ and $Z^{62'}$ represent an atomic group necessary to form a heterocycle or a noncyclic terminal acidic group by joining with $(N—R^{62})m$. However, $Z^{61}$, $Z^{62}$, and $Z^{62'}$ each may condense with a ring. m represents 0 or 1.

Following, the dyes represented by formulae (4), (5), or (6) are described in detail.

For an aliphatic group and an aromatic group of $R^{41}$, $R^{42}$, $R^{51}$ to $R^{58}$, $R^{61}$, and $R^{62}$ in formulae (4), (5), or (6), similar aliphatic groups and aromatic groups to those described in $R^{1}$ can be applied. Examples of the subsutituent are also similar to those ones.

For an acidic nucleus represented by $A^{41}$ and $A^{51}$, similar one as those described in A of formula (2) can be applied, and preferably applied a group in which one or more (usually two) hydrogen atoms are removed from a ketomethylene compound or a compound having a methylene group put between two electron-attracting groups. As more preferable examples of methylene compound, $Z^aCH_2Z^b$ (the same definition described in A of formula (2)), 2-pyrazoline-5-one, isoxazolone, barbituric acid, indanedione, Meldrum's acid, hydroxypyridine, pyrazolidinedione, dioxopyrazolopyridine, and the like can be described.

These may have a substituent. As a 5 or 6-membered ring formed by linking $R^{41}$ and $R^{42}$, a pyrrolidine ring, a pyperidine ring, a morphorine ring, and the like can be described as preferred examples.

In formula (6) described above, $Z^{61}$ is an atomic group necessary to form a 5 or 6-membered nitrogen-containing heterocycle, wherein the nitrogen-containing heterocycle may condense with an aromatic ring. The nitrogen-containing heterocycle and the condensed ring may have a substituent. As examples of the nitrogen-containing heterocycle described above, a thiazoline nucleus, a thiazole nucleus, a benzothiazole nucleus, an oxazoline nucleus, an oxazolole nucleus, a benzoxazole nucleus, a selenazoline nucleus, a selenazole nucleus, a benzoselenazole nucleus, a tellurazoline nucleus, a tellurazole nucleus, a benzotellurazole nucleus, a 3,3-dialkylindolenine nucleus (e.g., 3,3-dimethylindolenine), an imidazoline nucleus, an imidazole nucleus, a benzimidazole nucleus, a 2-pyridine nucleus, a 4-pyridine nucleus, a 2-quinoline nucleus, a 4-quinoline nucleus, a 1-isoquinoline nucleus, a 3-isoquinoline nucleus, an imidazo[4,5-b]quinoxaline nucleus, an oxadiazole nucleus, a thiadiazole nucleus, a tetrazole nucleus, a pyrimidine nucleus, and the like can be described. Among them, a thiazoline nucleus, a thiazole nucleus, a benzothiazole nucleus, an oxazoline nucleus, an oxazole nucleus, a benzoxazole nucleus, 3,3-dialkylindolenine nucleus (e.g., 3,3-dimethylindolenine), an imidazoline nucleus, an imidazole nucleus, a benzimidazole nucleus, a 2-pyridine nucleus, a 4-pyridine nucleus, a 2-quinoline nucleus, a 4-quinoline nucleus, a 1-isoquinoline nucleus, and a 3-isoquinoline nucleus are preferable. A thiazoline nucleus, a thiazole nucleus, a benzothiazole nucleus, an oxazoline nucleus, an oxazole nucleus, a benzoxazole nucleus, 3,3-dialkylindolenine nucleus (e.g., 3,3-dimethylindolenine), an imidazoline nucleus, an imidazole nucleus, and a benzimidazole nucleus are more preferable. A thiazoline nucleus, a thiazole nucleus, a benzothiazole nucleus, an oxazoline nucleus, an oxazole nucleus, and a benzoxazole nucleus are particularly preferable. And a thiazoline nucleus, an oxazoline nucleus, and a benzoxazole nucleus are most preferable.

The nitrogen-containing heterocycle may condense with an aromatic ring (a benzene ring or a naphthalene ring). The nitrogen-containing heterocycle and the condensed ring may have a substituent. As examples of the substituent, a substituent of the aromatic group described above can be described, and preferably described are a halogen atom (a fluorine atom, a chlorine atom, or a bromine atom), a hydroxy group, a nitro group, a carboxyl group, a sulfo group, an alkoxy group, an aryl group, and an alkyl group.

The carboxyl group and sulfo group may be a salt state. As the cation which forms a salt with the carboxyl group and sulfo group, ammonium and an alkali metal ion (e.g., a sodium ion or a potassium ion) are preferable.

$Z^{62}$, $Z^{62'}$, and $(N—R^{62})m$ represent an atomic group necessary to form a heterocycle and a noncyclic acidic terminal group by joining each other. As the heterocycle (preferably a 5 or 6-membered heterocycle), any heterocycle can be applied, and preferably, an acidic nucleus is applied.

Next, an acidic nucleus and a noncyclic acidic terminal group are explained. As an acidic nucleus and a noncyclic acidic terminal group, any acidic nucleus in merocyanine dye and any noncyclic acidic terminal group can be applied. In the preferable form, $Z^{62}$ is a thiocarbonyl group, a carbonyl group, an ester group, an acyl group, a carbamoyl group, a cyano group, or a sulfonyl group, and $Z^{62}$ is more preferably a thiocarbonyl group or a carbonyl group. $Z^{62'}$ represents a residual atomic group necessary to form an acidic nucleus and a noncyclic acidic terminal group.

In the case where a noncyclic acidic terminal group is formed, a thiocarbonyl group, a carbonyl group, an ester group, an acyl group, a carbamoyl group, a cyano group, a sulfonyl group, and the like are preferable.

m represents 0 or 1 and preferably 1.

The acidic nucleus and the noncyclic acidic terminal group herein are described in, for example, T. H. James, "THE THEORY OF THE PHOTOGRAPHIC PROCESS, FOURTH EDITION" (Macmillan Publishing Co., Inc., pages 197 to 200, 1977). Herein, the noncyclic acidic terminal group means a group which does not form a ring among an acidic terminal group that is to say an electron accepting terminal group.

Typical examples of an acidic nucleus and a noncyclic acidic terminal group are described in U.S. Pat. Nos. 3,567,719, 3,575,869, 3,804,634, 3,837,862, 4,002,480, and 4,925,777, JP-A No. 3-167546, U.S. Pat. Nos. 5,994,051 and 5,747,236, and the like.

The acidic nucleus preferably is a heterocycle (preferably, a 5 or 6-membered nitrogen-containing heterocycle) comprising a carbon atom, a nitrogen atom and/or chalcogen atom (typically, an oxygen atom, a sulfur atom, a selenium atom, and a tellurium atom), and more preferably a 5 or 6-membered nitrogen-containing heterocycle comprising a carbon atom, a nitrogen atom and/or chalcogen atom (typically, an oxygen atom, a sulfur atom, a selenium atom and a tellurium atom). As typical examples, the nucleus of 2-pyrazoline-5-one, pyrazolidine-3,5-dione, imidazoline-5-one, hydantoin, 2-thiohydantoin, 4-thiohydantoin, 2-iminoxazolidine-4-one, 2-oxazoline-5-one, 2-thioxazolidine-2,5-dione, 2-thioxazoline-2,4-dione, isoxazolidine-5-one, 2-thiazoline-4-one, thiazolidine-4-one, thiazolidine-2,4,-dione, rhodanine, thiazolidine-2,4-dithione, isorhodanine, indane-1,3-dione, thiophene-3-one, thiophene-3-one-1,1-dioxide, indoline-2-one, indoline-3-one, 2-oxoindazolinium, 3-oxoindazolinium, 5,7-dioxo-6,7-dihydrothiazolo[3,2-a]pyrimidine, cyclohexane-1,3-dione, 3,4-dihydroisoquinoline-4-one, 1,3-dioxane-4,6-dione, barbituric acid, 2-thiobarbituric acid, chromane-2,4-dione, indazoline-2-one, pyrido[1,2-a]pyrimidine-1,3-dione, pyrazolo[1,5-b]quinazolone, pyrazolo[1,5-a]benzimidazole, pyrazolopyridone, 1,2,3,4-tetrahydroquinoline-2,4-dione, 3-oxo-2,3-dihydrobenzo[d]thiophene-1,1-dioxide, and 3-dicyanomethine-2,3-dihydrobenzo[d]thiophene-1,1-dioxide, a nucleus having an exo-methylene structure formed by substitution of the carbonyl group or thiocarbonyl group in the nuclei above described at an active methylene position of acidic nucleus, a nucleus having an exo-methylene structure formed by substitution at an active methylene position of active methylene compound having a ketomethylene or a cyanomethylene structure which can be a starting material of noncyclic acidic terminal group, and a nucleus having a repeating structure of these nuclei can be described.

An acidic nucleus and a noncyclic acidic terminal group described above may be substituted by a substituent described above as an example of the substituent of an aromatic group or may be condensed with a ring.

As $Z^{62}$, $Z^{62'}$, and $(N—R^{62})m$, preferable are hydantoin, 2-thiohydantoin, 4-thiohydantoin, 2-oxazoline-5-one, 2-thioxazoline-2,4-dione, thiazolidine-2,4,-dione, rhodanine, thiazolidine-2,4-dithione, barbituric acid, and 2-thiobarbituric acid. More preferable are hydantoin, 2-thiohydantoin, 4-thiohydantoin, 2-oxazoline-5-one, rhodanine, barbituric acid, and 2-thiobarbituric acid. Among them, 2-thiohydantoin, 4-thiohydantoin, 2-oxazoline-5-one, and rhodanine are especially preferable.

In the case where the dye represented by formulae (4) to (6) described above is water-soluble, it is preferred that the dye has an ionic hydrophilic group. Examples and the preferred examples of the ionic hydrophilic group are similar to those described in formulae (1) and (2).

As typical examples of antihalation dye for preferred use, those described in JP-A No. 2003-215751 as well as the examples shown below can be described, but the antihalation dyes are not limited to the following typical examples.

1

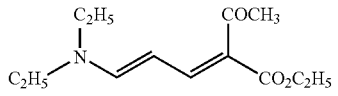

2

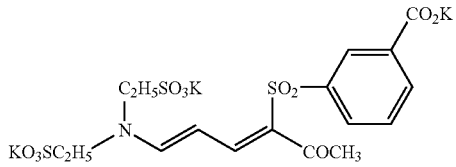

3

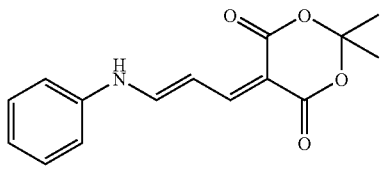

-continued

4

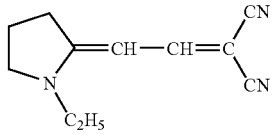

5

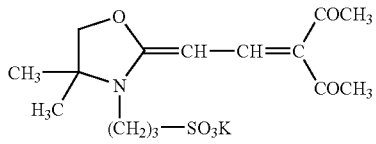

6

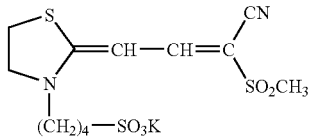

7

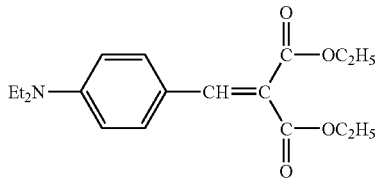

8

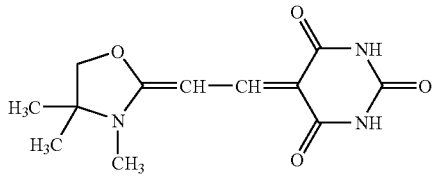

9

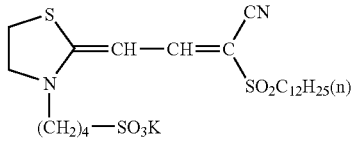

10

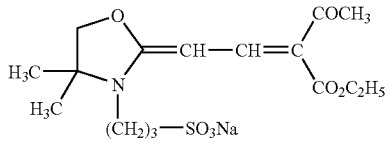

11

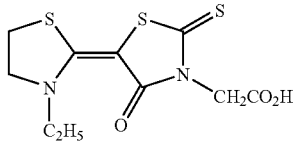

12

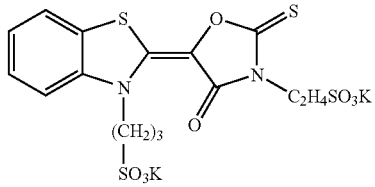

-continued
13
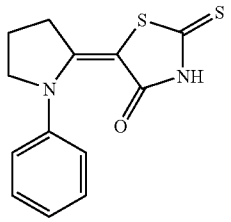
14
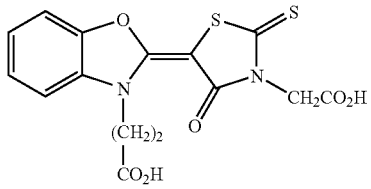
15
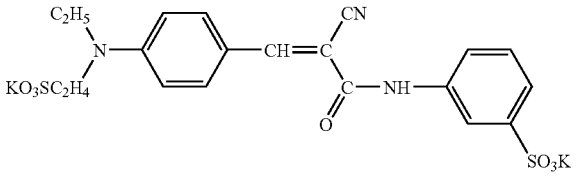
16
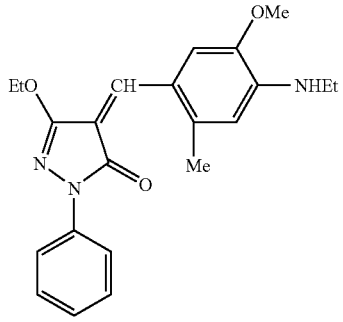
17
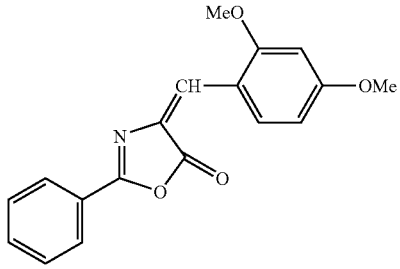
18
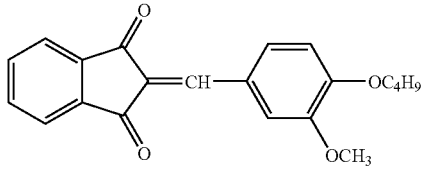
19
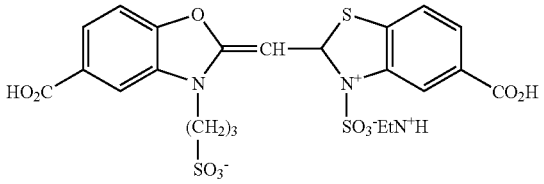
-continued
20
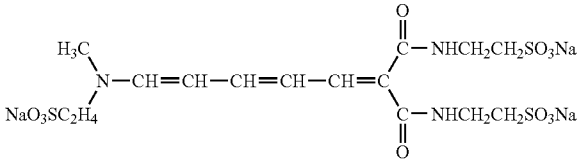
21
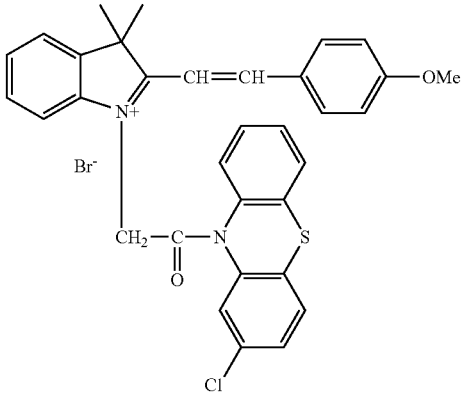
22
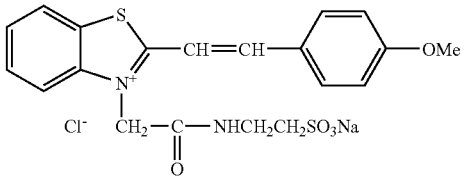
23
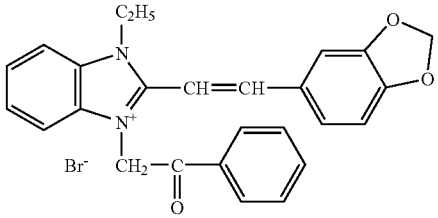
24
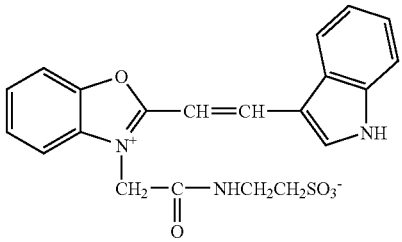
25
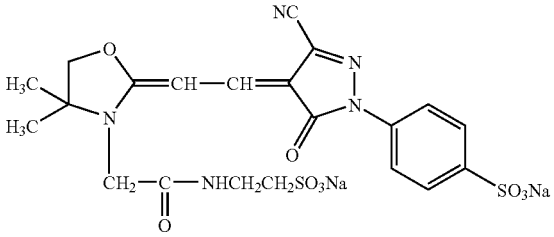

-continued

26

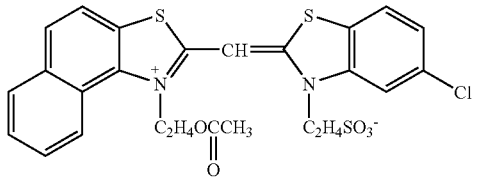

Concerning the synthesis of antihalation dye, general synthetic methods are described in Frances Harmer, "The Cyanine Dyes and Related Compounds", Interscience Publishers, 1964. Specifically, the synthesis can be performed by the methods based on the methods described in JP-A Nos. 11-231457, 2000-112058, 2000-86927, and 2000-86928.

In the case of decoloring the antihalation dye at a thermal developing process, decoloring can be made by an action of a decoloring agent under the heating condition. Particularly, the dyes represented by formulae (1) or (2) described above are decolored by an action of a base, wherein the base causes a deprotonation from an active methylene group and the resulting nucleophile attacks to the methylene chain in a molecule and then the intra-molecular ring closure is occurred and finally the dye is decolored.

Therefore, as the base usable for this reaction, any base can be used as far as it can cause the deprotonation of active methylene group in the dye.

Though the number of member of the ring newly formed by an intra-molecular ring closure reaction is not especially limited, a 5 to 7-membered ring are preferable, and a 5-membered ring or a 7-membered ring are more preferable.

The actually colorless compound formed in this way is stable compound and does not return to the original dye. And there is no coloring problem caused by returning of the decolored dye back to the original dye.

A heating temperature in the decoloring reaction of above described dye is preferably from 40° C. to 200° C., more preferably from 80° C. to 150° C., even more preferably from 100° C. to 130° C., and most preferably 115° C. to 125° C. Time period for heating is preferably from 5 seconds to 120 seconds, more preferably from 10 seconds to 60 seconds, even more preferably from 12 seconds to 30 seconds, and most preferably from 14 seconds to 25 seconds. In the photothermographic material, the heating for thermal development can be used for decoloring the dye.

A heat response type base precursor, which generates a base by heating (described after in detail), is preferably used. In this case, the actual temperature and time period for heating are determined under the consideration of the temperature or the time necessary for thermal development and the temperature and the time necessary for thermal decomposition.

The decoloring agent necessary for decoloring reaction is preferably a radical, a nucleophile, a base, or a precursor thereof. In the case where the dye represented by formulae (1) or (2) described above is used, it is preferred to decolor the dye by using a base or a base precursor. A base necessary for decoloring reaction means a base in a wide sense and contains a nucleophile (Lewis base) in addition to a base in a narrow sense. When a base and a dye coexist, there is a fear of the decoloring reaction progressing a little, even under the room temperature.

Therefore, a base is preferably isolated from a dye physically or chemically, and the isolation is released at the time to be decolorized, for example by heating, resulting in contact (reaction) of the dye and the base. There are three physical isolating methods of both compounds: namely to make at least one of the base and the dye described above enclose in a microcapsule; to make at least one of the base and the dye described above enclose in a fine particle of a thermal melting compound; or to make the dye described above and the base described above contain in a different layer from each other. One type of the microcapule described above is exploded by pressure and another is exploded by heating. It is convenient to use the thermal explosion type (heat response type) of microcapsule, as the decoloring reaction described above progresses easily under the heating condition.

At least one of a base and a dye is enclosed in a microcapsule to isolate each other. It is also preferred to enclose both of them in different capsules from each other. In the case wherein an outer shell of a microcapsule is opaque, it is preferred that a dye is contained in the outside of microcapsule and a base is contained in the microcapsule. As the heat response microcapsule, it is described in Hiroyuki Moriga, NYUMON TOKUSYUSI NO KAGAKU, 1975, and JP-A No. 1-150575.

As the thermal melting compound described above to isolate a dye and a base described above, a wax and the like can be used. The isolation can be done by the addition of at least one of a dye and a base (preferably a base) in a fine particle of the thermal melting compound. A melting point of the thermal melting compound described above is preferably between a room temperature and a heating temperature at which a decoloring reaction occurs.

In the case, wherein a dye and a base are isolated by incorporating to different layers from each other, it is preferred that a barrier layer containing a thermal melting compound is arranged between those layers.

A chemical isolation of a dye and a base is practically convenient and preferred. As the chemical isolating method of both, it is preferred to use a base precursor capable to generate (releasing of base is also contained) a base by heating. As the base precursor described above, a thermal decomposition type base precursor is typically and a thermal decomposition type base precursor composed of a carboxylic acid and a base (decarbonation type) is particularly typically. When the decarbonation type base precursor is heated, the carboxyl group of carboxylic acid is decarbonated and an organic base is released.

As the carboxylic acid composing of the thermal decomposition type base precursor, sulfonylacetic acid or propiolic acid, which can decarbonate easily, can be used. The sulfonylacetic acid and propiolic acid preferably have a substituent group having an aromaticity to promote decarbonation (an aryl group or an unsaturated heterocyclic group). A base precursor with a sulfonyldiacetic acid is described in JP-A No. 59-168441 and a base precursor with a propiolic acid salt is described in JP-A No. 59-180537. As a base side component of a decarbonation type base precursor, an organic base is preferable, and amidine, a derivative thereof, guanidine, and a derivative thereof are more preferable.

The organic base is preferably a diacidic base, a triacidic base, or a tetraacidic base, more preferably a diacidic base, and most preferably a diacidic base of an amidine derivative or a diacidic base of a guanidine derivative.

The precursors of a diacidic base, a triacidic base, and a tetreaacidic base of an amidine derivative are described in JP-B No. 7-59545. The precursors of a diacidic base, a triacidic base, and a tetreaacidic base of guanidine derivative is described in JP-B No. 8-10321. The diacidic base of a amidine derivative or a guanine derivative comprises (A)

two amidine parts or guanine parts, (B) the substituent of amidine part or guanine part, and (C) divalent linking group to bind two amidine parts or guanine parts. As examples of the substituent of (B), an alkyl group (a cycloalkyl group is contained), an alkenyl group, an alkynyl group, an aralkyl group, and a heterocyclic residual group are included. Two or more substituents may bind together to form a nitrogen-containing heterocycle.

The linking group of (C) is preferably an alkylene group or a phenylene group. As examples of the diacidic base precursor of an amidine derivative or guanidine derivative, the base precursor described in compound 55 to compound 95 in JP-A No. 11-231457 can be preferably used in the present invention.

When the dye described above is decolored, the optical density after thermal development can be decreased to 0.1 or less. Two or more kinds of bleaching dyes may be used together in a photothermographic material. Similarly, two or more kinds of base precursors may be used in combination.

In a thermal bleaching process, wherein a base and a dye described above are used, it is preferable to use a compound which can decrease a melting point at 3° C. or more by mixing with a base precursor described in JP-A No. 11-352626 (for example, diphenylsulfone, 4-chlorophenyl (phenyl)sulfone, 2-naphthylbenzoate, or the like) in combination.

A layer containing an antihalation dye preferably contains a binder in combination with the dye. As a binder, a hydrophilic polymer (e.g., a poly(vinyl alcohol), or a gelatin) is preferable. In general, the addition amount of an antihalation dye in a photothermographic material is preferably in a range wherein an optical density (absorbance) exceeds 0.1, and more preferably 0.2 to 2.0.

The amount of dye needed for obtaining those optical densities can be reduced by using an aggregation dye and generally is from 0.001 g/m$^2$ to 0.2 g/m$^2$, preferably from 0.001 g/m$^2$ to 0.1 g/m$^2$ and, more preferably from 0.001 g/m$^2$ to 0.05 g/m$^2$. By decoloring the antihalation dye in such a manner, the optical density can be lowered to 0.1 or lower.

Two or more kinds of dyes may be used in combination. Similarly, two or more kinds of base precursors may be used in combination. The addition amount of a base precursor (mol) is preferably 1 to 100 times toward the amount of dye (mol), and more preferably 3 to 30 times. A base precursor is preferably dispersed and contained in either layer of a photothermographic material in a solid fine particle dispersing state.

As a method of adding an antihalation dye to a non-photosensitive layer, an addition of a solid fine particle dispersion or an aggregation dispersion of dye to the coating solution for the non-photosensitive layer can be adopted. The adding method is similar to the adding method of dye generally used in the photothermographic material.

3) Back Layer

Back layers usable in the invention are described in paragraph Nos. 0128 to 0130 of JP-A No. 11-65021.

In the invention, coloring matters having maximum absorption in a wavelength range from 300 nm to 450 nm can be added in order to improve color tone of developed silver images and a deterioration of the images during aging. Such coloring matters are described in JP-A Nos. 62-210458, 63-104046, 63-103235, 63-208846, 63-306436, 63-314535, 01-61745, 2001-100363, and the like. Such coloring matters are generally added in a range of from 0.1 mg/m$^2$ to 1 g/m$^2$, preferably to the back layer which is provided to the side opposite to the image forming layer.

4) Matting Agent

In the invention, a matting agent is preferably added to the surface protective layer and the back layer in order to improve transportability. Description of the matting agent can be found in paragraphs Nos. 0126 to 0127 of JP-A No.11-65021.

The addition amount of the matting agent is preferably in a range of from 1 mg/m$^2$ to 400 mg/m$^2$, and more preferably, from 5 mg/m$^2$ to 300 mg/m$^2$, with respect to the coating amount per 1 m$^2$ of the photothermographic material.

The level of matting on the image forming layer surface is not restricted as far as star-dust trouble occurs, but the level of matting of 30 seconds to 2000 seconds is preferred, particularly preferred, 40 seconds to 1500 seconds as Beck's smoothness. Beck's smoothness can be calculated easily, by using Japan Industrial Standared (JIS) P8119 "The method of testing Beck's smoothness for papers and sheets using Beck's test apparatus", or TAPPI standard method T479.

The level of matting of the back layer in the invention is preferably in a range of 1200 seconds or less and 10 seconds or more; more preferably, 800 seconds or less and 20 seconds or more; and even more preferably, 500 seconds or less and 40 seconds or more, when expressed by Beck smoothness.

In the present invention, a matting agent is preferably contained in an outermost layer, in a layer which can function as an outermost layer, or in a layer nearer to outer surface of the photothermographic material, and is also preferably contained in a layer which can function as a so-called protective layer.

5) Polymer Latex

A polymer latex can be incorporated in the surface protective layer or the back layer of the photothermographic material according to the present invention.

Concerning such polymer latex, descriptions can be found in "Gosei Jushi Emulsion (Synthetic resin emulsion)" (Taira Okuda and Hiroshi Inagaki, Eds., published by Kobunshi Kankokai (1978)), "Gosei Latex no Oyo (Application of synthetic latex)" (Takaaki Sugimura, Yasuo Kataoka, Soichi Suzuki, and Keiji Kasahara, Eds., published by Kobunshi Kankokai (1993)), and "Gosei Latex no Kagaku (Chemistry of synthetic latex)" (Soichi Muroi, published by Kobunshi Kankokai (1970)). More specifically, there can be mentioned a latex of methyl methacrylate (33.5% by weight)/ethyl acrylate (50% by weight)/methacrylic acid (16.5% by weight) copolymer, a latex of methyl methacrylate (47.5% by weight)/butadiene (47.5% by weight)/itaconic acid (5% by weight) copolymer, a latex of ethyl acrylate/methacrylic acid copolymer, a latex of methyl methacrylate (58.9% by weight)/2-ethylhexyl acrylate (25.4% by weight)/styrene (8.6% by weight)/2-hydroethyl methacrylate (5.1% by weight)/acrylic acid (2.0% by weight) copolymer, a latex of methyl methacrylate (64.0% by weight)/styrene (9.0% by weight)/butyl acrylate (20.0% by weight)/2-hydroxyethyl methacrylate (5.0% by weight)/acrylic acid (2.0% by weight) copolymer, and the like.

The polymer latex in the surface protective layer or the back layer is preferably contained in an amount of from 10% by weight to 90% by weight, particularly preferably, from 20% by weight to 80% by weight of the total weight of binder.

6) Surface pH

The surface pH of the photothermographic material according to the invention preferably yields a pH of 7.0 or lower, and more preferably, 6.6 or lower, before thermal developing process. Although there is no particular restriction concerning the lower limit, the lower limit of pH value is about 3. Most preferred surface pH range is from 4 to 6.2.

From the viewpoint of reducing the surface pH, it is preferred to use an organic acid such as phthalic acid derivative or a non-volatile acid such as sulfuric acid, or a volatile base such as ammonia for the adjustment of the surface pH. In particular, ammonia can be used favorably for the achievement of low surface pH, because it can easily vaporize to remove it before the coating step or before applying thermal development.

It is also preferred to use a non-volatile base such as sodium hydroxide, potassium hydroxide, lithium hydroxide, and the like, in combination with ammonia. The method of measuring surface pH value is described in paragraph No. 0123 of the specification of JP-A No. 2000-284399.

7) Hardener

A hardener may be used in each of the image forming layer, protective layer, back layer, and the like.

As examples of the hardener, descriptions of various methods can be found in pages 77 to 87 of T. H. James, "THE THEORY OF THE PHOTOGRAPHIC PROCESS, FOURTH EDITION" (Macmillan Publishing Co., Inc., 1977). Preferably used are, in addition to chromium alum, sodium salt of 2,4-dichloro-6-hydroxy-s-triazine, N,N-ethylene bis(vinylsulfonacetamide), and N,N-propylene bis(vinylsulfonacetamide), polyvalent metal ions described in page 78 of the above literature and the like, polyisocyanates described in U.S. Pat. No. 4,281,060, JP-A No. 6-208193 and the like, epoxy compounds of U.S. Pat. No. 4,791,042 and the like, and vinyl sulfone compounds of JP-A No. 62-89048.

The hardener is added as a solution, and the solution is added to the coating solution for protective layer 180 minutes before coating to just before coating, preferably 60 minutes before to 10 seconds before coating. However, so long as the effect of the invention is sufficiently exhibited, there is no particular restriction concerning the mixing method and the conditions of mixing.

As specific mixing methods, there can be mentioned a method of mixing in the tank, in which the average stay time calculated from the flow rate of addition and the feed rate to the coater is controlled to yield a desired time, or a method using static mixer as described in Chapter 8 of N. Harnby, M. F. Edwards, A. W. Nienow (translated by Koji Takahashi) "EKITAI KONGO GIJUTSU (Liquid Mixing Technology)" (Nikkan Kogyo Shinbunsha, 1989), and the like.

8) Surfactant

Concerning the surfactant applicable in the invention, description can be found in paragraph No. 0132 of JP-A No. 11-65021.

In the invention, preferably used are fluorocarbon surfactants. Specific examples of fluorocarbon surfactants can be found in those described in JP-A Nos. 10-197985, 2000-19680, and 2000-214554. Polymer fluorocarbon surfactants described in JP-A 9-281636 can be also used preferably.

For the photothermographic material of the invention, fluorocarbon surfactants described in JP-A No. 2000-206560 are particularly preferably used.

9) Antistatic Agent

The photothermographic material of the invention may contain an electrically conductive layer including metal oxides or electrically conductive polymers. The antistatic layer may serve as an undercoat layer, a back surface protective layer, or the like, but can also be placed specially. Specific examples of the antistatic layer in the invention include described in paragraph Nos. 0135 of JP-A No. 11-65021, in JP-A Nos. 56-143430, 56-143431, 58-62646, and 56-120519, and in paragraph Nos. 0040 to 0051 of JP-A No. 11-84573, in U.S. Pat. No. 5,575,957, and in paragraph Nos. 0078 to 0084 of JP-A No. 11-223898.

10) Support

As the transparent support, preferably used is polyester, particularly, polyethylene terephthalate, which is subjected to heat treatment in the temperature range of from 130° C. to 185° C. in order to relax the internal strain caused by biaxial stretching and remaining inside the film, and to remove strain ascribed to heat shrinkage generated during thermal development.

As the support of the photothermographic material used in combination with the ultraviolet light emission screen, PEN is preferably used, but the present invention is not limited thereto. As PEN, polyethylene-2,6-naphthalate is preferred. The term "polyethylene-2,6-naphthalate" as used herein means that the structure repeating units essentially may consist of ethylene-2,6-naphthalene dicarboxylate units and also may include un-copolymerized polyethylene-2,6-naphthalene dicarboxylate, and the copolymer comprising 10% or less, and preferably 5% or less, of the structure repeating units modified with the other components and mixtures or constituents of other polymers.

Polyethylene-2,6-naphthalate can be synthesized by reacting a naphthalene-2,6-dicarboxylic acid or functional derivatives thereof, and an ethylene glycol or functional derivatives thereof in the presence of a suitable catalyst at a proper reaction condition. The polyethylene-2,6-naphthalate of the present invention may be copolymerized or blended polysters, where one or more kinds of suitable third component (denaturing agent) is added before the completion of polymerization of the polyethylene-2,6-aphthalate.

As the suitable third component, compounds containing a divalent ester forming functional group, for example, dicarboxylic acids such as oxalic acid, adipic acid, phthalic acid, isophthalic acid, terephthalic acid, naphthalene-2,7-dicarboxylic acid, succinic acid, diphenylether dicarboxylic acid, and the like, or lower alkylesters thereof, oxycarboxylic acids such as p-oxybenzoic acid, p-oxyethoxybenzoic acid, or lower alkylesters thereof, and divalent alcohols such as propylene glycol, trimethylene glycol, and the like are described. Polyethylene-2,6-naphthalate and the modified polymers thereof may include, for example, the polymer where the terminal hydroxy group and/or the carboxyl group is blocked by mono-functional compounds such as benzoic acid, benzoyl benzoic acid, benzyloxy benzoic acid, methoxy polyalkylene glycol, or the like, or the polymer modified with a very small amount of compounds having tri-functional or tetra-functional ester forming group such as glycerine and penta-erthritol in the extent to form linear chain copolymers substantially.

In the case of a photothermographic material for medical use, the transparent support may be colored with a blue dye (for instance, dye-1 described in the Example of JP-A No. 8-240877), or may be uncolored.

Specific examples of the support can be found in paragraph No. 0134 of JP-A No. 11-65021.

As to the support, it is preferred to apply undercoating technology, such as water-soluble polyester described in JP-A No. 11-84574, a styrene-butadiene copolymer described in JP-A No. 10-186565, a vinylidene chloride copolymer described in JP-A No. 2000-39684, and the like.

11) Other Additives

Furthermore, antioxidant, stabilizing agent, plasticizer, UV absorbent, or a film-forming promoting agent may be added to the photothermographic material. Each of the additives is added to either of the image forming layer or the non-photosensitive layer. Reference can be made to WO No. 98/36322, EP No. 803764A1, JP-A Nos. 10-186567 and 10-18568, and the like.

12) Coating Method

The photothermographic material of the invention may be coated by any method. More specifically, various types of coating operations inclusive of extrusion coating, slide coating, curtain coating, immersion coating, knife coating, flow coating, or an extrusion coating using the kind of hopper described in U.S. Pat. No. 2,681,294 are used. Preferably used is extrusion coating or slide coating described in pages 399 to 536 of Stephen F. Kistler and Petert M. Schweizer, "LIQUID FILM COATING" (Chapman & Hall, 1997), and particularly preferably used is slide coating.

Example of the shape of the slide coater for use in slide coating is shown in FIG. 11b.1, page 427, of the same literature. If desired, two or more layers can be coated simultaneously by the method described in pages 399 to 536 of the same literature, or by the method described in U.S. Pat. No. 2,761,791 and British Patent No. 837095.

The coating solution for the image forming layer in the invention is preferably a so-called thixotropic fluid. Concerning this technology, reference can be made to JP-A No. 11-52509.

Viscosity of the coating solution for the image forming layer of the invention at a shear velocity of 0.1 $S^{-1}$ is preferably from 400 mPa·s to 100,000 mPa·s, and more preferably, from 500 mPa·s to 20,000 mPa·s.

At a shear velocity of 1000 $S^{-1}$, the viscosity is preferably from 1 mPa·s to 200 mPa's, and more preferably, from 5 mPa·s to 80 mPa·s.

13) Wrapping Material

In order to suppress fluctuation from occurring on the photographic property during a preservation of the photothermographic material of the invention before use, or in order to improve curling or winding tendencies when the photothermographic material is manufactured in a roll state, it is preferred that a wrapping material having low oxygen transmittance and/or vapor transmittance is used.

Preferably, oxygen transmittance is 50 $mL \cdot atm^{-1} m^{-2} day^{-1}$ or lower at 25° C., more preferably, 10 $mL \cdot atm^{-1} m^{-2} day^{-1}$ or lower, and further preferably, 1.0 $mL \cdot atm^{-1} m^{-2} day^{-1}$ or lower. Preferably, vapor transmittance is 10 $g \cdot atm^{-1} m^{-2} day^{-1}$ or lower, more preferably, 5 $g \cdot atm^{-1} m^{-2} day^{-1}$ or lower, and further preferably, 1 $g \cdot atm^{-1} m^{-2} day^{-1}$ or lower. As specific examples of a wrapping material having low oxygen transmittance and/or vapor transmittance, reference can be made to, for instance, the wrapping material described in JP-A Nos.8-254793 and 2000-206653.

14) Other Applicable Techniques

Techniques which can be used for the photothermographic material of the invention also include those in EP No. 803764A1, EP No. 883022A1, WO No. 98/36322, JP-A Nos. 56-62648, and 58-62644, JP-A Nos. 09-43766, 09-281637, 09-297367, 09-304869, 09-311405, 09-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, and 11-343420, JP-A Nos. 2000-187298, 2001-200414, 2001-234635, 2002-20699, 2001-275471, 2001-275461, 2000-313204, 2001-292844, 2000-324888, 2001-293864, and 2001-348546.

The constitution of a multicolor photothermographic material may include combinations of two layers for those for each of the colors, or may contain all the components in a single layer as described in U.S. Pat. No. 4,708,928.

In the case of multicolor photothermographic material, each of the image forming layers is maintained distinguished from each other by incorporating functional or non-functional barrier layer between each of the image forming layers as described in U.S. Pat. No. 4,460,681.

2. Image Forming Method

The photothermographic material of the present invention may be either "single-sided type" having an image forming layer on one side of the support, or "double-sided type" having image forming layers on both sides of the support.

(Double-sided Type Photothermographic Material)

The photothermographic material of the present invention is preferably applied for an image forming method to record X-ray images using a fluorescent intensifying screen.

The image forming method using the photothermographic materials described above comprises:

(a) providing an assembly for forming an image by placing the photothermographic material between a pair of the X-ray intensifying screens, (b) putting an analyte between the assembly and the X-ray source, (c) applying X-rays having an energy level in a range of 25 kVp to 125 kVp to the analyte;

(d) taking the photothermographic material out of the assembly; and (e) heating the removed photothermographic material in a temperature range of 90° C. to 180° C.

The photothermographic material used for the assembly in the present invention is subjected to X-ray exposure through a step wedge tablet and thermal development. On the photographic characteristic curve having an optical density (D) and an exposure value (log E) along the rectangular coordinates having the equal axis-of-coordinate unit, it is preferred to adjust so that the thermal developed image may have the photographic characteristic curve where the average gamma (γ) made at the points of a density of fog+0.1 and a density of fog+0.5 is from 0.5 to 0.9, and the average gamma (γ) made at the points of a density of fog+1.2 and a density of fog+1.6 is from 3.2 to 4.0.

For the X-ray radiography employed in the practice of the present invention, the use of photothermographic material having the aforesaid photographic characteristic curve would give the radiation images with excellent photographic properties that exhibit an extended bottom portion and high gamma value at a middle density area. According to this photographic property, the photographic properties mentioned have the advantage of that the depiction in a low density portion on the mediastinal region and the heart shadow region having little X-ray transmittance becomes excellent, and that the density becomes easy to view, and that gradation in the images on the lung field region having much X-ray transmittance becomes excellent.

The photothermographic material having a preferred photographic characteristic curve mentioned above can be easily prepared, for example, by the method where each of the image forming layer of both sides may be constituted of two or more image forming layers containing silver halide and having a sensitivity different from each other.

Especially, the aforesaid image forming layer preferably comprises an emulsion of high sensitivity for the upper layer and an emulsion with photographic properties of low sensitivity and high gradation for the lower layer.

In the case of preparing the image forming layer comprising two layers, the sensitivity difference between the silver halide emulsion in each layer is preferably from 1.5 times to 20 times, and more preferably from 2 times to 15 times.

The ratio of the amounts of emulsion used for forming each layer may depend on the sensitivity difference between emulsions used and the covering power. Generally, as the sensitivity difference is large, the ratio of the using amount of high sensitivity emulsion is reduced. For example, if the sensitivity difference is two times, and the covering power is equal, the ratio of the amount of high sensitivity emulsion to low sensitivity emulsion would be preferably adjusted to be in a range of from 1:20 to 1:50 based on silver amount.

As the techniques for crossover cut (in the case of double-sided photosensitive material) and anti-halation (in the case of single-sided photosensitive material), dyes or combined use of dye and mordant described in JP-A. No. 2-68539, (from page 13, left lower column, line 1 to page 14, left lower column, line 9) can be employed.

Next, the fluorescent intensifying screen of the present invention is explained below. The fluorescent intensifying screen essentially comprises a support and a fluorescent substance layer coated on one side of the support as the fundamental structure. The fluorescent substance layer is a layer where the fluorescent substance is dispersed in binders. On the surface of a fluorescent substance layer opposite to the support side (the surface of the side that does not face on the support), a transparent protective layer is generally disposed to protect the fluorescent substance layer from chemical degradation and physical shock.

Preferred fluorescent substances according to the present invention are described below. Tungstate fluorescent substances ($CaWO_4$, $MgWO_4$, $CaWO_4$:Pb, and the like), terbium activated rare earth sulfoxide fluorescent substances ($Y_2O_2S$:Tb, $Gd_2O_2S$:Tb, $La_2O_2S$:Tb, $(Y,Gd)_2O_2S$:Tb, $(Y,Gd)O_2S$:Tb, Tm, and the like), terbium activated rare earth phosphate fluorescent substances ($YPO_4$:Tb, $GdPO_4$:Tb, $LaPO_4$:Tb, and the like), terbium activated rare earth oxyhalogen fluorescent substances (LaOBr:Tb, LaOBr:Tb, Tm, LaOCl:Tb, LaOCl:Tb, Tm, LaOBr:Tb, GdOBr:Tb, GdOCl:Tb, and the like), thulium activated rare earth oxyhalogen fluorescent substances (LaOBr:Tm, LaOCl:Tm, and the like), barium sulfate fluorescent substances ($BaSO_4$:Pb, $BaSO_4$:$Eu^{2+}$, $(Ba,Sr)SO_4$:$Eu^{2+}$, and the like), divalent europium activated alkali earth metal phosphate fluorescent substances ($(Ba_2PO_4)_2$:$Eu^+$, $(Ba_2PO_4)_2$:$Eu^{2+}$, and the like), divalent europium activated alkali earth metal fluorinated halogenide fluorescent substances (BaFCl:$Eu^{2+}$, BaFBr:$Eu^{2+}$, BaFCl:$Eu^{2+}$, Tb, BaFBr:$Eu^{2+}$, Tb, $BaF_2$.BaCl.KCl:$Eu^{2+}$, $(Ba,Mg)F_2$.BaCl.KCl:$Eu^{2+}$, and the like), iodide fluorescent substances (CsI:Na, CsI:Tl, NaI, KI:Tl, and the like), sulfide fluorescent substances (ZnS:Ag(Zn,Cd)S:Ag, (Zn, Cd)S:Cu, (Zn,Cd)S:Cu, Al, and the like), hafnium phosphate fluorescent substances ($HfP_2O_7$:Cu and the like), $YTaO_4$ and a substance in which various activator is added as an emission center to $YTaO_4$.

However, the fluorescent substance used in the present invention is not particularly limited to these specific examples, so long as to emit light in visible or near ultraviolet region by exposure to a radioactive ray.

In the fluorescent intensifying screen used in the present invention, the fluorescent substances are preferably packed in the particle size graded structure. Especially, fluorescent substance particles having a large particle size is preferably coated on the side of the surface protective layer and fluorescent substance particles having a small particle size is preferably coated on the side of the support. Hereto, the small particle size of fluorescent substance is preferably in a range of from 0.5 μm to 2.0 μm and the large size is preferably in a range of from 10 μm to 30 μm.

(Single-sided Type Photothermographic Material)

The single-sided type photothermographic material of the present invention is preferably applied for an X-ray photosensitive material used for mammography.

To use the single-sided type photothermographic material for that purpose, it is very important to design the gradation of the obtained image in a suitable range.

Concerning the preferable constitution for a photosensitive material used for mammography, reference can be made to JP-A Nos. 5-45807, 10-62881, 10-54900, 11-109564.

(Combined Use with Ultraviolet Fluorescent Intensifying Screen)

Concerning the image forming method using photothermographic material according to the present invention, it is preferred that the image forming method is perfomed in combination with a fluorescent substance having a main emission peak at 400 nm or lower. And more preferably, the image forming method is performed in combination with a fluorescent substance having a main emission peak at 380 nm or lower. Either single-sided photosensitive material or double-sided photosensitive material can be applied for the assembly. As the screen having a main emission peak at 400 nm or lower, the screens described in JP-A No. 6-11804 and WO No. 93/01521 and the like are used, but the present invention is not limited to these. As the techniques of crossover cut (for double-sided photosensitive material) and anti-halation (for single-sided photosensitive material) of ultraviolet light, the technique described in JP-A No. 8-76307 can be applied. As ultraviolet absorbing dyes, the dye described in JP-A No. 2001-144030 is particularly preferred.

(Thermal Development)

Although any method may be used for the development of the photothermographic material of the invention, the thermal developing process is usually performed by elevating the temperature of the photothermographic material exposed imagewise. The temperature for the development is preferably in a range of from 80° C. to 250° C., and more preferably, from 100° C. to 140° C. Time period for development is preferably in a range from 1 second to 60 seconds, more preferably from 5 seconds to 30 seconds, and particularly preferably from 5 seconds to 20 seconds.

In the process of thermal development, a process using a plate type heater is preferred. A preferable process for thermal development by a plate type heater is a process described in JP-A No. 11-133572, which discloses a thermal developing apparatus in which a visible image is obtained by bringing a photothermographic material with a formed latent image into contact with a heating means at a thermal developing section, wherein the heating means comprises a plate heater, and a plurality of pressing rollers are oppositely provided along one surface of the plate heater, the thermal developing apparatus is characterized in that thermal development is performed by passing the photothermographic material between the pressing rollers and the plate heater. It is preferred that the plate heater is divided into 2 to 6 steps, with the leading end having a lower temperature by about 1° C. to 10° C.

Such a process is also described in JP-A No. 54-30032, which allows for passage of moisture and organic solvents included in the photothermographic material out of the system, and also allows for suppressing the change of shapes of the support of the photothermographic material upon rapid heating of the photothermographic material.

(System)

Examples of a medical laser imager equipped with a light exposing portion and a thermal developing portion include Fuji Medical Dry Laser Imager FM-DP L and DRYPIX 7000. Concerning FM-DP L, description is found in Fuji Medical Review, No. 8, pages 39 to 55, and these techniques can be applied. In addition, the present photothermographic material can be also applied as a photothermographic material for the laser imager used in "AD network" which was proposed by Fuji Film Medical Co., Ltd. as a network system accommodated to DICOM standard.

5. Application of the Invention

The photothermographic material and the image forming method of the invention are preferably employed as photothermographic materials for use in medical diagnosis, photothermographic materials for use in industrial photographs, photothermographic materials for use in graphic arts, as well as for COM, through forming black and white images by silver imaging, and the image forming method using the same.

The present invention is specifically explained by way of Examples below, which should not be construed as limiting the invention thereto.

EXAMPLES

Example 1

1. Preparation of PET Support and Undercoating 1-1. Film Manufacturing

PET having IV (intrinsic viscosity) of 0.66 (measured in phenol/tetrachloroethane=6/4 (mass ratio) at 25° C.) was obtained according to a conventional manner using terephthalic acid and ethylene glycol. The product was pelletized, dried at 130° C. for 4 hours, and colored blue with the blue dye (1,4-bis(2,6-diethylanilinoanthraquinone). Thereafter, the mixture was extruded from a T-die and rapidly cooled to form a non-tentered film.

The film was stretched along the longitudinal direction by 3.3 times using rollers of different peripheral speeds, and then stretched along the transverse direction by 4.5 times using a tenter machine. The temperatures used for these operations were 110° C. and 130° C., respectively. Then, the film was subjected to thermal fixation at 240° C. for 20 seconds, and relaxed by 4% along the transverse direction at the same temperature. Thereafter, the chucking part was slit off, and both edges of the film were knurled. Then the film was rolled up at the tension of 4 kg/cm$^2$ to obtain a roll having the thickness of 175 μm.

1-2. Surface Corona Discharge Treatment

Both surfaces of the support were treated at room temperature at 20 m/minute using Solid State Corona Discharge Treatment Machine Model 6 KVA manufactured by Piller GmbH. It was proven that treatment of 0.375 KV·A·minute·m$^{-2}$ was executed, judging from the readings of current and voltage on that occasion. The frequency upon this treatment was 9.6 kHz, and the gap clearance between the electrode and dielectric roll was 1.6 mm.

1-3. Undercoating

1) Preparations of Coating Solution for Undercoat Layer

Formula (1) (for Undercoat Layer on the Image Forming Layer Side)

| | |
|---|---|
| Pesresin A-520 manufactured by Takamatsu Oil & Fat Co., Ltd. (30% by weight solution) | 46.8 g |
| BAIRONAARU MD-1200 manufactured by Toyo Boseki Co., Ltd. | 10.4 g |
| Polyethylene glycol monononylphenylether (average ethylene oxide number = 8.5) 1% by weight solution | 11.0 g |
| MP-1000 manufactured by Soken Chemical & Engineering Co., Ltd. (PMMA polymer fine particle, mean particle diameter of 0.4 μm) | 0.91 g |
| distilled water | 931 mL |

2) Undercoating

Both surfaces of the aforementioned biaxially tentered polyethylene terephthalate support having the thickness of 175 μm were subjected to the corona discharge treatment as described above. Thereafter, the aforementioned formula (1) of the coating solution for the undercoat was coated with a wire bar so that the amount of wet coating became 6.6 mL/m$^2$ (per one side), and dried at 180° C. for 5 minutes. Thus, an undercoated support was produced.

2. Preparations of Coating Material

1) Preparations of Photosensitive Silver Halide Emulsion

<Preparations of Photosensitive Silver Halide Emulsion A1 and A2>

These are photosensitive silver halide emulsions for comparision.

Preparation of Host Grains

A solution was prepared by adding 4.3 mL of a 1% by weight potassium iodide solution, and then 3.5 mL of 0.5 mol/L sulfuric acid, 36.5 g of phthalated gelatin, and 160 mL of a 5% by weight methanol solution of 2,2'-(ethylene dithio)diethanol to 1421 mL of distilled water. The solution was kept at 75° C. while stirring in a stainless steel reaction vessel, and thereto were added total amount of: solution A prepared through diluting 22.22 g of silver nitrate by adding distilled water to give the volume of 218 mL; and solution B prepared through diluting 36.6 g of potassium iodide with distilled water to give the volume of 366 mL. A method of controlled double jet was executed through adding total amount of the solution A at a constant flow rate over 16 minutes, accompanied by adding the solution B while maintaining the pAg at 10.2.

Thereafter, 10 mL of a 3.5% by weight aqueous solution of hydrogen peroxide was added thereto, and 10.8 mL of a 10% by weight aqueous solution of benzimidazole was further added. Moreover, a solution C prepared through diluting 51.86 g of silver nitrate by adding distilled water to give the volume of 508.2 mL and a solution D prepared through diluting 63.9 g of potassium iodide with distilled water to give the volume of 639 mL were added. A method of controlled double jet was executed through adding total amount of the solution C at a constant flow rate over 80 minutes, accompanied by adding the solution D while maintaining the pAg at 10.2.

Potassium hexachloroiridate (III) was added in its entirety to give $1\times10^{-4}$ mol per 1 mol of silver, at 10 minutes post initiation of the addition of the solution C and the solution D. Moreover, at 5 seconds after completing the addition of the solution C, potassium hexacyanoferrate (II) in an aqueous solution was added in its entirety to give $3\times10^{-4}$ mol per 1 mol of silver.

The mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 11.0.

Thereby an unripened pure silver iodide emulsion (hereinafter, expressed as the unripened emulsion A) was prepared.

The obtained silver halide grains had a mean projected area equivalent diameter of 0.93 μm, a variation coefficient of a projected area equivalent diameter distribution of 17.7%, a mean thickness of 0.057 μm, and a mean aspect ratio of 16.3. Tabular grains having an aspect ratio of 2 or more occupied 80% or more of the total projected area. A mean equivalent spherical diameter of the grains was 0.42 μm. 30% or more of the silver iodide existed in γ phase from the result of powder X-ray diffraction analysis.

Preparation of Epitaxial Junction Portion

Silver halide emulsion A1: This is an emulsion having an epitaxial junction of AgBr.

1 mol of the unripened emulsion A described above was added to a reaction vessel. The pAg measured at 38° C. was 10.2. 0.5 mol/L potassium bromide solution and 0.5 mol/L silver nitrate solution were added at an addition speed of 10 mL/min over 20 minutes by the method of double jet addition to precipitate substantially a 10 mol % of silver bromide on the silver iodide host grains as epitaxial form while keeping the pAg at 10.2 during the operation. Furthermore, the mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 11.0.

Silver halide emulsion A2: This is an emulsion having an epitaxial junction of AgCl.

A silver halide dispersion was prepared in a similar manner to the process in the preparation of silver halide emulsion A1 except that using 0.5 mol/L sodium chloride solution instead of using 0.5 mol/L potassium bromide solution.

Chemical Sensitization

The above-mentioned silver halide emulsion A1 and A2 were kept at 38° C. with stirring, and to each was added 5 mL of a 0.34% by weight methanol solution of 1,2-benzoisothiazoline-3-one, and after 40 minutes the temperature was elevated to 47° C. At 20 minutes after elevating the temperature, sodium benzene thiosulfonate in a methanol solution was added at $7.6\times10^{-5}$ mol per 1 mol of silver. At additional 5 minutes later, tellurium sensitizer C in a methanol solution was added at $2.9\times10^{-5}$ mol per 1 mol of silver and subjected to ripening for 91 minutes.

Then, 1.3 mL of a 0.8% by weight N,N'-dihydroxy-N", N"-diethylmelamine in methanol was added thereto, and at additional 4 minutes thereafter, 5-methyl-2-mercaptobenzimidazole in a methanol solution at $4.8\times10^{-3}$ mol per 1 mol of silver, 1-phenyl-2-heptyl-5-mercapto-1,3,4-triazole in a methanol solution at $5.4\times10^{-3}$ mol per 1 mol of silver, and 1-(3-methylureido phenyl)-5-mercaptotetrazole in an aqueous solution at $8.5\times10^{-3}$ mol per 1 mol of silver were added.

<Preparations of Photosensitive Silver Halide Emulsion B1 to B7>

Using the host emulsion A, emulsions having core/shell type epitaxial junction portion with various halogen compositions were prepared (shown in Table 1). Preparations of the silver halide dispersion were conducted in a similar manner to the process in the preparation of epitaxial emulsion A1 except that 0.5 mol/L potassium bromide solution, 0.5 mol/L sodium chloride solution, and 0.5 mol/L silver nitrate solution were employed, and the formation of epitaxial junction portion having an arbitrary halogen composition was performed by adjusting the addition amount of the potassium bromide solution.

Chemical Sensitization

Chemical sensitization is applied for emulsion B1 to B7 similar to emulsion A1 and A2.

TABLE 1

| | Epitaxial Junction | | | |
|---|---|---|---|---|
| | Core Part | | Shell Part | |
| Silver Halide Emulsion No. | Halogen Composition Ratio | Silver Amount (mol % vs Host Grain) | Halogen Composition Ratio | Silver Amount (mol % vs Host Grain) |
| A1 | — | — | Cl/Br = 0/100 | 10 |
| A2 | — | — | Cl/Br = 100/0 | 10 |
| B1 | Cl/Br = 0/100 | 5 | Cl/Br = 30/70 | 5 |
| B2 | Cl/Br = 30/70 | 5 | Cl/Br = 20/80 | 5 |
| B3 | Cl/Br = 40/60 | 7 | Cl/Br = 30/70 | 3 |
| B4 | Cl/Br = 60/40 | 7 | Cl/Br = 20/80 | 3 |
| B5 | Cl/Br = 80/20 | 6 | Cl/Br = 20/80 | 4 |
| B6 | Cl/Br = 100/0 | 6 | Cl/Br = 0/100 | 4 |
| B7 | Cl/Br = 100/0 | 7 | Cl/Br = 0/100 | 3 |

<Preparations of Emulsion for Coating Solution>

The above-described silver halide emulsion was dissolved and thereto was added benzothiazolium iodide in a 1% by weight aqueous solution at $7\times10^{-3}$ mol per 1 mol of silver. Further, as "a compound that can be one-electron-oxidized to provide a one-electron oxidation product, which releases one or more electrons", the compounds Nos. 1, 2, and 3 were added respectively in an amount of $2\times10^{-3}$ mol per 1 mol of silver in silver halide.

Thereafter, as "a compound having an adsorptive group and a reducing group", the compound Nos. 1 and 2 were added respectively in an amount of $8\times10^{-3}$ mol per 1 mol of silver halide.

Further, water was added thereto to give the content of silver halide of 15.6 g in terms of silver, per 1 liter of the emulsion for a coating solution.

2) Preparation of Dispersion of Silver Salt of Fatty Acid

<Preparation of Recrystallized Behenic Acid>

Behenic acid manufactured by Henkel Co. (trade name: Edenor C22-85R) in an amount of 100 kg was admixed with 1200 kg of isopropyl alcohol, and dissolved at 50° C. The mixture was filtrated through a 10 μm filter, and cooled to 30° C. to allow recrystallization. Cooling speed for the recrystallization was controlled to be 3° C./hour. The resulting crystal was subjected to centrifugal filtration, and washing was performed with 100 kg of isopropyl alcohol. Thereafter, the crystal was dried.

The resulting crystal was esterified, and subjected to GC-FID analysis to give the results of the content of behenic acid being 96 mol %, lignoceric acid 2 mol %, and arachidic acid 2 mol %. In addition, erucic acid was included at 0.001 mol %.

<Preparation of Dispersion of Silver Salt of Fatty Acid>

88 kg of the recrystallized behenic acid, 422 L of distilled water, 49.2 L of 5 mol/L sodium hydroxide aqueous solution, 120 L of t-butyl alcohol were admixed, and subjected to a reaction with stirring at 75° C. for one hour to give a solution of sodium behenate. Separately, 206.2 L of an aqueous solution of 40.4 kg of silver nitrate (pH 4.0) was provided, and kept at a temperature of 10° C. A reaction vessel charged with 635 L of distilled water and 30 L of t-butyl alcohol was kept at 30° C., and thereto were added the total amount of the solution of sodium behenate and the total amount of the aqueous silver nitrate solution with sufficient stirring at a constant flow rate over 93 minutes and 15 seconds, and 90 minutes, respectively.

Upon this operation, during first 11 minutes following the initiation of adding the aqueous silver nitrate solution, the added material was restricted to the aqueous silver nitrate solution alone. The addition of the solution of sodium behenate was thereafter started, and during 14 minutes and 15 seconds following the completion of adding the aqueous silver nitrate solution, the added material was restricted to the solution of sodium behenate alone.

The temperature inside of the reaction vessel was then set to be 30° C., and the temperature outside was controlled so that the liquid temperature could be kept constant.

In addition, the temperature of a pipeline for the addition system of the solution of sodium behenate was kept constant by circulation of warm water outside of a double wall pipe, so that the temperature of the liquid at an outlet in the leading edge of the nozzle for addition was adjusted to be 75° C. Further, the temperature of a pipeline for the addition system of the aqueous silver nitrate solution was kept constant by circulation of cool water outside of a double wall pipe. Position at which the solution of sodium behenate was added and the position, at which the aqueous silver nitrate solution was added, was arranged symmetrically with a shaft for stirring located at a center. Moreover, both of the positions were adjusted to avoid contact with the reaction liquid.

After completing the addition of the solution of sodium behenate, the mixture was left to stand at the temperature as it was for 20 minutes. The temperature of the mixture was then elevated to 35° C. over 30 minutes followed by ripening for 210 minutes. Immediately after completing the ripening, solid matters were filtered out with centrifugal filtration. The solid matters were washed with water until the electric conductivity of the filtrated water became 30 μS/cm. A silver salt of fatty acid was thus obtained. The resulting solid matters were stored as a wet cake without drying.

When the shape of the resulting particles of the silver behenate was evaluated by an electron micrography, a crystal was revealed having a=0.21 μm, b=0.4 μm and c=0.4 μm on the average value, with a mean aspect ratio of 2.1, and a variation coefficient of an equivalent spherical diameter distribution of 11% (a, b and c are as defined aforementioned.).

To the wet cake corresponding to 260 kg of a dry solid matter content, were added 19.3 kg of poly(vinyl alcohol) (trade name: PVA-217) and water to give the total amount of 1000 kg. Then, a slurry was obtained from the mixture using a dissolver blade. Additionally, the slurry was subjected to preliminary dispersion with a pipeline mixer (manufactured by MIZUHO Industrial Co., Ltd.: PM-10 type).

Next, a stock liquid after the preliminary dispersion was treated three times using a dispersing machine (trade name: Microfluidizer M-610, manufactured by Microfluidex International Corporation, using Z type Interaction Chamber) with the pressure controlled to be 1150 kg/cm$^2$ to give a dispersion of the silver behenate. For the cooling manipulation, coiled heat exchangers were equipped in front of and behind the interaction chamber respectively, and accordingly, the temperature for the dispersion was set to be 18° C. by regulating the temperature of the cooling medium.

3) Preparation of Reducing Agent Dispersion

<Preparation of Reducing Agent-1 Dispersion>

To 10 kg of reducing agent-1 (1,1-bis(2-hydroxy-3,5-dimethylphenyl)-3,5,5-trimethylhexane) and 16 kg of a 10% by weight aqueous solution of modified poly(vinyl alcohol) (manufactured by Kuraray Co., Ltd., Poval MP203) is added 10 kg of water, and thoroughly mixed to give a slurry. This slurry is fed with a diaphragm pump, and is subjected to dispersion with a horizontal sand mill (UVM-2: manufactured by AIMEX Co., Ltd.) packed with zirconia beads having a mean particle diameter of 0.5 mm for 3 hours. Thereafter, 0.2 g of a benzisothiazolinone sodium salt and water are added thereto, thereby adjusting the concentration of the reducing agent to be 25% by weight. This dispersion is subjected to heat treatment at 60° C. for 5 hours to obtain reducing agent-1 dispersion.

Particles of the reducing agent included in the resulting reducing agent dispersion have a median diameter of 0.40 μm, and a maximum particle diameter of 1.4 μm or less. The resultant reducing agent dispersion is subjected to filtration with a polypropylene filter having a pore size of 3.0 μm to remove foreign substances such as dust, and stored.

4) Preparation of Nucleator Dispersion 2.5 g of poly(vinyl alcohol) (manufactured by Kuraray Co., Ltd., PVA-217) and 87.5 g of water are added to 10 g of nucleator SH-7, and thoroughly admixed to give a slurry. This slurry is allowed to stand for 3 hours.

Zirconia beads having a mean particle diameter of 0.5 mm are provided in an amount of 240 g, and charged in a vessel with the slurry. Dispersion is performed with a dispersing machine (1/4G sand grinder mill: manufactured by IMEX Co., Ltd.) for 10 hours to obtain a solid fine particle dispersion of nucleator. Particles of the nucleator included in the resulting nucleator dispersion have a mean particle diameter of 0.5 μm, and 80% by weight of the particles has a particle diameter of 0.1 μm to 1.0 μm.

5) Preparation of Hydrogen Bonding Compound Dispersion

To 10 kg of hydrogen bonding compound-1 (tri(4-t-butylphenyl)phosphineoxide) and 16 kg of a 10% by weight aqueous solution of modified poly(vinyl alcohol) (manufactured by Kuraray Co., Ltd., Poval MP203) was added 10 kg of water, and thoroughly mixed to give a slurry.

This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 4 hours. Thereafter, 0.2 g of a benzisothiazolinone sodium salt and water were added thereto, thereby adjusting the concentration of the hydrogen bonding compound to be 25% by weight.

This dispersion was warmed at 40° C. for one hour, followed by a subsequent heat treatment at 80° C. for one hour to obtain hydrogen bonding compound-1 dispersion.

Particles of the hydrogen bonding compound included in the resulting hydrogen bonding compound dispersion had a median diameter of 0.45 μm, and a maximum particle diameter of 1.3 μm or less. The resultant hydrogen bonding compound dispersion was subjected to filtration with a polypropylene filter having a pore size of 3.0 μm to remove foreign substances such as dust, and stored.

6) Preparations of Dispersions of Development Accelerator and Dispersion of Color-tone-adjusting Agent <Preparation of Development Accelerator-1 Dispersion>

To 10 kg of development accelerator-1 and 20 kg of a 10% by weight aqueous solution of modified poly(vinyl alcohol) (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours and 30 minutes. Thereafter, 0.2 g of a benzisothiazolinone sodium salt and water were added thereto, thereby adjusting the concentration of the development accelerator to be 20% by weight. Accordingly, development accelerator-1 dispersion was obtained.

Particles of the development accelerator included in the resulting development accelerator dispersion had a median diameter of 0.48 μm, and a maximum particle diameter of 1.4 μm or less. The resultant development accelerator dispersion was subjected to filtration with a polypropylene filter having a pore size of 3.0 μm to remove foreign substances such as dust, and stored.

<Preparations of Solid Dispersions of Development Accelerator-2 and Color-tone-adjusting Agent>

Also concerning solid dispersions of development accelerator-2 and color-tone-adjusting agent-1, dispersion was executed similar to the development accelerator-1, and thus dispersions of 20% by weight and 15% by weight were respectively obtained.

7) Preparations of Organic Polyhalogen Compound Dispersion

<Preparation of Organic Polyhalogen Compound-1 Dispersion>

10 kg of organic polyhalogen compound-1 (tribromomethane sulfonylbenzene), 10 kg of a 20% by weight aqueous solution of modified poly(vinyl alcohol) (manufactured by Kuraray Co., Ltd., Poval MP203), 0.4 kg of a 20% by weight aqueous solution of sodium triisopropylnaphthalenesulfonate and 14 kg of water were thoroughly admixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 5 hours. Thereafter, 0.2 g of a benzisothiazolinone sodium salt and water were added thereto, thereby adjusting the concentration of the organic polyhalogen compound to be 30% by weight. Accordingly, organic polyhalogen compound-1 dispersion was obtained.

Particles of the organic polyhalogen compound included in the resulting organic polyhalogen compound dispersion had a median diameter of 0.41 μm, and a maximum particle diameter of 2.0 μm or less.

The resultant organic polyhalogen compound dispersion was subjected to filtration with a polypropylene filter having a pore size of 10.0 μm to remove foreign substances such as dust, and stored.

<Preparation of Organic Polyhalogen Compound-2 Dispersion>

10 kg of organic polyhalogen compound-2 (N-butyl-3-tribromomethane sulfonylbenzamide), 20 kg of a 10% by weight aqueous solution of modified poly(vinyl alcohol) (manufactured by Kuraray Co., Ltd., Poval MP203) and 0.4 kg of a 20% by weight aqueous solution of sodium triisopropylnaphthalenesulfonate were thoroughly admixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 5 hours. Thereafter, 0.2 g of a benzisothiazolinone sodium salt and water were added thereto, thereby adjusting the concentration of the organic polyhalogen compound to be 30% by weight. This fluid dispersion was heated at 40° C. for 5 hours to obtain organic polyhalogen compound-2 dispersion.

Particles of the organic polyhalogen compound included in the resulting organic polyhalogen compound dispersion had a median diameter of 0.40 μm, and a maximum particle diameter of 1.3 μm or less. The resultant organic polyhalogen compound dispersion was subjected to filtration with a polypropylene filter having a pore size of 3.0 μm to remove foreign substances such as dust, and stored.

8) Preparation of Silver Iodide Complex-forming Agent Solution 8 kg of modified poly(vinyl alcohol) MP203 was dissolved in 174.57 kg of water, and thereto were added 3.15 kg of a 20% by weight aqueous solution of sodium triisopropylnaphthalenesulfonate and 14.28 kg of a 70% by weight aqueous solution of 6-isopropylphthalazine. Accordingly, a 5% by weight solution of silver iodide complex-forming agent compound was prepared.

9) Preparations of Aqueous Solution of Mercapto Compound

<Preparation of Aqueous Solution of Mercapto Compound-1>

Mercapto compound-1 (1-(3-sulfophenyl)-5-mercaptotetrazole sodium salt) in an amount of 7 g was dissolved in 993 g of water to give a 0.7% by weight aqueous solution.

<Preparation of Aqueous Solution of Mercapto Compound-2>

Mercapto compound-2 (1-(3-methylureidophenyl)-5-mercaptotetrazole) in an amount of 20 g was dissolved in 980 g of water to give a 2.0% by weight aqueous solution.

10) Preparation of Polymer Latex Solution

To a polymerization tank of a gas monomer reaction apparatus (manufactured by Taiatsu Techno Corporation, TAS-2J type), were charged 287 g of distilled water, 7.73 g of a surfactant (Pionin A-43-S (manufactured by TAKEMOTO OIL & FAT CO., LTD.): solid matter content of 48.5% by weight), 14.06 mL of 1 mol/L sodium hydroxide, 0.15 g of ethylenediamine tetraacetate tetrasodium salt, 255 g of styrene, 11.25 g of acrylic acid, and 3.0 g of tert-dodecyl mercaptan, followed by sealing of the reaction vessel and stirring at a stirring rate of 200 rpm. Degassing was conducted with a vacuum pump, followed by repeating nitrogen gas replacement several times. Thereto was injected 108.75 g of 1,3-butadiene, and the inner temperature is elevated to 60° C. Thereto was added a solution of 1.875 g of ammonium persulfate dissolved in 50 mL of water, and the mixture was stirred for 5 hours as it stands. The temperature was further elevated to 90° C., followed by stirring for 3 hours. After completing the reaction, the inner temperature was lowered to reach to the room temperature, and thereafter the mixture was treated by adding 1 mol/L sodium hydroxide and ammonium hydroxide to give the molar ratio of $Na^+$ ion:$NH_4^+$ ion=1:5.3, and thus, the pH of the mixture was adjusted to 8.4. Thereafter, filtration with a polypropylene filter having the pore size of 1.0 μm was conducted to remove foreign substances such as dust followed by storage. Accordingly, SBR latex TP-1 was obtained in an amount of 774.7 g. Upon the measurement of halogen ion by ion chromatography, concentration of chloride ion was revealed to be 3 ppm. As a result of the measurement of the concentration of the chelating agent by high performance liquid chromatography, it was revealed to be 145 ppm.

The aforementioned latex had a mean particle diameter of 90 nm, Tg of 17° C., solid matter concentration of 44% by weight, the equilibrium moisture content at 25° C. and 60% RH of 0.6% by weight, ionic conductance of 4.80 mS/cm (measurement of the ionic conductance performed using a conductivity meter CM-30S manufactured by Toa Electronics Ltd. for the latex stock solution (44% by weight) at 25° C.) and pH of 8.4.

3. Preparations of Coating Solution

1) Preparations of Coating Solution for Image Forming Layer

To the dispersion of silver salt of fatty acid in an amount of 1000 g and 276 mL of water were serially added the organic polyhalogen compound-1 dispersion, the organic polyhalogen compound-2 dispersion, the SBR latex (Tg: 17° C.) solution, the reducing agent-1 dispersion, the nucleator dispersion, the hydrogen bonding compound-1 dispersion, the development accelerator-1 dispersion, the development accelerator-2 dispersion, the color-tone-adjusting agent-1 dispersion, the mercapto compound-1 aqueous solution, and the mercapto compound-2 aqueous solution. After adding thereto the silver iodide complex-forming agent, the emulsion for coating solution was added thereto in an amount of 0.22 mol by silver amount per 1 mol of silver salt of fatty acid, followed by thorough mixing just prior to the coating, which is fed directly to a coating die.

2) Preparation of Coating Solution for Intermediate Layer

To 1000 g of poly(vinyl alcohol) PVA-205 (manufactured by Kuraray Co., Ltd.) and 4200 mL of a 19% by weight solution of methyl methacrylate/styrene/butyl acrylate/hydroxyethyl methacrylate/acrylic acid copolymer (mass ratio of the copolymerization of 64/9/20/5/2) latex were added 27 mL of a 5% by weight aqueous solution of aerosol OT (manufactured by American Cyanamid Co.) and water to give total amount of 10000 g. The mixture was adjusted with sodium hydroxide to give the pH of 7.5. Accordingly, the coating solution for the intermediate layer was prepared, and was fed to a coating die to provide 9.1 mL/m$^2$.

Viscosity of the coating solution was 58 [mPa·s] which was measured with a B type viscometer at 40° C. (No. 1 rotor, 60 rpm).

3) Preparation of Coating Solution for First Layer of Surface Protective Layers

In water was dissolved 64 g of inert gelatin, and thereto were added 112 g of a 19.0% by weight solution of methyl methacrylate/styrene/butyl acrylate/hydroxyethyl methacrylate/acrylic acid copolymer (mass ratio of the copolymerization of 64/9/20/5/2) latex, 30 mL of a 15% by weight methanol solution of phthalic acid, 23 mL of a 10% by weight aqueous solution of 4-metyl phthalic acid, 28 mL of 0.5 mol/L sulfuric acid, 5 mL of a 5% by weight aqueous solution of aerosol OT, 0.5 g of phenoxyethyl alcohol, and 0.1 g of benzisothiazolinone. Water was added to give total amount of 750 g. Immediately before coating, 26 mL of a 4% by weight chrome alum which had been mixed with a static mixer was fed to a coating die so that the amount of the coating solution became 18.6 mL/m$^2$.

Viscosity of the coating solution was 20 [mPa·s] which was measured with a B type viscometer at 40° C. (No. 1 rotor, 60 rpm).

4) Preparation of Coating Solution for Second Layer of Surface Protective Layers In water was dissolved 80 g of inert gelatin and thereto were added 102 g of a 27.5% by weight solution of methyl methacrylate/styrene/butyl acrylate/hydroxyethyl methacrylate/acrylic acid copolymer (mass ratio of the copolymerization of 64/9/20/5/2) latex, 5.4 mL of a 2% by weight solution of a fluorocarbon surfactant (F-1), 5.4 mL of a 2% by weight aqueous solution of another fluorocarbon surfactant (F-2), 23 mL of a 5% by weight aqueous solution of aerosol OT, 4 g of poly(methyl methacrylate) fine particles (mean particle diameter of 0.7 μm, distribution of volume weighted average being 30%), 21 g of poly(methyl methacrylate) fine particles (mean particle diameter of 3.6 μm, distribution of volume weighted average being 60%), 1.6 g of 4-methyl phthalic acid, 4.8 g of phthalic acid, 44 mL of 0.5 mol/L sulfuric acid, and 10 mg of benzisothiazolinone. Water was added to give total amount of 650 g. Immediately before coating, 445 mL of a aqueous solution containing 4% by weight chrome alum and 0.67% by weight phthalic acid were added and admixed with a static mixer to give a coating solution for the second layer of the surface protective layers, which was fed to a coating die so that 8.3 mL/m$^2$ could be provided.

Viscosity of the coating solution was 19 [mPa·s] which was measured with a B type viscometer at 40° C. (No. 1 rotor, 60 rpm).

4. Preparations of Photothermographic Material

Simultaneous overlaying coating by a slide bead coating method was subjected in order of the image forming layer, intermediate layer, first layer of the surface protective layers, and second layer of the surface protective layers, starting from the undercoated face. Thus samples of photothermographic materials were produced.

In this method, the temperature of the coating solution was adjusted to 31° C. for the image forming layer and intermediate layer, to 36° C. for the first layer of the surface protective layers, and to 37° C. for the second layer of the surface protective layers. The amount of coated silver was 0.862 g/m$^2$ per one side, with respect to the sum of silver salt of fatty acid and silver halide. This was coated on both sides of the support.

The coating amount of each compound (g/m$^2$) for the image forming layer per one side is as follows.

| | |
|---|---|
| Silver salt of fatty acid | 2.85 |
| Organic polyhalogen compound-1 | 0.028 |
| Organic polyhalogen compound-2 | 0.094 |
| Silver iodide complex-forming agent | 0.46 |
| SBR latex | 5.20 |
| Reducing agent-1 | 0.46 |
| Nucleator SH-7 | 0.036 |
| Hydrogen bonding compound-1 | 0.15 |
| Development accelerator-1 | 0.005 |
| Development accelerator-2 | 0.035 |
| Color-tone-adjusting agent-1 | 0.002 |
| Mercapto compound-1 | 0.001 |
| Mercapto compound-2 | 0.003 |
| Silver halide (on the basis of Ag content) | 0.175 |

Conditions for coating and drying were as follows.

The support was decharged by ionic wind. Coating was performed at the speed of 160 m/min. Conditions for coating and drying were adjusted within the range described below, and conditions were set to obtain the most stable surface state.

The clearance between the leading end of the coating die and the support was 0.10 mm to 0.30 mm.

The pressure in the vacuum chamber was set to be lower than atmospheric pressure by 196 Pa to 882 Pa.

In the subsequent cooling zone, the coating solution was cooled by wind having the dry-bulb temperature of 10° C. to 20° C.

Transportation with no contact was carried out, and the coated support was dried with an air of the dry-bulb of 23° C. to 45° C. and the wet-bulb of 15° C. to 21° C. in a helical type contactless drying apparatus.

After drying, moisture conditioning was performed at 25° C. in the humidity of 40% RH to 60% RH.

Then, the film surface was heated to be 70° C. to 90° C., and after heating, the film surface was cooled to 25° C.

Thus prepared photothermographic material had a level of matting of 550 seconds as Beck's smoothness. In addition, measurement of the pH of the film surface gave the result of 6.0.

Chemical structures of the compounds used in Examples of the invention are shown below.

Tellurium sensitizer C

Tellurium sensitizer C

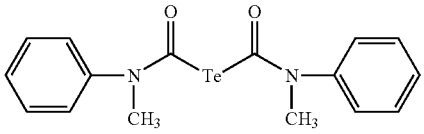

Compound 1 that can be one-electron-oxidized to provide a one-electron oxidation product which releases one or more electrons

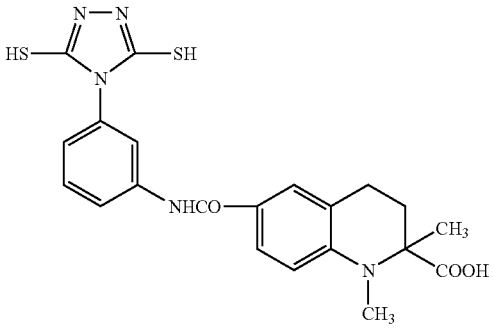

Compound 2 that can be one-electron-oxidized to provide a one-electron oxidation product which releases one or more electrons

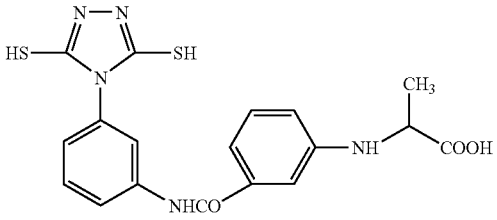

Compound 3 that can be one-electron-oxidized to provide a one-electron oxidation product which releases one or more electrons

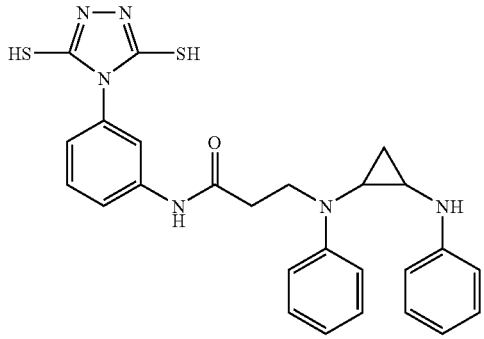

Compound 1 having adsorptive group and reducing group

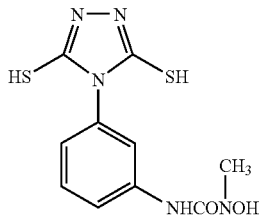

Compound 2 having adsorptive group and reducing group

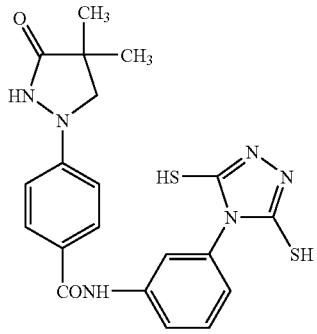

Reducing agent-1

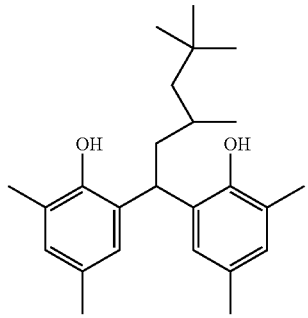

Nucleator SH-7

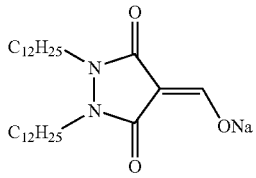

-continued

Hydrogen bonding compound-1

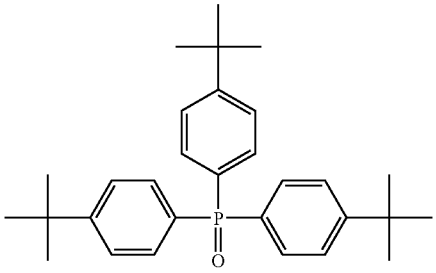

Organic polyhalogen compound-1

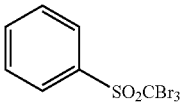

Organic polyhalogen compound-2

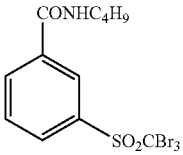

Mercapto compound-1

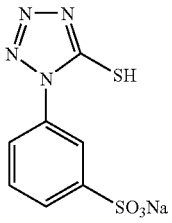

Mercapto compound-2

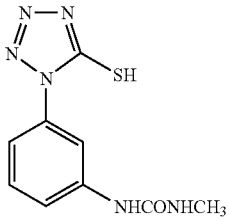

Silver iodide complex-forming agent

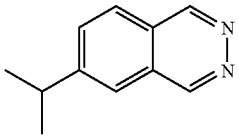

Development accelerator-1

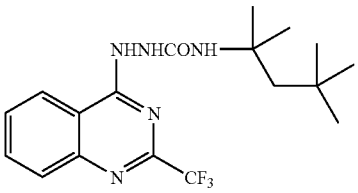

-continued

Development accelerator-2

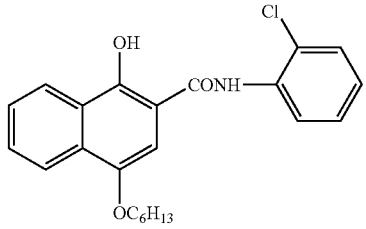

Color-tone-adjusting agent-1

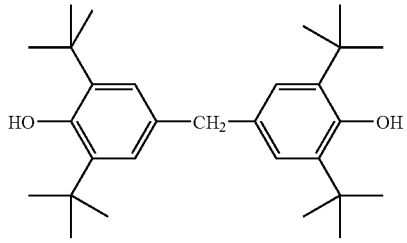

(F-1)

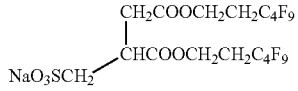

(F-2)

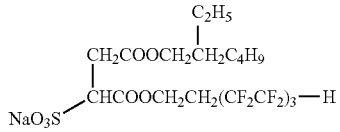

5. Evaluation of Photographic Properties

1) Preparation

The resulting sample was cut into a half-cut size, and was wrapped with the following packaging material under an environment of 25° C. and 50% RH, and stored for 2 weeks at an ambient temperature.

<Packaging Material>

A film laminated with PET 10 μm/PE 12 μm/aluminum foil 9 μm/Ny 15 μm/polyethylene 50 μm containing carbon at 3% by weight:

oxygen permeability at 25° C.: 0.02 $mL \cdot atm^{-1}m^{-2}day^{-1}$;

vapor permeability at 25° C.: 0.10 $g \cdot atm^{1}m^{-2}day^{-1}$.

2) Exposure and Thermal Development

Thus prepared double-sided coated photothermographic material was evaluated as follows.

Two sheets of X-ray regular screen HI-SCREEN-B3 ($CaWO_4$ was used as fluorescent substance, the emission peak wavelength of 425 nm) produced by Fuji Photo Film Co., Ltd. were used, and the assembly for image formation was provided by inserting the sample between them.

This assembly was subjected to X-ray exposure for 0.05 seconds, and then X-ray sensitometry was performed. The X-ray apparatus used was DRX-3724HD (trade name) produced by Toshiba Corp., and a tungsten target tube was used. X-ray emitted by a pulse generator operated at three phase voltage of 80 kVp and penetrated through a filter comprising 7 cm thickness of water having the absorption ability almost the same as human body was used as the light source. Changing the exposure value of X-ray by a distance method, the sample was subjected to exposure with a step wedge tablet having a width of 0.15 in terms of log E. After exposure, the exposed sample was subjected to thermal development with the condition mentioned below, and then the obtained image was evaluated by a densitometer.

The thermal developing portion of Fuji Medical Dry Laser Imager FM-DP L was modified so that it can heat from both sides, and by another modification the transportation rollers in the thermal developing portion were changed to the heating drum so that the sheet of film could be conveyed. The temperature of four panel heaters were set to 112° C.-118° C.-120° C.-120° C., and the temperature of the heating drum was set to 120° C. By increasing the speed of transportation, the total time period for thermal development was set to be 14 seconds.

3) Results of Evaluation (Phtographic Properties)

Densities of the obtained image were measured by using a Macbeth densitometer to draw a photographic characteristic curve representing a relationship between density and the common logarithm of exposure value.

Fog: The density of the unexposed part was measured using a Macbeth densitometer.

Sensitivity: Sensitivity is the inverse of the exposure value giving image density of fog+1.0. The sensitivities are shown in relative value, detecting the sensitivity of Sample No. 1 to be 100. The bigger the value is, it shows that sensitivity is higher.

(Image Storability)

Image Storability (Print-out): After thermal development, the samples were cut in a half-cut size and stored, under the environment of 30° C. and 70% RH, for 24 hours under 1000 Lux fluorescent lamp. Thereafter the increase of fog was measured.

(Raw Stock Storability)

Each sample was stored under the environment of 45° C. and 40% RH for 3 days. Thereafter similar processing was performed.

The obtained results are shown in Table 2.

TABLE 2

| Sample | Silver Halide | Photographic Properties | | Raw Stock Storability | | Print-out | |
|---|---|---|---|---|---|---|---|
| No. | Emulsion No. | Fog | Sensitivity | Fog | Sensitivity | Δ Fog | Note |
| 1 | A1 | 0.20 | 100 | 0.25 | 62 | 0.02 | Comparative |
| 2 | A2 | 0.13 | 35 | 0.14 | 33 | 0.02 | Comparative |
| 3 | B1 | 0.19 | 105 | 0.23 | 79 | 0.02 | Invention |
| 4 | B2 | 0.19 | 108 | 0.22 | 84 | 0.02 | Invention |
| 5 | B3 | 0.17 | 95 | 0.19 | 80 | 0.02 | Invention |
| 6 | B4 | 0.16 | 91 | 0.18 | 79 | 0.02 | Invention |
| 7 | B5 | 0.14 | 85 | 0.15 | 79 | 0.02 | Invention |
| 8 | B6 | 0.16 | 115 | 0.18 | 100 | 0.02 | Invention |
| 9 | B7 | 0.15 | 108 | 0.16 | 97 | 0.02 | Invention |

4) Results

It is apparent from the results that the photothermographic materials of the present invention can attain both low fog and high sensitivity, and astonishingly, deterioration in sensitivity at raw stock storage is extremely well improved as for the photothermographic material of the presen invention.

Especially, the improvement was remarkable when the core part had a high content of silver chloride. Further the photothermographic materials of the present invention exhibit excellent performances in printout resistance after processing.

Example 2

1. Preparations of Sample

Preparations of sample Nos. 21 to 27 were conducted in a similar manner to the process in the preparation of sample No. 3 in Example 1, except that using the photosensitive silver halide emulsion C1 to C8 described below instead of using photosensitive silver halide emulsion B1.

(Preparations of Photosensitive Silver Halide Emulsion C1 to C8)<

<Host Grains>

The same host grains as those in Example 1 were used.

<Preparations of Epitaxial Junction Portion>

Epitaxial junction portions having a threefold structure were prepared. Details of each layer are shown in Table 3.

2. Evaluation of Photographic Properties

Evaluation was conducted similar to Example 1. The obtained results are shown in Table 4.

It is apparent from the results that the photothermographic materials of the present invention can attain both low fog and high sensitivity. It is revealed that deterioration in sensitivity at raw stock storage is extremely well improved similar to Example 1 as for the photothermographic material of the presen invention.

TABLE 3

| Silver Halide | Epitaxial Junction | | | | | |
|---|---|---|---|---|---|---|
| | Core Part | | Intermediate Part | | Shell Part | |
| Emulsion No. | Halogen Composition Ratio | Silver Amount (mol % vs Host Grain) | Halogen Composition Ratio | Silver Amount (mol % vs Host Grain) | Halogen Composition Ratio | Silver Amount (mol % vs Host Grain) |
| B1 | Cl/Br = 0/100 | 5 | — | — | Cl/Br = 30/70 | 5 |
| C1 | Cl/Br = 0/100 | 2 | Cl/Br/I = 0/96/4 | 3 | Cl/Br = 30/70 | 5 |
| C2 | Cl/Br = 0/100 | 2 | Cl/Br/I = 0/90/10 | 3 | Cl/Br = 30/70 | 5 |
| C3 | Cl/Br = 0/100 | 3 | Cl/Br/I = 0/75/25 | 2 | Cl/Br = 30/70 | 5 |
| C4 | Cl/Br = 40/60 | 3 | Cl/Br/I = 0/90/10 | 3 | Cl/Br = 30/70 | 4 |
| C5 | Cl/Br = 80/20 | 3 | Cl/Br/I = 0/90/10 | 3 | Cl/Br = 10/90 | 4 |
| C6 | Cl/Br = 80/20 | 4 | Cl/Br/I = 0/100/0 | 2 | Cl/Br = 30/70 | 4 |
| C7 | Cl/Br = 100/0 | 5 | Cl/Br/I = 0/0/100 | 1 | Cl/Br = 0/100 | 4 |
| C8 | Cl/Br = 100/0 | 4 | Cl/Br/I = 0/90/10 | 2 | Cl/Br = 10/90 | 4 |

TABLE 4

| Sample | Silver Halide | Photographic Properties | | Raw Stock Storability | | Print-out | |
|---|---|---|---|---|---|---|---|
| No. | Emulsion No. | Fog | Sensitivity | Fog | Sensitivity | Δ Fog | Note |
| 3 | B1 | 0.19 | 105 | 0.23 | 79 | 0.02 | Invention |
| 21 | C1 | 0.19 | 113 | 0.23 | 86 | 0.02 | Invention |
| 22 | C2 | 0.20 | 118 | 0.24 | 91 | 0.02 | Invention |
| 23 | C3 | 0.21 | 124 | 0.25 | 93 | 0.02 | Invention |
| 24 | C4 | 0.18 | 105 | 0.21 | 84 | 0.02 | Invention |
| 25 | C5 | 0.18 | 102 | 0.21 | 83 | 0.02 | Invention |
| 26 | C6 | 0.17 | 95 | 0.20 | 82 | 0.02 | Invention |
| 27 | C7 | 0.16 | 115 | 0.19 | 100 | 0.02 | Invention |
| 28 | C8 | 0.17 | 113 | 0.19 | 97 | 0.02 | Invention |

Example 3

1. Preparations of Photosensitive Silver Halide Emulsion D1 to D6

<Preparation of Host Grains>

1500 mL of an aqueous solution containing 4.1 g of potassium bromide and 14.1 g of phthalated gelatin was stirred while maintaining the temperature thereof at 40° C. An aqueous solution containing silver nitrate (2.9 g) and an aqueous solution containing potassium bromide (2.0 g) and potassium iodide (0.39 g) were added to the solution over a period of 40 seconds. After the addition of an aqueous solution containing 35.5 g of phthalated gelatin, the temperature of the mixture was elevated to 58° C.

Thereafter, as the first growth stage, an aqueous solution containing silver nitrate (63.7 g) and a potassium bromide aqueous solution containing potassium iodide were added by a double jet method at increasing flow rate. The concentration of the potassium iodide was adjusted to make the silver iodide content of 0.5 mol %. During the operation, the pAg was kept at 8.9. On the way, potassium hexachloroiridate (III) and sodium benzene thiosulfonate were added thereto.

Thereafter, as the outermost layer growth stage, an aqueous solution containing silver nitrate (7.4 g) and a potassium bromide aqueous solution containing potassium iodide were added to the mixture over a period of 5 minutes. The concentration of the potassium iodide was adjusted to make the silver iodide content of 10 mol %. During the operation, the pAg was kept at 8.9. After water washing in a normal manner, the amount of silver and gelatin per 1 kg of the emulsion was adjusted by the addition of phthalated gelatin to be equivalent to those of silver halide emulsion A, and then the pH and the pAg of the resulting emulsion at 40° C. were adjusted to 5.9 and 8.4, respectively.

The obtained silver halide grains had a mean equivalent circular diameter of 0.95 μm, a variation coefficient of an equivalent circular diameter distribution of 12.6%, a mean thickness of 0.055 μm and a mean aspect ratio of 17.2. Tabular grains having an aspect ratio of 2 or more occupied 80% or more of the total projected area. A mean equivalent spherical diameter of the grains was 0.42 μm. Thereby host emulsion D was obtained.

<Preparations of Photosensitive Silver Halide Emulsion D1 to D6>

Using the host emulsion D, emulsions having core/shell type epitaxial junction portion with various halogen compositions were prepared (shown in Table 5). Preparations of the silver halide dispersion were conducted similar to Example 1 except that 0.5 mol/L potassium bromide solution, 0.5 mol/L sodium chloride solution, 0.5 mol/L silver nitrate solution, and 0.5 mol/L potassium iodide solution were employed, and the formation of epitaxial junction portion having an arbitrary halogen composition was performed by adjusting the addition amounts of the potassium bromide solution and the potassium iodide solution.

TABLE 5

| Silver Halide Emulsion No. | Epitaxial Junction: Core Part: Halogen Composition Ratio | Core Part: Silver Amount (mol % vs Host Grain) | Shell Part: Halogen Composition Ratio | Shell Part: Silver Amount (mol % vs Host Grain) |
|---|---|---|---|---|
| D1 | — | — | AgBr | 10 |
| D2 | — | — | AgCl | 10 |
| D3 | Cl/Br = 20/80 | 5 | Cl/Br = 50/50 | 5 |
| D4 | Cl/Br = 40/60 | 5 | Cl/Br = 20/80 | 5 |
| D5 | Cl/Br = 80/20 | 5 | Cl/Br = 10/90 | 5 |
| D6 | Cl/Br = 100/0 | 3 | Cl/Br = 0/100 | 7 |

Chemical Sensitization

Chemical sensitization was applied for ech of the emulsion prepared above with stirring and keeping the temperature at 56° C. At first, thiosulfonate compound-1 described below was added in an amount of $10^{-4}$ mol per 1 mol of silver halide, and then silver iodide grains having a grain size of 0.03 μm were added in an amount of 0.15 mol % with respect to total amount of silver. 3 minutes later, thiourea dioxide was added in an amount of $1\times10^{-6}$ mol per 1 mol of silver, and the reduction sensitization was applied for the period of 22 minutes. Thereafter, 4-hyroxy-6-methyl-1,3,3a,7-tetrazaindene was added in an amount of $3\times10^{-4}$ mol equivalent per 1 mol of silver halide and the following sensitizing dye-1, sensitizing dye-2, and sensitizing dye-3 were added in an amount of $1\times10^{-3}$ mol, $1\times10^{-3}$ mol, and $1\times10^{-4}$ mol per 1 mol of silver respectively, and then further calcium chloride was added.

Subsequently, sodium thiosulfate and selenium compound-1 were added in an amount of $6\times10^{-6}$ mol equivalent and $4\times10^{-6}$ mol equivalent per 1 mol of silver halide, respectively, to the dispersion, thereafter aurichloric acid was added in an amount of $2\times10^{-3}$ mol equivalent per 1 mol of silver halide. Thereto, nucleic acid (trade name: RNA-F, manufactured by Sanyo Kokusaku Pulp Co., Ltd.) was added in an amount of 67 mg equivalent per 1 mol of silver halide. 40 minutes later, water-soluble mercapto compound-1 was added in an amount of $1\times10^{-4}$ mol equivalent per 1 mol of silver halide and cooled to 35° C. to finish the chemical sensitizing step.

Thiosulfonate compound-1

$C_2H_5SO_2SNa$

Selenium compound-1

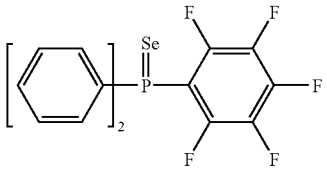

Water-soluble mercapto compound-1

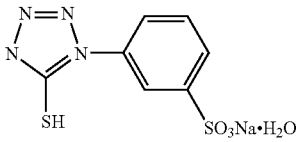

-continued

Sensitizing dye-1

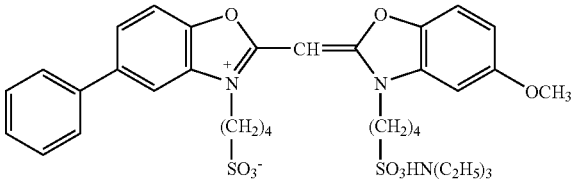

Sensitizing dye-2

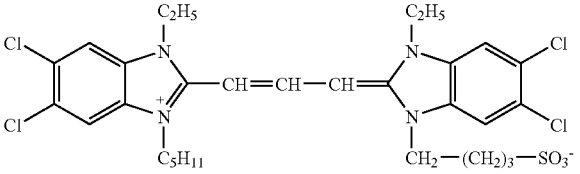

Sensitizing dye-3

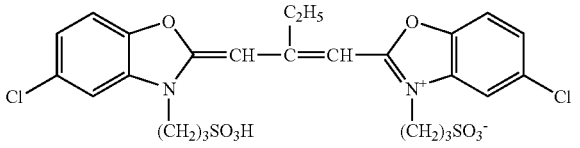

<Preparations of Emulsion for Coating Solution>

Each of silver halide emulsion D1 to D6 was dissolved and thereto was added benzothiazolium iodide in a 1% by weight aqueous solution at $7\times10^{-3}$ mol per 1 mol of silver. Further, as "a compound that can be one-electron-oxidized to provide a one-electron oxidation product, which releases one or more electrons", the compounds Nos. 1, 2, and 3 were added respectively in an amount of $2\times10^{-3}$ mol per 1 mol of silver in silver halide.

Thereafter, as "a compound having an adsorptive group and a reducing group", the compound Nos. 1 and 2 were added respectively in an amount of $8\times10^{-3}$ mol per 1 mol of silver halide.

Further, water was added thereto to give the content of silver halide of 15.6 g in terms of silver, per 1 liter of the emulsion for a coating solution.

2. Preparations of Sample

Double-sided photothermographic material 31 to 36 were prepared similar to Example 1 except that changing the silver halide emulsion for coating solution to the emulsion for coating solution D1 to D6.

3. Evaluation of Photographic Properties

Evaluation was performed similar to Example 1, except that X-ray exposure was performed similar to Example 1, except that using two sheets of X-ray orthochomatic screen HG-M produced by Fuji Photo Film Co., Ltd. as a fluorescent screen (using as fluorescent substance a terbium activated gadolinium oxysulfide fluorescent substance, emission peak wavelength of 545 nm) and providing the assembly for image formation by inserting the sample between them.

The obtained results are shown in Table 6.

It is apparent from the results that the photothermographic materials of the present invention exhibit high sensitivity and an extremely well improved performance in deterioration in sensitivity at raw stock storage.

TABLE 6

| Sample No. | Silver Halide Emulsion No. | Photographic Properties Fog | Photographic Properties Sensitivity | Raw Stock Storability Fog | Raw Stock Storability Sensitivity | Print-out Δ Fog | Note |
|---|---|---|---|---|---|---|---|
| 31 | D1 | 0.21 | 100 | 0.24 | 72 | 0.04 | Comparative |
| 32 | D2 | 0.19 | 69 | 0.22 | 66 | 0.04 | Comparative |
| 33 | D3 | 0.20 | 89 | 0.23 | 80 | 0.04 | Invention |
| 34 | D4 | 0.21 | 102 | 0.23 | 93 | 0.04 | Invention |
| 35 | D5 | 0.19 | 118 | 0.22 | 108 | 0.04 | Invention |
| 36 | D6 | 0.21 | 121 | 0.24 | 99 | 0.04 | Invention |

Example 4

1. Preparations of Samples

Preparations of sample Nos. 41 to 47 were conducted similar to the process in the preparation of sample No. 33 in Example 3, except that using the following photosensitive silver halide emulsion E1 to E7 instead of using photosensitive silver halide emulsion D3.

(Preparations of Photosensitive Silver Halide Emulsion E1 to E7)

<Host Grains>

The same host grains as those in Example 3 were used.

<Preparations of Epitaxial Junction Portion>

Epitaxial junction portions having a threefold structure were prepared. Details of each layer are shown in Table 7.

2. Evaluation of Photographic Properties

Evaluation was performed similar to Example 3. The obtained results are shown in Table 8.

It is apparent from the results that the photothermographic materials of the present invention exhibit high sensitivity and extremely well improved performances in deterioration in sensitivity at raw stock storage and deterioration in fog.

TABLE 7

| Silver Halide Emulsion No. | Epitaxial Junction: Core Part Halogen Composition Ratio | Core Part Silver Amount (mol % vs Host Grain) | Intermediate Part Halogen Composition Ratio | Intermediate Part Silver Amount (mol % vs Host Grain) | Shell Part Halogen Composition Ratio | Shell Part Silver Amount (mol % vs Host Grain) |
|---|---|---|---|---|---|---|
| D3 | Cl/Br = 20/80 | 5 | — | — | Cl/Br = 50/50 | 5 |
| E1 | Cl/Br = 20/80 | 2 | Cl/Br/I = 0/90/10 | 3 | Cl/Br = 50/50 | 5 |
| E2 | Cl/Br = 20/80 | 2 | Cl/Br/I = 0/75/25 | 3 | Cl/Br = 50/50 | 5 |
| E3 | Cl/Br = 20/80 | 3 | Cl/Br/I = 0/66/34 | 2 | Cl/Br = 50/50 | 5 |
| E4 | Cl/Br = 40/60 | 3 | Cl/Br/I = 0/90/10 | 3 | Cl/Br = 20/80 | 4 |
| E5 | Cl/Br = 80/20 | 3 | Cl/Br/I = 0/90/10 | 3 | Cl/Br = 10/90 | 4 |
| E6 | Cl/Br = 80/20 | 5 | Cl/Br/I = 0/90/10 | 2 | Cl/Br = 20/80 | 3 |
| E7 | Cl/Br = 100/1 | 5 | Cl/Br/I = 0/0/100 | 1 | Cl/Br = 0/100 | 4 |

TABLE 8

| Sample No. | Silver Halide Emulsion No. | Photographic Properties Fog | Photographic Properties Sensitivity | Raw Stock Storability Fog | Raw Stock Storability Sensitivity | Print-out Δ Fog | Note |
|---|---|---|---|---|---|---|---|
| 33 | D3 | 0.20 | 89 | 0.23 | 80 | 0.04 | Invention |
| 41 | E1 | 0.20 | 99 | 0.22 | 84 | 0.04 | Invention |
| 42 | E2 | 0.20 | 106 | 0.22 | 90 | 0.04 | Invention |
| 43 | E3 | 0.20 | 112 | 0.21 | 94 | 0.04 | Invention |
| 44 | E4 | 0.21 | 118 | 0.22 | 95 | 0.04 | Invention |
| 45 | E5 | 0.20 | 115 | 0.23 | 99 | 0.04 | Invention |
| 46 | E6 | 0.19 | 109 | 0.21 | 100 | 0.04 | Invention |
| 47 | E7 | 0.19 | 121 | 0.20 | 111 | 0.04 | Invention |

Example 5

1. Preparations of Sample

A single-sided photothermographic material having the image forming layer only on one side and disposing a back layer on the opposite side of the support from the image forming layer was prepared similar to Example 1. The image forming layer had the same composition ratio as that of sample No. 45 of Example 4 and the amount of coated silver (total amount of silver contained in silver salt of fatty acid and silver halide) was adjusted to be 1.6 g/m$^2$.

<Constitution of Back Layer>

1) Preparation of Coating Solution for Antihalation Layer

A vessel was kept at 40° C., and thereto were added 40 g of gelatin, 20 g of monodispersed polymethyl methacrylate fine particles (mean particle size of 8 μm, standard deviation of particle diameter of 0.4), 0.1 g of benzoisothiazolinone, and 490 mL of water to allow gelatin to be dissolved. Additionally, 2.3 mL of a 1 mol/L sodium hydroxide aqueous solution, 40 g of the following dispersion of solid fine particles of the orthochromatic thermal bleaching dye, 90 g of the following dispersion of solid fine particles (a) of the base precursor, 12 mL of a 3% by weight aqueous solution of sodium polystyrenesulfonate, and 180 g of a 10% by weight solution of SBR latex were admixed. Just prior to the coating, 80 mL of a 4% by weight aqueous solution of N,N-ethylenebis(vinylsulfone acetamide) was admixed to give a coating solution for the antihalation layer.

2) Crossover Cut Layer (Preparation of Dispersion of Solid Fine Particles (a) of Base Precursor)

2.5 kg of base precursor-1, 300 g of a surfactant (trade name: DEMOL N, manufactured by Kao Corporation), 800 g of diphenyl sulfone, and 1.0 g of benzoisothiazolinone sodium salt were mixed with distilled water to give the total amount of 8.0 kg. This mixed liquid was subjected to beads dispersion using a horizontal sand mill (UVM-2: manufactured by AIMEX Co., Ltd.).

Method for dispersion includes feeding the mixed liquid to UVM-2 packed with zirconia beads having a mean particle diameter of 0.5 mm with a diaphragm pump, followed by the dispersion at the inner pressure of 50 hPa or higher until desired mean particle diameter could be achieved.

Dispersion was continued until the ratio of the optical density at 450 nm to the optical density at 650 nm for the spectral absorption of the dispersion ($D_{450}/D_{650}$) became 3.0 upon spectral absorption measurement. The obtained dispersion was diluted with distilled water, thereby adjusting the concentration of the base precursor to be 25% by weight, and was subjected to filtration (with a polypropylene filter having a mean fine pore diameter of 3 μm) for removing dust to put into practical use.

(Preparation of Dispersion of Solid Fine Particle of Orthochromatic Thermal Bleaching Dye)

Orthochromatic thermal bleaching dye-1 (λ max=566 nm) described in JP-A No. 11-231457 in an amount of 6.0 kg, 3.0 kg of sodium p-dodecylbenzenesulfonate, 0.6 kg of DEMOL SNB (a surfactant manufactured by Kao Corporation), and 0.15 kg of a defoaming agent (trade name: SURFYNOL 104E, manufactured by Nissin Chemical Industry Co., Ltd.) were mixed with distilled water to give the total amount of 60 kg. The mixed liquid was subjected to dispersion with 0.5 mm zirconia beads using a horizontal sand mill (UVM-2: manufactured by AIMEX Co., Ltd.).

Dispersion was continued until the ratio of the optical density at 650 nm to the optical density at 750 nm for the spectral absorption of the dispersion ($D_{650}/D_{750}$) becomes 5.0 or higher upon spectral absorption measurement. The obtained dispersion was diluted with distilled water, thereby adjusting the concentration of the cyanine dye to be 6% by weight, and was subjected to filtration with a filter (mean fine pore diameter: 1 μm) for removing dust to put into practical use.

(Preparation of Coating Solution for Crossover Cut Layer)

17 g of poly(vinyl alcohol) PVA-205 (manufactured by Kuraray Co., Ltd.), 9.6 g of polyacrylamide, 70 g of the dispersion of solid fine particles (a) of the base precursor, 56 g of the dispersion of solid fine particles of the orthochromatic thermal bleaching dye (solid content of dye of 3% by weight), 0.03 g of benzoisothiazolinone, 2.2 g of sodium polystyrenesulfonate, and 844 mL of water were admixed to give a coating solution for the crossover cut layer.

3) Preparation of Coating Solution for Back Surface Protective Layer

A vessel was kept at 40° C., and thereto were added 40 g of gelatin, 35 mg of benzoisothiazolinone, and 840 mL of water to allow gelatin to be dissolved. Additionally, 5.8 mL of a 1 mol/L sodium hydroxide aqueous solution, 5 g of a 10% by weight emulsion of liquid paraffin, 5 g of a 10% by weight emulsion of tri(isostearic acid)-trimethylol-propane, 10 mL of a 5% by weight aqueous solution of di(2-ethylhexyl) sodium sulfosuccinate, 20 mL of a 3% by weight aqueous solution of sodium polystyrenesulfonate, 2.4 mL of a 2% by weight solution of a fluorocarbon surfactant (F-1), 2.4 mL of a 2% by weight solution of another fluorocarbon surfactant (F-2), and 32 g of a 19% by weight solution of methyl methacrylate/styrene/butyl acrylate/hydroxyethyl methacrylate/acrylic acid copolymer (mass ratio of the copolymerization of 57/8/28/5/2) latex were admixed. Just prior to the coating, 25 mL of a 4% by weight aqueous solution of N,N-ethylenebis(vinylsulfone acetamide) was admixed to give a coating solution for the back surface protective layer.

4) Coating of Back Layer

The backside of the undercoated support described above was subjected to simultaneous double coating so that the coating solution for the antihalation layer gave the coating amount of gelatin of 0.52 g/m$^2$, and so that the coating solution for the back surface protective layer gave the coating amount of gelatin of 1.7 g/m$^2$, followed by drying to produce a back layer.

Chemical structures of the compounds used in Example 5 are shown below.

Base precursor-1

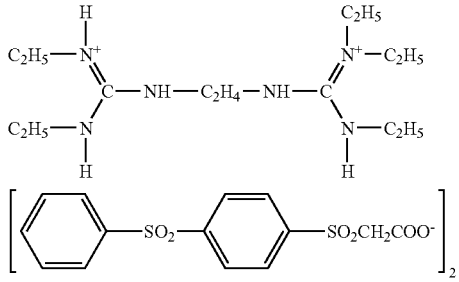

-continued

Orthochromatic thermal bleaching dye-1

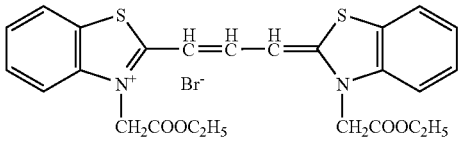

2. Evaluation of Photographic Properties

Thus obtained orthochromatic sensitized single-sided photothermographic material was evaluated as follows.

<Exposure>

As a fluorescent intensifying screen, the fluorescent intensifying screen UM MAMMO FINE for mammography (using as fluorescent substance, a terbium activated gadolinium oxysulfide fluorescent substance, the emission peak wavelength of 545 nm) produced by Fuji Photo Film Co., Ltd. was used.

The photothermographic material and the intensifying screen were loaded in ECMA cassette produced by Fuji Photo Film Co., Ltd. so as the image forming layer of the photothermographic material came in contact with the surface protective layer of the screen. X-ray exposure was performed after arranging so that the top plate of cassette, the photothermographic material and the screen might be set, from X-ray tube, in turn.

The commercially available mammography apparatus DRX-B1356EC produced by Toshiba Corp. was used as an X-ray source. The X-ray emitted from the molydenum target tube operated by three-phase electric power at 26 kVp, which penetrated Be of 1 mm, Mo of 0.03 mm and an acrylic filter of 2 cm, was used. By a distance method, the exposure value of X-ray was changed, while the photothermographic material was subjected to exposure for one second with a step wedge tablet having a width of 0.15 in terms of log E.

<Thermal Development>

The photothermographic material was subjected to thermal development utilizing the thermal developing portion of Fuji Medical Dry Laser Imager FM-DPL. The temperatures of four panel heaters were set to 112° C.-119° C.-121° C.-121° C. and total time period for thermal development was set to be 24 seconds.

On the other hand, UM-MAHC film for mammographic use produced by Fuji Photo Film Co., Ltd. was subjected to X-ray exposure in the same condition as above, and processed for 90 seconds with the automatic photographic processor CEPROS-M2 and Developer CE-D1 (both produced by Fuji Photo Film Co., Ltd.) to obtain an image.

As a result of comparing photographic properties of both images, similar excellent properties were attained.

What is claimed is:

1. A photothermographic material comprising, on at least one side of a support, an image forming layer comprising at least a photosensitive silver halide, a non-photosensitive organic silver salt, a reducing agent, and a binder, wherein 50% or more of the total projected area of the photosensitive silver halide is occupied by tabular grains having an aspect ratio of 2 or more, and the grains have at least one epitaxial junction portion having a multifold structure.

2. The photothermographic material according to claim 1, wherein the multifold structure is at least a twofold structure comprising a core part and a shell part.

3. The photothermographic material according to claim 2, wherein the core part has a silver chloride content of 40 mol % or higher and the shell part has a silver chloride content of 30 mol % or lower.

4. The photothermographic material according to claim 3, wherein the core part comprises silver chloride and the shell part comprises silver bromide.

5. The photothermographic material according to claim 1, wherein the multifold structure comprises at least a threefold structure comprising a core part, an intermediate part, and a shell part.

6. The photothermographic material according to claim 5, wherein at least one of the core part or the intermediate part has a silver iodide content of 4 mol % or higher.

7. The photothermographic material according to claim 6, wherein a silver iodide content of the intermediate part is 10 mol % or higher.

8. The photothermographic material according to claim 5, wherein the core part comprises silver chloride or silver bromide, the intermediate part comprises silver iodide, and the shell part comprises silver bromide.

9. The photothermographic material according to claim 8, wherein the core part comprises silver chloride.

10. The photothermographic material according to claim 1, wherein an average silver iodide content of the tabular grains is 40 mol % or higher.

11. The photothermographic material according to claim 10, wherein the average silver iodide content of the tabular grains is 80 mol % or higher.

12. The photothermographic material according to claim 11, wherein the average silver iodide content of the tabular grains is 90 mol % or higher.

13. The photothermographic material according to claim 1, wherein a mean equivalent spherical diameter of the silver halide is from 0.3 μm to 5.0 μm.

14. The photothermographic material according to claim 1, wherein a mean aspect ratio of the silver halide is 5 or more.

15. The photothermographic material according to claim 10, further comprising a silver iodide complex-forming agent.

16. The photothermographic material according to claim 1, having the image forming layer on both sides of the support.

17. An image forming method using a photothermographic material comprising, on both sides of a support, an image forming layer comprising at least a photosensitive silver halide, a non-photosensitive organic silver salt, a reducing agent, and a binder, wherein 50% or more of a total projected area of the photosensitive silver halide is occupied by tabular grains having an aspect ratio of 2 or more, and the grains have at least one epitaxial junction portion having a multifold structure, wherein the method comprises:

(a) providing an assembly for forming an image by placing the photothermographic material between a pair of fluorescent intensifying screens;

(b) putting an analyte between the assembly and an X-ray source;

(c) irradiating the analyte with X-rays having an energy level in a range of from 25 kVp to 125 kVp;

(d) taking the photothermographic material out of the assembly; and (e) heating the removed photothermographic material in a temperature range of from 90° C. to 180° C.

* * * * *